US007236147B2

(12) United States Patent
Morita et al.

(10) Patent No.: US 7,236,147 B2
(45) Date of Patent: Jun. 26, 2007

(54) DISPLAY DEVICE, AND DISPLAY METHOD

(75) Inventors: Tomoko Morita, Hirakata (JP); Mitsuhiro Kasahara, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 687 days.

(21) Appl. No.: 10/069,526

(22) PCT Filed: Jul. 5, 2001

(86) PCT No.: PCT/JP01/05859

§ 371 (c)(1),
(2), (4) Date: Mar. 6, 2002

(87) PCT Pub. No.: WO02/05253

PCT Pub. Date: Jan. 17, 2002

(65) Prior Publication Data

US 2002/0135595 A1 Sep. 26, 2002

(30) Foreign Application Priority Data

Jul. 7, 2000 (JP) ..... 2000-206422
Jun. 29, 2001 (JP) ..... 2001-200114

(51) Int. Cl.
*G09G 3/28* (2006.01)

(52) U.S. Cl. ..... 345/63; 345/690

(58) Field of Classification Search ..... 345/60, 345/63, 66, 690, 204, 596, 599
See application file for complete search history.

(56) References Cited

U.S. PATENT DOCUMENTS 5,790,095 A 8/1998 Onodera et al.
6,069,609 A 5/2000 Ishida et al.
6,097,358 A 8/2000 Hirakawa et al.
6,144,364 A 11/2000 Otobe et al. ..... 345/147
6,414,658 B1 * 7/2002 Tokunaga ..... 345/63
6,646,625 B1 11/2003 Shigeta et al.
7,071,902 B1 * 7/2006 Kawahara ..... 345/63

FOREIGN PATENT DOCUMENTS

EP 0994457 4/2000

(Continued)

OTHER PUBLICATIONS

"New Category Contour Noise Observed in Pulse-Width-Modulation Moving Images" by Matsuda et al., Technical Report of Television Institute, vol. 19, No. 2, IDY95-21, pp. 61-66, together with an English Language Abstract of Same.

*Primary Examiner*—Jimmy H. Nguyen
(74) *Attorney, Agent, or Firm*—Greenblum & Bernstein, P.L.C.

(57) ABSTRACT

A gray level conversion/diffusion circuit diffuses the difference between a non-display gray level and a display gray level by error diffusion processing when a video signal is a video signal of the non-display gray level, a video signal-sub-field corresponder converts a video signal of one field after diffusion to a video signal every sub-field, and a sub-field processor, a scanning and sustain driving circuits and a data driving circuit make a discharge cell of a plasma display panel emit light or emit no light every sub-field in response to the video signal every sub-field.

21 Claims, 30 Drawing Sheets

FOREIGN PATENT DOCUMENTS

| | | |
|---|---|---|
| EP | 1022714 | 7/2000 |
| JP | 2-125287 | 5/1990 |
| JP | 7-175440 | 7/1995 |
| JP | 08146908 | 6/1996 |
| JP | 8-190361 | 7/1996 |
| JP | 8-286634 | 11/1996 |
| JP | 9-81072 | 3/1997 |
| JP | 9-222870 | 8/1997 |
| JP | 9-222873 | 8/1997 |
| JP | 10-31455 | 2/1998 |
| JP | 10031455 | 2/1998 |
| JP | 11-95718 | 4/1999 |
| JP | 11143420 | 5/1999 |
| JP | 2000-188702 | 7/2000 |
| JP | 2000276102 | 10/2000 |

* cited by examiner

F I G. 4

| | SUB-FIELD | | | | | | | | | | DISPLAY AVAILABLE/ UNAVAILABLE | CONVERTED VALUE | ERROR | DITHER |
|---|---|---|---|---|---|---|---|---|---|---|---|---|---|---|
| WEIGHT / GRAY LEVELS | SF1 | SF2 | SF3 | SF4 | SF5 | SF6 | SF7 | SF8 | SF9 | SF10 | | | | |
| | 1 | 3 | 6 | 12 | 19 | 26 | 34 | 42 | 51 | 61 | | | | |
| 0 | | | | | | | | | | | ○ | 0 | 0 | |
| 1 | ○ | | | | | | | | | | ○ | 1 | 0 | |
| 2 | – | – | – | – | – | – | – | – | – | – | × | 1 | 1 | ±1 |
| 3 | | ○ | | | | | | | | | ○ | 3 | 0 | |
| 4 | ○ | ○ | | | | | | | | | ○ | 4 | 0 | |
| 5 | – | – | – | – | – | – | – | – | – | – | × | 4 | 1 | ±1 |
| 6 | | | ○ | | | | | | | | ○ | 6 | 0 | |
| 7 | ○ | | ○ | | | | | | | | ○ | 7 | 0 | |
| 8 | – | – | – | – | – | – | – | – | – | – | × | 7 | 1 | ±1 |
| 9 | | ○ | ○ | | | | | | | | ○ | 9 | 0 | |
| 10 | ○ | ○ | ○ | | | | | | | | ○ | 10 | 0 | |
| 11 | – | – | – | – | – | – | – | – | – | – | × | 10 | 1 | ±1 |
| 12 | | | | ○ | | | | | | | ○ | 12 | 0 | |
| 13 | ○ | | | ○ | | | | | | | ○ | 13 | 0 | |
| 14 | – | – | – | – | – | – | – | – | – | – | × | 13 | 1 | ±1 |
| 15 | | ○ | | ○ | | | | | | | ○ | 15 | 0 | |
| 16 | ○ | ○ | | ○ | | | | | | | ○ | 16 | 0 | |
| 17 | – | – | – | – | – | – | – | – | – | – | × | 16 | 1 | ±1 |
| 18 | | | ○ | ○ | | | | | | | ○ | 18 | 0 | |
| 19 | ○ | | ○ | ○ | | | | | | | ○ | 19 | 0 | |
| 20 | – | – | – | – | – | – | – | – | – | – | × | 19 | 1 | ±1 |
| 21 | | ○ | ○ | ○ | | | | | | | ○ | 21 | 0 | |
| 22 | ○ | ○ | ○ | ○ | | | | | | | ○ | 22 | 0 | |
| 23 | ○ | ○ | | | ○ | | | | | | ○ | 23 | 0 | |
| 24 | – | – | – | – | – | – | – | – | – | – | × | 23 | 1 | ±1 |
| 25 | | | ○ | | ○ | | | | | | ○ | 25 | 0 | |
| 26 | ○ | | ○ | | ○ | | | | | | ○ | 26 | 0 | |
| 27 | – | – | – | – | – | – | – | – | – | – | × | 26 | 1 | ±1 |
| 28 | | ○ | ○ | | ○ | | | | | | ○ | 28 | 0 | |
| 29 | ○ | ○ | ○ | | ○ | | | | | | ○ | 29 | 0 | |
| 30 | – | – | – | – | – | – | – | – | – | – | × | 29 | 1 | ±1 |
| 31 | | | | ○ | ○ | | | | | | ○ | 31 | 0 | |
| 32 | ○ | | | ○ | ○ | | | | | | ○ | 32 | 0 | |
| 33 | – | – | – | – | – | – | – | – | – | – | × | 32 | 1 | ±1 |
| 34 | | ○ | | ○ | ○ | | | | | | ○ | 34 | 0 | |
| 35 | ○ | ○ | | ○ | ○ | | | | | | ○ | 35 | 0 | |
| 36 | – | – | – | – | – | – | – | – | – | – | × | 35 | 1 | ±1 |
| 37 | | | ○ | ○ | ○ | | | | | | ○ | 37 | 0 | |
| 38 | ○ | | ○ | ○ | ○ | | | | | | ○ | 38 | 0 | |
| 39 | – | – | – | – | – | – | – | – | – | – | × | 38 | 1 | ±1 |
| 40 | | ○ | ○ | ○ | ○ | | | | | | ○ | 40 | 0 | |
| 41 | ○ | ○ | ○ | ○ | ○ | | | | | | ○ | 41 | 0 | |
| 42 | ○ | ○ | | ○ | | ○ | | | | | ○ | 42 | 0 | |
| 43 | – | – | – | – | – | – | – | – | – | – | × | 42 | 1 | ±1 |
| 44 | | | ○ | ○ | | ○ | | | | | ○ | 44 | 0 | |
| 45 | ○ | | ○ | ○ | | ○ | | | | | ○ | 45 | 0 | |
| 46 | – | – | – | – | – | – | – | – | – | – | × | 45 | 1 | ±1 |
| 47 | | ○ | ○ | ○ | | ○ | | | | | ○ | 47 | 0 | |
| 48 | ○ | ○ | ○ | ○ | | ○ | | | | | ○ | 48 | 0 | |
| 49 | ○ | ○ | | | ○ | ○ | | | | | ○ | 49 | 0 | |
| 50 | – | – | – | – | – | – | – | – | – | – | × | 49 | 1 | ±1 |

FIG. 5

| WEIGHT / GRAY LEVELS | SUB-FIELD SF1 | SF2 | SF3 | SF4 | SF5 | SF6 | SF7 | SF8 | SF9 | SF10 | DISPLAY AVAILABLE/ UNAVAILABLE | CONVERTED VALUE | ERROR | DITHER |
|---|---|---|---|---|---|---|---|---|---|---|---|---|---|---|
| | 1 | 3 | 6 | 12 | 19 | 26 | 34 | 42 | 51 | 61 | | | | |
| 51 | | | ○ | | ○ | ○ | | | | | ○ | 51 | 0 | |
| 52 | ○ | | ○ | | ○ | ○ | | | | | ○ | 52 | 0 | |
| 53 | – | – | – | – | – | – | – | – | – | – | × | 52 | 1 | ±1 |
| 54 | | ○ | ○ | | ○ | ○ | | | | | ○ | 54 | 0 | |
| 55 | ○ | ○ | ○ | | ○ | ○ | | | | | ○ | 55 | 0 | |
| 56 | – | – | – | – | – | – | – | – | – | – | × | 55 | 1 | ±1 |
| 57 | | | | ○ | ○ | ○ | | | | | ○ | 57 | 0 | |
| 58 | ○ | | | ○ | ○ | ○ | | | | | ○ | 58 | 0 | |
| 59 | – | – | – | – | – | – | – | – | – | – | × | 58 | 1 | ±1 |
| 60 | | ○ | | ○ | ○ | ○ | | | | | ○ | 60 | 0 | |
| 61 | ○ | ○ | | ○ | ○ | ○ | | | | | ○ | 61 | 0 | |
| 62 | – | – | – | – | – | – | – | – | – | – | × | 61 | 1 | ±1 |
| 63 | | | ○ | ○ | ○ | ○ | | | | | ○ | 63 | 0 | |
| 64 | ○ | | ○ | ○ | ○ | ○ | | | | | ○ | 64 | 0 | |
| 65 | – | – | – | – | – | – | – | – | – | – | × | 64 | 1 | ±1 |
| 66 | | ○ | ○ | ○ | ○ | ○ | | | | | ○ | 66 | 0 | |
| 67 | ○ | ○ | ○ | ○ | ○ | ○ | | | | | ○ | 67 | 0 | |
| 68 | | ○ | | ○ | ○ | | ○ | | | | ○ | 68 | 0 | |
| 69 | ○ | ○ | | ○ | ○ | | ○ | | | | ○ | 69 | 0 | |
| 70 | – | – | – | – | – | – | – | – | – | – | × | 69 | 1 | ±1 |
| 71 | | | ○ | ○ | ○ | | ○ | | | | ○ | 71 | 0 | |
| 72 | ○ | | ○ | ○ | ○ | | ○ | | | | ○ | 72 | 0 | |
| 73 | – | – | – | – | – | – | – | – | – | – | × | 72 | 1 | ±1 |
| 74 | | ○ | ○ | ○ | ○ | | ○ | | | | ○ | 74 | 0 | |
| 75 | ○ | ○ | ○ | ○ | ○ | | ○ | | | | ○ | 75 | 0 | |
| 76 | ○ | ○ | | ○ | | ○ | ○ | | | | ○ | 76 | 0 | |
| 77 | – | – | – | – | – | – | – | – | – | – | × | 76 | 1 | ±1 |
| 78 | | | ○ | ○ | | ○ | ○ | | | | ○ | 78 | 0 | |
| 79 | ○ | | ○ | ○ | | ○ | ○ | | | | ○ | 79 | 0 | |
| 80 | – | – | – | – | – | – | – | – | – | – | × | 79 | 1 | ±1 |
| 81 | | ○ | ○ | ○ | | ○ | ○ | | | | ○ | 81 | 0 | |
| 82 | ○ | ○ | ○ | ○ | | ○ | ○ | | | | ○ | 82 | 0 | |
| 83 | ○ | ○ | | | ○ | ○ | ○ | | | | ○ | 83 | 0 | |
| 84 | – | – | – | – | – | – | – | – | – | – | × | 83 | 1 | ±1 |
| 85 | | | ○ | | ○ | ○ | ○ | | | | ○ | 85 | 0 | |
| 86 | ○ | | ○ | | ○ | ○ | ○ | | | | ○ | 86 | 0 | |
| 87 | – | – | – | – | – | – | – | – | – | – | × | 86 | 1 | ±1 |
| 88 | | ○ | ○ | | ○ | ○ | ○ | | | | ○ | 88 | 0 | |
| 89 | ○ | ○ | ○ | | ○ | ○ | ○ | | | | ○ | 89 | 0 | |
| 90 | – | – | – | – | – | – | – | – | – | – | × | 89 | 1 | ±1 |
| 91 | | | | ○ | ○ | ○ | ○ | | | | ○ | 91 | 0 | |
| 92 | ○ | | | ○ | ○ | ○ | ○ | | | | ○ | 92 | 0 | |
| 93 | – | – | – | – | – | – | – | – | – | – | × | 92 | 1 | ±1 |
| 94 | | ○ | | ○ | ○ | ○ | ○ | | | | ○ | 94 | 0 | |
| 95 | ○ | ○ | | ○ | ○ | ○ | ○ | | | | ○ | 95 | 0 | |
| 96 | – | – | – | – | – | – | – | – | – | – | × | 95 | 1 | ±1 |
| 97 | | | ○ | ○ | ○ | ○ | ○ | | | | ○ | 97 | 0 | |
| 98 | ○ | | ○ | ○ | ○ | ○ | ○ | | | | ○ | 98 | 0 | |
| 99 | – | – | – | – | – | – | – | – | – | – | × | 98 | 1 | ±1 |
| 100 | | ○ | ○ | ○ | ○ | ○ | ○ | | | | ○ | 100 | 0 | |
| 101 | ○ | ○ | ○ | ○ | ○ | ○ | ○ | | | | ○ | 101 | 0 | |

FIG. 6

| WEIGHT / GRAY LEVELS | SUB-FIELD SF1 | SF2 | SF3 | SF4 | SF5 | SF6 | SF7 | SF8 | SF9 | SF10 | DISPLAY AVAILABLE/ UNAVAILABLE | CONVERTED VALUE | ERROR | DITHER |
|---|---|---|---|---|---|---|---|---|---|---|---|---|---|---|
| | 1 | 3 | 6 | 12 | 19 | 26 | 34 | 42 | 51 | 61 | | | | |
| 102 | | ○ | | ○ | ○ | ○ | | ○ | | | ○ | 102 | 0 | |
| 103 | ○ | ○ | | ○ | ○ | ○ | | ○ | | | ○ | 103 | 0 | |
| 104 | — | — | — | — | — | — | — | — | — | — | × | 103 | 1 | ±1 |
| 105 | | | ○ | ○ | ○ | ○ | | ○ | | | ○ | 105 | 0 | |
| 106 | ○ | | ○ | ○ | ○ | ○ | | ○ | | | ○ | 106 | 0 | |
| 107 | — | — | — | — | — | — | — | — | — | — | × | 106 | 1 | ±1 |
| 108 | | ○ | ○ | ○ | ○ | ○ | | ○ | | | ○ | 108 | 0 | |
| 109 | ○ | ○ | ○ | ○ | ○ | ○ | | ○ | | | ○ | 109 | 0 | |
| 110 | | ○ | | ○ | ○ | | ○ | ○ | | | ○ | 110 | 0 | |
| 111 | ○ | ○ | | ○ | ○ | | ○ | ○ | | | ○ | 111 | 0 | |
| 112 | — | — | — | — | — | — | — | — | — | — | × | 111 | 1 | ±1 |
| 113 | | | ○ | ○ | ○ | | ○ | ○ | | | ○ | 113 | 0 | |
| 114 | ○ | | ○ | ○ | ○ | | ○ | ○ | | | ○ | 114 | 0 | |
| 115 | — | — | — | — | — | — | — | — | — | — | × | 114 | 1 | ±1 |
| 116 | | ○ | ○ | ○ | ○ | | ○ | ○ | | | ○ | 116 | 0 | |
| 117 | ○ | ○ | ○ | ○ | ○ | | ○ | ○ | | | ○ | 117 | 0 | |
| 118 | ○ | ○ | | ○ | | ○ | ○ | ○ | | | ○ | 118 | 0 | |
| 119 | — | — | — | — | — | — | — | — | — | — | × | 118 | 1 | ±1 |
| 120 | | | ○ | ○ | | ○ | ○ | ○ | | | ○ | 120 | 0 | |
| 121 | ○ | | ○ | ○ | | ○ | ○ | ○ | | | ○ | 121 | 0 | |
| 122 | — | — | — | — | — | — | — | — | — | — | × | 121 | 1 | ±1 |
| 123 | | ○ | ○ | ○ | | ○ | ○ | ○ | | | ○ | 123 | 0 | |
| 124 | ○ | ○ | ○ | ○ | | ○ | ○ | ○ | | | ○ | 124 | 0 | |
| 125 | ○ | ○ | | | ○ | ○ | ○ | ○ | | | ○ | 125 | 0 | |
| 126 | — | — | — | — | — | — | — | — | — | — | × | 125 | 1 | ±1 |
| 127 | | ○ | ○ | ○ | ○ | ○ | ○ | | | | ○ | 127 | 0 | |
| 128 | ○ | | ○ | | ○ | ○ | ○ | ○ | | | ○ | 128 | 0 | |
| 129 | — | — | — | — | — | — | — | — | — | — | × | 128 | 1 | ±1 |
| 130 | | ○ | ○ | | ○ | ○ | ○ | ○ | | | ○ | 130 | 0 | |
| 131 | ○ | ○ | ○ | | ○ | ○ | ○ | ○ | | | ○ | 131 | 0 | |
| 132 | — | — | — | — | — | — | — | — | — | — | × | 131 | 1 | ±1 |
| 133 | | | | ○ | ○ | ○ | ○ | ○ | | | ○ | 133 | 0 | |
| 134 | ○ | | | ○ | ○ | ○ | ○ | ○ | | | ○ | 134 | 0 | |
| 135 | — | — | — | — | — | — | — | — | — | — | × | 134 | 1 | ±1 |
| 136 | | ○ | | ○ | ○ | ○ | ○ | ○ | | | ○ | 136 | 0 | |
| 137 | ○ | ○ | | ○ | ○ | ○ | ○ | ○ | | | ○ | 137 | 0 | |
| 138 | — | — | — | — | — | — | — | — | — | — | × | 137 | 1 | ±1 |
| 139 | | | ○ | ○ | ○ | ○ | ○ | ○ | | | ○ | 139 | 0 | |
| 140 | ○ | | ○ | ○ | ○ | ○ | ○ | ○ | | | ○ | 140 | 0 | |
| 141 | — | — | — | — | — | — | — | — | — | — | × | 140 | 1 | ±1 |
| 142 | | ○ | ○ | ○ | ○ | ○ | ○ | ○ | | | ○ | 142 | 0 | |
| 143 | ○ | ○ | ○ | ○ | ○ | ○ | ○ | ○ | | | ○ | 143 | 0 | |
| 144 | — | — | — | — | — | — | — | — | — | — | × | 143 | 1 | ±1 |
| 145 | | ○ | | ○ | ○ | ○ | ○ | | ○ | | ○ | 145 | 0 | |
| 146 | ○ | ○ | | ○ | ○ | ○ | ○ | | ○ | | ○ | 146 | 0 | |
| 147 | — | — | — | — | — | — | — | — | — | — | × | 146 | 1 | ±1 |
| 148 | | | ○ | ○ | ○ | ○ | ○ | | ○ | | ○ | 148 | 0 | |
| 149 | ○ | | ○ | ○ | ○ | ○ | ○ | | ○ | | ○ | 149 | 0 | |
| 150 | — | — | — | — | — | — | — | — | — | — | × | 149 | 1 | ±1 |
| 151 | | ○ | ○ | ○ | ○ | ○ | ○ | | ○ | | ○ | 151 | 0 | |
| 152 | ○ | ○ | ○ | ○ | ○ | ○ | ○ | | ○ | | ○ | 152 | 0 | |

FIG. 7

| WEIGHT / GRAY LEVELS | SUB-FIELD SF1 | SF2 | SF3 | SF4 | SF5 | SF6 | SF7 | SF8 | SF9 | SF10 | DISPLAY AVAILABLE/ UNAVAILABLE | CONVERTED VALUE | ERROR | DITHER |
|---|---|---|---|---|---|---|---|---|---|---|---|---|---|---|
| | 1 | 3 | 6 | 12 | 19 | 26 | 34 | 42 | 51 | 61 | | | | |
| 153 | | ○ | | ○ | ○ | ○ | | ○ | ○ | | ○ | 153 | 0 | |
| 154 | ○ | ○ | | ○ | ○ | ○ | | ○ | ○ | | ○ | 154 | 0 | |
| 155 | — | — | — | — | — | — | — | — | — | — | × | 154 | 1 | ±1 |
| 156 | | | ○ | ○ | ○ | ○ | | ○ | ○ | | ○ | 156 | 0 | |
| 157 | ○ | | ○ | ○ | ○ | ○ | | ○ | ○ | | ○ | 157 | 0 | |
| 158 | — | — | — | — | — | — | — | — | — | — | × | 157 | 1 | ±1 |
| 159 | | ○ | ○ | ○ | ○ | ○ | | ○ | ○ | | ○ | 159 | 0 | |
| 160 | ○ | ○ | ○ | ○ | ○ | ○ | | ○ | ○ | | ○ | 160 | 0 | |
| 161 | | ○ | | ○ | ○ | | ○ | ○ | ○ | | ○ | 161 | 0 | |
| 162 | ○ | ○ | | ○ | ○ | | ○ | ○ | ○ | | ○ | 162 | 0 | |
| 163 | — | — | — | — | — | — | — | — | — | — | × | 162 | 1 | ±1 |
| 164 | | | ○ | ○ | ○ | | ○ | ○ | ○ | | ○ | 164 | 0 | |
| 165 | ○ | | ○ | ○ | ○ | | ○ | ○ | ○ | | ○ | 165 | 0 | |
| 166 | — | — | — | — | — | — | — | — | — | — | × | 165 | 1 | ±1 |
| 167 | | ○ | ○ | ○ | ○ | | ○ | ○ | ○ | | ○ | 167 | 0 | |
| 168 | ○ | ○ | ○ | ○ | ○ | | ○ | ○ | ○ | | ○ | 168 | 0 | |
| 169 | ○ | ○ | | ○ | | ○ | ○ | ○ | ○ | | ○ | 169 | 0 | |
| 170 | — | — | — | — | — | — | — | — | — | — | × | 169 | 1 | ±1 |
| 171 | | | ○ | ○ | | ○ | ○ | ○ | ○ | | ○ | 171 | 0 | |
| 172 | ○ | | ○ | ○ | | ○ | ○ | ○ | ○ | | ○ | 172 | 0 | |
| 173 | — | — | — | — | — | — | — | — | — | — | × | 172 | 1 | ±1 |
| 174 | | ○ | ○ | ○ | | ○ | ○ | ○ | ○ | | ○ | 174 | 0 | |
| 175 | ○ | ○ | ○ | ○ | | ○ | ○ | ○ | ○ | | ○ | 175 | 0 | |
| 176 | ○ | ○ | | | ○ | ○ | ○ | ○ | ○ | | ○ | 176 | 0 | |
| 177 | — | — | — | — | — | — | — | — | — | — | × | 176 | 1 | ±1 |
| 178 | | | ○ | | ○ | ○ | ○ | ○ | ○ | | ○ | 178 | 0 | |
| 179 | ○ | | ○ | | ○ | ○ | ○ | ○ | ○ | | ○ | 179 | 0 | |
| 180 | — | — | — | — | — | — | — | — | — | — | × | 179 | 1 | ±1 |
| 181 | | ○ | ○ | | ○ | ○ | ○ | ○ | ○ | | ○ | 181 | 0 | |
| 182 | ○ | ○ | ○ | | ○ | ○ | ○ | ○ | ○ | | ○ | 182 | 0 | |
| 183 | — | — | — | — | — | — | — | — | — | — | × | 182 | 1 | ±1 |
| 184 | | | | ○ | ○ | ○ | ○ | ○ | ○ | | ○ | 184 | 0 | |
| 185 | ○ | | | ○ | ○ | ○ | ○ | ○ | ○ | | ○ | 185 | 0 | |
| 186 | — | — | — | — | — | — | — | — | — | — | × | 185 | 1 | ±1 |
| 187 | | ○ | | ○ | ○ | ○ | ○ | ○ | ○ | | ○ | 187 | 0 | |
| 188 | ○ | ○ | | ○ | ○ | ○ | ○ | ○ | ○ | | ○ | 188 | 0 | |
| 189 | — | — | — | — | — | — | — | — | — | — | × | 188 | 1 | ±1 |
| 190 | | | ○ | ○ | ○ | ○ | ○ | ○ | ○ | | ○ | 190 | 0 | |
| 191 | ○ | | ○ | ○ | ○ | ○ | ○ | ○ | ○ | | ○ | 191 | 0 | |
| 192 | — | — | — | — | — | — | — | — | — | — | × | 191 | 1 | ±1 |
| 193 | | ○ | ○ | ○ | ○ | ○ | ○ | ○ | ○ | | ○ | 193 | 0 | |
| 194 | ○ | ○ | ○ | ○ | ○ | ○ | ○ | ○ | ○ | | ○ | 194 | 0 | |
| 195 | ○ | | | ○ | ○ | ○ | ○ | ○ | | ○ | ○ | 195 | 0 | |
| 196 | — | — | — | — | — | — | — | — | — | — | × | 195 | 1 | ±1 |
| 197 | | ○ | | ○ | ○ | ○ | ○ | ○ | | ○ | ○ | 197 | 0 | |
| 198 | ○ | ○ | | ○ | ○ | ○ | ○ | ○ | | ○ | ○ | 198 | 0 | |
| 199 | — | — | — | — | — | — | — | — | — | — | × | 198 | 1 | ±1 |
| 200 | | | ○ | ○ | ○ | ○ | ○ | ○ | | ○ | ○ | 200 | 0 | |
| 201 | ○ | | ○ | ○ | ○ | ○ | ○ | ○ | | ○ | ○ | 201 | 0 | |
| 202 | — | — | — | — | — | — | — | — | — | — | × | 201 | 1 | ±1 |
| 203 | | ○ | ○ | ○ | ○ | ○ | ○ | ○ | | ○ | ○ | 203 | 0 | |

FIG. 8

| WEIGHT / GRAY LEVELS | SUB-FIELD SF1 | SF2 | SF3 | SF4 | SF5 | SF6 | SF7 | SF8 | SF9 | SF10 | DISPLAY AVAILABLE/ UNAVAILABLE | CONVERTED VALUE | ERROR | DITHER |
|---|---|---|---|---|---|---|---|---|---|---|---|---|---|---|
| | 1 | 3 | 6 | 12 | 19 | 26 | 34 | 42 | 51 | 61 | | | | |
| 204 | ○ | ○ | ○ | ○ | ○ | ○ | ○ | ○ | | ○ | ○ | 204 | 0 | |
| 205 | — | — | — | — | — | — | — | — | — | — | × | 204 | 1 | ±1 |
| 206 | | ○ | | ○ | ○ | ○ | ○ | | ○ | ○ | ○ | 206 | 0 | |
| 207 | ○ | ○ | | ○ | ○ | ○ | ○ | | ○ | ○ | ○ | 207 | 0 | |
| 208 | — | — | — | — | — | — | — | — | — | — | × | 207 | 1 | ±1 |
| 209 | | | ○ | ○ | ○ | ○ | ○ | | ○ | ○ | ○ | 209 | 0 | |
| 210 | ○ | | ○ | ○ | ○ | ○ | ○ | | ○ | ○ | ○ | 210 | 0 | |
| 211 | — | — | — | — | — | — | — | — | — | — | × | 210 | 1 | ±1 |
| 212 | | ○ | ○ | ○ | ○ | ○ | ○ | | ○ | ○ | ○ | 212 | 0 | |
| 213 | ○ | ○ | ○ | ○ | ○ | ○ | ○ | | ○ | ○ | ○ | 213 | 0 | |
| 214 | | ○ | | ○ | ○ | ○ | | ○ | ○ | ○ | ○ | 214 | 0 | |
| 215 | ○ | ○ | | ○ | ○ | ○ | | ○ | ○ | ○ | ○ | 215 | 0 | |
| 216 | — | — | — | — | — | — | — | — | — | — | × | 215 | 1 | ±1 |
| 217 | | | ○ | ○ | ○ | ○ | | ○ | ○ | ○ | ○ | 217 | 0 | |
| 218 | ○ | | ○ | ○ | ○ | ○ | | ○ | ○ | ○ | ○ | 218 | 0 | |
| 219 | — | — | — | — | — | — | — | — | — | — | × | 218 | 1 | ±1 |
| 220 | | ○ | ○ | ○ | ○ | ○ | | ○ | ○ | ○ | ○ | 220 | 0 | |
| 221 | ○ | ○ | ○ | ○ | ○ | ○ | | ○ | ○ | ○ | ○ | 221 | 0 | |
| 222 | | ○ | | ○ | ○ | | ○ | ○ | ○ | ○ | ○ | 222 | 0 | |
| 223 | ○ | ○ | | ○ | ○ | | ○ | ○ | ○ | ○ | ○ | 223 | 0 | |
| 224 | — | — | — | — | — | — | — | — | — | — | × | 223 | 1 | ±1 |
| 225 | | | ○ | ○ | ○ | | ○ | ○ | ○ | ○ | ○ | 225 | 0 | |
| 226 | ○ | | ○ | ○ | ○ | | ○ | ○ | ○ | ○ | ○ | 226 | 0 | |
| 227 | — | — | — | — | — | — | — | — | — | — | × | 226 | 1 | ±1 |
| 228 | | ○ | ○ | ○ | ○ | | ○ | ○ | ○ | ○ | ○ | 228 | 0 | |
| 229 | ○ | ○ | ○ | ○ | ○ | | ○ | ○ | ○ | ○ | ○ | 229 | 0 | |
| 230 | ○ | ○ | | ○ | | ○ | ○ | ○ | ○ | ○ | ○ | 230 | 0 | |
| 231 | — | — | — | — | — | — | — | — | — | — | × | 230 | 1 | ±1 |
| 232 | | | ○ | ○ | | ○ | ○ | ○ | ○ | ○ | ○ | 232 | 0 | |
| 233 | ○ | | ○ | ○ | | ○ | ○ | ○ | ○ | ○ | ○ | 233 | 0 | |
| 234 | — | — | — | — | — | — | — | — | — | — | × | 233 | 1 | ±1 |
| 235 | | ○ | ○ | ○ | | ○ | ○ | ○ | ○ | ○ | ○ | 235 | 0 | |
| 236 | ○ | ○ | ○ | ○ | | ○ | ○ | ○ | ○ | ○ | ○ | 236 | 0 | |
| 237 | ○ | ○ | | | ○ | ○ | ○ | ○ | ○ | ○ | ○ | 237 | 0 | |
| 238 | — | — | — | — | — | — | — | — | — | — | × | 237 | 1 | ±1 |
| 239 | | | ○ | | ○ | ○ | ○ | ○ | ○ | ○ | ○ | 239 | 0 | |
| 240 | ○ | | ○ | | ○ | ○ | ○ | ○ | ○ | ○ | ○ | 240 | 0 | |
| 241 | — | — | — | — | — | — | — | — | — | — | × | 240 | 1 | ±1 |
| 242 | | ○ | ○ | | ○ | ○ | ○ | ○ | ○ | ○ | ○ | 242 | 0 | |
| 243 | ○ | ○ | ○ | | ○ | ○ | ○ | ○ | ○ | ○ | ○ | 243 | 0 | |
| 244 | — | — | — | — | — | — | — | — | — | — | × | 243 | 1 | ±1 |
| 245 | | | | ○ | ○ | ○ | ○ | ○ | ○ | ○ | ○ | 245 | 0 | |
| 246 | ○ | | | ○ | ○ | ○ | ○ | ○ | ○ | ○ | ○ | 246 | 0 | |
| 247 | — | — | — | — | — | — | — | — | — | — | × | 246 | 1 | ±1 |
| 248 | | ○ | | ○ | ○ | ○ | ○ | ○ | ○ | ○ | ○ | 248 | 0 | |
| 249 | ○ | ○ | | ○ | ○ | ○ | ○ | ○ | ○ | ○ | ○ | 249 | 0 | |
| 250 | — | — | — | — | — | — | — | — | — | — | × | 249 | 1 | ±1 |
| 251 | | | ○ | ○ | ○ | ○ | ○ | ○ | ○ | ○ | ○ | 251 | 0 | |
| 252 | ○ | | ○ | ○ | ○ | ○ | ○ | ○ | ○ | ○ | ○ | 252 | 0 | |
| 253 | — | — | — | — | — | — | — | — | — | — | × | 252 | 1 | ±1 |
| 254 | | ○ | ○ | ○ | ○ | ○ | ○ | ○ | ○ | ○ | ○ | 254 | 0 | |
| 255 | ○ | ○ | ○ | ○ | ○ | ○ | ○ | ○ | ○ | ○ | ○ | 255 | 0 | |

FIG. 12

| WEIGHT / GRAY LEVELS | SUB-FIELD SF1 | SF2 | SF3 | SF4 | SF5 | SF6 | SF7 | SF8 | SF9 | SF10 | DISPLAY AVAILABLE/ UNAVAILABLE | CONVERTED VALUE | ERROR | DITHER |
|---|---|---|---|---|---|---|---|---|---|---|---|---|---|---|
| | 1 | 3 | 6 | 13 | 20 | 27 | 34 | 42 | 50 | 59 | | | | |
| 0 | | | | | | | | | | | ○ | 0 | 0 | |
| 1 | ○ | | | | | | | | | | ○ | 1 | 0 | |
| 2 | — | — | — | — | — | — | — | — | — | — | × | 2 | 0 | ±1 |
| 3 | | ○ | | | | | | | | | ○ | 3 | 0 | |
| 4 | ○ | ○ | | | | | | | | | ○ | 4 | 0 | |
| 5 | — | — | — | — | — | — | — | — | — | — | × | 5 | 0 | ±1 |
| 6 | | | ○ | | | | | | | | ○ | 6 | 0 | |
| 7 | ○ | | ○ | | | | | | | | ○ | 7 | 0 | |
| 8 | — | — | — | — | — | — | — | — | — | — | × | 8 | 0 | ±1 |
| 9 | | ○ | ○ | | | | | | | | ○ | 9 | 0 | |
| 10 | ○ | ○ | ○ | | | | | | | | ○ | 10 | 0 | |
| 11 | — | — | — | — | — | — | — | — | — | — | × | 11 | 0 | ±2 |
| 12 | — | — | — | — | — | — | — | — | — | — | × | 11 | 1 | |
| 13 | | | | ○ | | | | | | | ○ | 13 | 0 | |
| 14 | ○ | | | ○ | | | | | | | ○ | 14 | 0 | |
| 15 | — | — | — | — | — | — | — | — | — | — | × | 15 | 0 | ±1 |
| 16 | | ○ | | ○ | | | | | | | ○ | 16 | 0 | |
| 17 | ○ | ○ | | ○ | | | | | | | ○ | 17 | 0 | |
| 18 | — | — | — | — | — | — | — | — | — | — | × | 18 | 0 | ±1 |
| 19 | | | ○ | ○ | | | | | | | ○ | 19 | 0 | |
| 20 | ○ | | ○ | ○ | | | | | | | ○ | 20 | 0 | |
| 21 | — | — | — | — | — | — | — | — | — | — | × | 21 | 0 | ±1 |
| 22 | | ○ | ○ | ○ | | | | | | | ○ | 22 | 0 | |
| 23 | ○ | ○ | ○ | ○ | | | | | | | ○ | 23 | 0 | |
| 24 | ○ | ○ | | | ○ | | | | | | ○ | 24 | 0 | |
| 25 | — | — | — | — | — | — | — | — | — | — | × | 25 | 0 | ±1 |
| 26 | | | ○ | | ○ | | | | | | ○ | 26 | 0 | |
| 27 | ○ | | ○ | | ○ | | | | | | ○ | 27 | 0 | |
| 28 | — | — | — | — | — | — | — | — | — | — | × | 28 | 0 | ±1 |
| 29 | | ○ | ○ | | ○ | | | | | | ○ | 29 | 0 | |
| 30 | ○ | ○ | ○ | | ○ | | | | | | ○ | 30 | 0 | |
| 31 | — | — | — | — | — | — | — | — | — | — | × | 31 | 0 | ±2 |
| 32 | — | — | — | — | — | — | — | — | — | — | × | 31 | 1 | |
| 33 | | | | ○ | ○ | | | | | | ○ | 33 | 0 | |
| 34 | ○ | | | ○ | ○ | | | | | | ○ | 34 | 0 | |
| 35 | — | — | — | — | — | — | — | — | — | — | × | 35 | 0 | ±1 |
| 36 | | ○ | | ○ | ○ | | | | | | ○ | 36 | 0 | |
| 37 | ○ | ○ | | ○ | ○ | | | | | | ○ | 37 | 0 | |
| 38 | — | — | — | — | — | — | — | — | — | — | × | 38 | 0 | ±1 |
| 39 | | | ○ | ○ | ○ | | | | | | ○ | 39 | 0 | |
| 40 | ○ | | ○ | ○ | ○ | | | | | | ○ | 40 | 0 | |
| 41 | — | — | — | — | — | — | — | — | — | — | × | 41 | 0 | ±1 |
| 42 | | ○ | ○ | ○ | ○ | | | | | | ○ | 42 | 0 | |
| 43 | ○ | ○ | ○ | ○ | ○ | | | | | | ○ | 43 | 0 | |
| 44 | ○ | ○ | | ○ | | ○ | | | | | ○ | 44 | 0 | |
| 45 | — | — | — | — | — | — | — | — | — | — | × | 45 | 0 | ±1 |
| 46 | | | ○ | ○ | | ○ | | | | | ○ | 46 | 0 | |
| 47 | ○ | | ○ | ○ | | ○ | | | | | ○ | 47 | 0 | |
| 48 | — | — | — | — | — | — | — | — | — | — | × | 48 | 0 | ±1 |
| 49 | | ○ | ○ | ○ | | ○ | | | | | ○ | 49 | 0 | |
| 50 | ○ | ○ | ○ | ○ | | ○ | | | | | ○ | 50 | 0 | |

FIG. 13

| | SUB-FIELD | | | | | | | | | | DISPLAY AVAILABLE/ UNAVAILABLE | CONVERTED VALUE | ERROR | DITHER |
|---|---|---|---|---|---|---|---|---|---|---|---|---|---|---|
| WEIGHT / GRAY LEVELS | SF1 | SF2 | SF3 | SF4 | SF5 | SF6 | SF7 | SF8 | SF9 | SF10 | | | | |
| | 1 | 3 | 6 | 13 | 20 | 27 | 34 | 42 | 50 | 59 | | | | |
| 51 | ○ | ○ | | | ○ | ○ | | | | | ○ | 51 | 0 | |
| 52 | – | – | – | – | – | – | – | – | – | – | × | 52 | 0 | ±1 |
| 53 | | | ○ | | ○ | ○ | | | | | ○ | 53 | 0 | |
| 54 | ○ | | ○ | | ○ | ○ | | | | | ○ | 54 | 0 | |
| 55 | – | – | – | – | – | – | – | – | – | – | × | 55 | 0 | ±1 |
| 56 | | ○ | ○ | | ○ | ○ | | | | | ○ | 56 | 0 | |
| 57 | ○ | ○ | ○ | | ○ | ○ | | | | | ○ | 57 | 0 | |
| 58 | – | – | – | – | – | – | – | – | – | – | × | 58 | 0 | ±2 |
| 59 | – | – | – | – | – | – | – | – | – | – | × | 58 | 1 | |
| 60 | | | | ○ | ○ | ○ | | | | | ○ | 60 | 0 | |
| 61 | ○ | | | ○ | ○ | ○ | | | | | ○ | 61 | 0 | |
| 62 | – | – | – | – | – | – | – | – | – | – | × | 62 | 0 | ±1 |
| 63 | | ○ | | ○ | ○ | ○ | | | | | ○ | 63 | 0 | |
| 64 | ○ | ○ | | ○ | ○ | ○ | | | | | ○ | 64 | 0 | |
| 65 | – | – | – | – | – | – | – | – | – | – | × | 65 | 0 | ±1 |
| 66 | | | ○ | ○ | ○ | ○ | | | | | ○ | 66 | 0 | |
| 67 | ○ | | ○ | ○ | ○ | ○ | | | | | ○ | 67 | 0 | |
| 68 | – | – | – | – | – | – | – | – | – | – | × | 68 | 0 | ±1 |
| 69 | | ○ | ○ | ○ | ○ | ○ | | | | | ○ | 69 | 0 | |
| 70 | ○ | ○ | ○ | ○ | ○ | ○ | | | | | ○ | 70 | 0 | |
| 71 | ○ | ○ | | ○ | ○ | | ○ | | | | ○ | 71 | 0 | |
| 72 | – | – | – | – | – | – | – | – | – | – | × | 72 | 0 | ±1 |
| 73 | | | ○ | ○ | ○ | | ○ | | | | ○ | 73 | 0 | |
| 74 | ○ | | ○ | ○ | ○ | | ○ | | | | ○ | 74 | 0 | |
| 75 | – | – | – | – | – | – | – | – | – | – | × | 75 | 0 | ±1 |
| 76 | | ○ | ○ | ○ | ○ | | ○ | | | | ○ | 76 | 0 | |
| 77 | ○ | ○ | ○ | ○ | ○ | | ○ | | | | ○ | 77 | 0 | |
| 78 | ○ | ○ | | ○ | | ○ | ○ | | | | ○ | 78 | 0 | |
| 79 | – | – | – | – | – | – | – | – | – | – | × | 79 | 0 | ±1 |
| 80 | | | ○ | ○ | | ○ | ○ | | | | ○ | 80 | 0 | |
| 81 | ○ | | ○ | ○ | | ○ | ○ | | | | ○ | 81 | 0 | |
| 82 | – | – | – | – | – | – | – | – | – | – | × | 82 | 0 | ±1 |
| 83 | | ○ | ○ | ○ | | ○ | ○ | | | | ○ | 83 | 0 | |
| 84 | ○ | ○ | ○ | ○ | | ○ | ○ | | | | ○ | 84 | 0 | |
| 85 | ○ | ○ | | | ○ | ○ | ○ | | | | ○ | 85 | 0 | |
| 86 | – | – | – | – | – | – | – | – | – | – | × | 86 | 0 | ±1 |
| 87 | | | ○ | | ○ | ○ | ○ | | | | ○ | 87 | 0 | |
| 88 | ○ | | ○ | | ○ | ○ | ○ | | | | ○ | 88 | 0 | |
| 89 | – | – | – | – | – | – | – | – | – | – | × | 89 | 0 | ±1 |
| 90 | | ○ | ○ | | ○ | ○ | ○ | | | | ○ | 90 | 0 | |
| 91 | ○ | ○ | ○ | | ○ | ○ | ○ | | | | ○ | 91 | 0 | |
| 92 | – | – | – | – | – | – | – | – | – | – | × | 92 | 0 | ±2 |
| 93 | – | – | – | – | – | – | – | – | – | – | × | 92 | 1 | |
| 94 | | | | ○ | ○ | ○ | ○ | | | | ○ | 94 | 0 | |
| 95 | ○ | | | ○ | ○ | ○ | ○ | | | | ○ | 95 | 0 | |
| 96 | – | – | – | – | – | – | – | – | – | – | × | 96 | 0 | ±1 |
| 97 | | ○ | | ○ | ○ | ○ | ○ | | | | ○ | 97 | 0 | |
| 98 | ○ | ○ | | ○ | ○ | ○ | ○ | | | | ○ | 98 | 0 | |
| 99 | – | – | – | – | – | – | – | – | – | – | × | 99 | 0 | ±1 |
| 100 | | | ○ | ○ | ○ | ○ | ○ | | | | ○ | 100 | 0 | |
| 101 | ○ | | ○ | ○ | ○ | ○ | ○ | | | | ○ | 101 | 0 | |

FIG. 14

| WEIGHT / GRAY LEVELS | SUB-FIELD SF1 | SF2 | SF3 | SF4 | SF5 | SF6 | SF7 | SF8 | SF9 | SF10 | DISPLAY AVAILABLE/ UNAVAILABLE | CONVERTED VALUE | ERROR | DITHER |
|---|---|---|---|---|---|---|---|---|---|---|---|---|---|---|
| | 1 | 3 | 6 | 13 | 20 | 27 | 34 | 42 | 50 | 59 | | | | |
| 102 | – | – | – | – | – | – | – | – | – | – | × | 102 | 0 | ±1 |
| 103 | | ○ | ○ | ○ | ○ | ○ | ○ | | | | ○ | 103 | 0 | |
| 104 | ○ | ○ | ○ | ○ | ○ | ○ | ○ | | | | ○ | 104 | 0 | |
| 105 | | ○ | | ○ | ○ | ○ | | ○ | | | ○ | 105 | 0 | |
| 106 | ○ | ○ | | ○ | ○ | ○ | | ○ | | | ○ | 106 | 0 | |
| 107 | – | – | – | – | – | – | – | – | – | – | × | 107 | 0 | ±1 |
| 108 | | | ○ | ○ | ○ | ○ | | ○ | | | ○ | 108 | 0 | |
| 109 | ○ | | ○ | ○ | ○ | ○ | | ○ | | | ○ | 109 | 0 | |
| 110 | – | – | – | – | – | – | – | – | – | – | × | 110 | 0 | ±1 |
| 111 | | ○ | ○ | ○ | ○ | ○ | | ○ | | | ○ | 111 | 0 | |
| 112 | ○ | ○ | ○ | ○ | ○ | ○ | | ○ | | | ○ | 112 | 0 | |
| 113 | ○ | ○ | | ○ | ○ | | ○ | ○ | | | ○ | 113 | 0 | |
| 114 | – | – | – | – | – | – | – | – | – | – | × | 114 | 0 | ±1 |
| 115 | | | ○ | ○ | ○ | | ○ | ○ | | | ○ | 115 | 0 | |
| 116 | ○ | | ○ | ○ | ○ | | ○ | ○ | | | ○ | 116 | 0 | |
| 117 | – | – | – | – | – | – | – | – | – | – | × | 117 | 0 | ±1 |
| 118 | | ○ | ○ | ○ | ○ | | ○ | ○ | | | ○ | 118 | 0 | |
| 119 | ○ | ○ | ○ | ○ | ○ | | ○ | ○ | | | ○ | 119 | 0 | |
| 120 | ○ | ○ | | ○ | | ○ | ○ | ○ | | | ○ | 120 | 0 | |
| 121 | – | – | – | – | – | – | – | – | – | – | × | 121 | 0 | ±1 |
| 122 | | | ○ | ○ | | ○ | ○ | ○ | | | ○ | 122 | 0 | |
| 123 | ○ | | ○ | ○ | | ○ | ○ | ○ | | | ○ | 123 | 0 | |
| 124 | – | – | – | – | – | – | – | – | – | – | × | 124 | 0 | ±1 |
| 125 | | ○ | ○ | ○ | | ○ | ○ | ○ | | | ○ | 125 | 0 | |
| 126 | ○ | ○ | ○ | ○ | | ○ | ○ | ○ | | | ○ | 126 | 0 | |
| 127 | ○ | ○ | | | ○ | ○ | ○ | ○ | | | ○ | 127 | 0 | |
| 128 | – | – | – | – | – | – | – | – | – | – | × | 128 | 0 | ±1 |
| 129 | | | ○ | | ○ | ○ | ○ | ○ | | | ○ | 129 | 0 | |
| 130 | ○ | | ○ | | ○ | ○ | ○ | ○ | | | ○ | 130 | 0 | |
| 131 | – | – | – | – | – | – | – | – | – | – | × | 131 | 0 | ±1 |
| 132 | | ○ | ○ | | ○ | ○ | ○ | ○ | | | ○ | 132 | 0 | |
| 133 | ○ | ○ | ○ | | ○ | ○ | ○ | ○ | | | ○ | 133 | 0 | |
| 134 | – | – | – | – | – | – | – | – | – | – | × | 134 | 0 | ±2 |
| 135 | – | – | – | – | – | – | – | – | – | – | × | 134 | 1 | |
| 136 | | | | ○ | ○ | ○ | ○ | ○ | | | ○ | 136 | 0 | |
| 137 | ○ | | | ○ | ○ | ○ | ○ | ○ | | | ○ | 137 | 0 | |
| 138 | – | – | – | – | – | – | – | – | – | – | × | 138 | 0 | ±1 |
| 139 | | ○ | | ○ | ○ | ○ | ○ | ○ | | | ○ | 139 | 0 | |
| 140 | ○ | ○ | | ○ | ○ | ○ | ○ | ○ | | | ○ | 140 | 0 | |
| 141 | – | – | – | – | – | – | – | – | – | – | × | 141 | 0 | ±1 |
| 142 | | | ○ | ○ | ○ | ○ | ○ | ○ | | | ○ | 142 | 0 | |
| 143 | ○ | | ○ | ○ | ○ | ○ | ○ | ○ | | | ○ | 143 | 0 | |
| 144 | – | – | – | – | – | – | – | – | – | – | × | 144 | 0 | ±1 |
| 145 | | ○ | ○ | ○ | ○ | ○ | ○ | ○ | | | ○ | 145 | 0 | |
| 146 | ○ | ○ | ○ | ○ | ○ | ○ | ○ | ○ | | | ○ | 146 | 0 | |
| 147 | | ○ | | ○ | ○ | ○ | ○ | | ○ | | ○ | 147 | 0 | |
| 148 | ○ | ○ | | ○ | ○ | ○ | ○ | | ○ | | ○ | 148 | 0 | |
| 149 | – | – | – | – | – | – | – | – | – | – | × | 149 | 0 | ±1 |
| 150 | | | ○ | ○ | ○ | ○ | ○ | | ○ | | ○ | 150 | 0 | |
| 151 | ○ | | ○ | ○ | ○ | ○ | ○ | | ○ | | ○ | 151 | 0 | |
| 152 | – | – | – | – | – | – | – | – | – | – | × | 152 | 0 | ±1 |

FIG. 15

| WEIGHT / GRAY LEVELS | SUB-FIELD SF1 | SF2 | SF3 | SF4 | SF5 | SF6 | SF7 | SF8 | SF9 | SF10 | DISPLAY AVAILABLE/ UNAVAILABLE | CONVERTED VALUE | ERROR | DITHER |
|---|---|---|---|---|---|---|---|---|---|---|---|---|---|---|
| | 1 | 3 | 6 | 13 | 20 | 27 | 34 | 42 | 50 | 59 | | | | |
| 153 | | ○ | ○ | ○ | ○ | ○ | ○ | | ○ | | ○ | 153 | 0 | |
| 154 | ○ | ○ | ○ | ○ | ○ | ○ | ○ | | ○ | | ○ | 154 | 0 | |
| 155 | | ○ | | ○ | ○ | ○ | | ○ | ○ | | ○ | 155 | 0 | |
| 156 | ○ | ○ | | ○ | ○ | ○ | | ○ | ○ | | ○ | 156 | 0 | |
| 157 | — | — | — | — | — | — | — | — | — | — | × | 157 | 0 | ±1 |
| 158 | | | ○ | ○ | ○ | ○ | | ○ | ○ | | ○ | 158 | 0 | |
| 159 | ○ | | ○ | ○ | ○ | ○ | | ○ | ○ | | ○ | 159 | 0 | |
| 160 | — | — | — | — | — | — | — | — | — | — | × | 160 | 0 | ±1 |
| 161 | | ○ | ○ | ○ | ○ | ○ | | ○ | ○ | | ○ | 161 | 0 | |
| 162 | ○ | ○ | ○ | ○ | ○ | ○ | | ○ | ○ | | ○ | 162 | 0 | |
| 163 | ○ | ○ | | ○ | ○ | | ○ | ○ | ○ | | ○ | 163 | 0 | |
| 164 | — | — | — | — | — | — | — | — | — | — | × | 164 | 0 | ±1 |
| 165 | | | ○ | ○ | ○ | | ○ | ○ | ○ | | ○ | 165 | 0 | |
| 166 | ○ | | ○ | ○ | ○ | | ○ | ○ | ○ | | ○ | 166 | 0 | |
| 167 | — | — | — | — | — | — | — | — | — | — | × | 167 | 0 | ±1 |
| 168 | | ○ | ○ | ○ | ○ | | ○ | ○ | ○ | | ○ | 168 | 0 | |
| 169 | ○ | ○ | ○ | ○ | ○ | | ○ | ○ | ○ | | ○ | 169 | 0 | |
| 170 | ○ | ○ | | ○ | | ○ | ○ | ○ | ○ | | ○ | 170 | 0 | |
| 171 | — | — | — | — | — | — | — | — | — | — | × | 171 | 0 | ±1 |
| 172 | | | ○ | ○ | | ○ | ○ | ○ | ○ | | ○ | 172 | 0 | |
| 173 | ○ | | ○ | ○ | | ○ | ○ | ○ | ○ | | ○ | 173 | 0 | |
| 174 | — | — | — | — | — | — | — | — | — | — | × | 174 | 0 | ±1 |
| 175 | | ○ | ○ | ○ | | ○ | ○ | ○ | ○ | | ○ | 175 | 0 | |
| 176 | ○ | ○ | ○ | ○ | | ○ | ○ | ○ | ○ | | ○ | 176 | 0 | |
| 177 | ○ | ○ | | | ○ | ○ | ○ | ○ | ○ | — | ○ | 177 | 0 | |
| 178 | — | — | — | — | — | — | — | — | — | — | × | 178 | 0 | ±1 |
| 179 | | | ○ | | ○ | ○ | ○ | ○ | ○ | | ○ | 179 | 0 | |
| 180 | ○ | | ○ | | ○ | ○ | ○ | ○ | ○ | | ○ | 180 | 0 | |
| 181 | — | — | — | — | — | — | — | — | — | — | × | 181 | 0 | ±1 |
| 182 | | ○ | ○ | | ○ | ○ | ○ | ○ | ○ | | ○ | 182 | 0 | |
| 183 | ○ | ○ | ○ | | ○ | ○ | ○ | ○ | ○ | | ○ | 183 | 0 | |
| 184 | — | — | — | — | — | — | — | — | — | — | × | 184 | 0 | ±2 |
| 185 | — | — | — | — | — | — | — | — | — | — | × | 184 | 1 | |
| 186 | | | | ○ | ○ | ○ | ○ | ○ | ○ | | ○ | 186 | 0 | |
| 187 | ○ | | | ○ | ○ | ○ | ○ | ○ | ○ | | ○ | 187 | 0 | |
| 188 | — | — | — | — | — | — | — | — | — | — | × | 188 | 0 | ±1 |
| 189 | | ○ | | ○ | ○ | ○ | ○ | ○ | ○ | | ○ | 189 | 0 | |
| 190 | ○ | ○ | | ○ | ○ | ○ | ○ | ○ | ○ | | ○ | 190 | 0 | |
| 191 | — | — | — | — | — | — | — | — | — | — | × | 191 | 0 | ±1 |
| 192 | | | ○ | ○ | ○ | ○ | ○ | ○ | ○ | | ○ | 192 | 0 | |
| 193 | ○ | | ○ | ○ | ○ | ○ | ○ | ○ | ○ | | ○ | 193 | 0 | |
| 194 | — | — | — | — | — | — | — | — | — | — | × | 194 | 0 | ±1 |
| 195 | | ○ | ○ | ○ | ○ | ○ | ○ | ○ | ○ | | ○ | 195 | 0 | |
| 196 | ○ | ○ | ○ | ○ | ○ | ○ | ○ | ○ | ○ | | ○ | 196 | 0 | |
| 197 | — | — | — | — | — | — | — | — | — | — | × | 197 | 0 | ±1 |
| 198 | | ○ | | ○ | ○ | ○ | ○ | ○ | | ○ | ○ | 198 | 0 | |
| 199 | ○ | ○ | | ○ | ○ | ○ | ○ | ○ | | ○ | ○ | 199 | 0 | |
| 200 | — | — | — | — | — | — | — | — | — | — | × | 200 | 0 | ±1 |
| 201 | | | ○ | ○ | ○ | ○ | ○ | ○ | | ○ | ○ | 201 | 0 | |
| 202 | ○ | | ○ | ○ | ○ | ○ | ○ | ○ | | ○ | ○ | 202 | 0 | |
| 203 | — | — | — | — | — | — | — | — | — | — | × | 203 | 0 | ±1 |

FIG. 16

| GRAY LEVELS \ WEIGHT | SUB-FIELD SF1 | SF2 | SF3 | SF4 | SF5 | SF6 | SF7 | SF8 | SF9 | SF10 | DISPLAY AVAILABLE/ UNAVAILABLE | CONVERTED VALUE | ERROR | DITHER |
|---|---|---|---|---|---|---|---|---|---|---|---|---|---|---|
| | 1 | 3 | 6 | 13 | 20 | 27 | 34 | 42 | 50 | 59 | | | | |
| 204 | | ○ | ○ | ○ | ○ | ○ | ○ | ○ | | ○ | ○ | 204 | 0 | |
| 205 | ○ | ○ | ○ | ○ | ○ | ○ | ○ | ○ | | ○ | ○ | 205 | 0 | |
| 206 | | ○ | | ○ | ○ | ○ | ○ | | ○ | ○ | ○ | 206 | 0 | |
| 207 | ○ | ○ | | ○ | ○ | ○ | ○ | | ○ | ○ | ○ | 207 | 0 | |
| 208 | — | — | — | — | — | — | — | — | — | — | × | 208 | 0 | ±1 |
| 209 | | | ○ | ○ | ○ | ○ | ○ | | ○ | ○ | ○ | 209 | 0 | |
| 210 | ○ | | ○ | ○ | ○ | ○ | ○ | | ○ | ○ | ○ | 210 | 0 | |
| 211 | — | — | — | — | — | — | — | — | — | — | × | 211 | 0 | ±1 |
| 212 | | ○ | ○ | ○ | ○ | ○ | ○ | | ○ | ○ | ○ | 212 | 0 | |
| 213 | ○ | ○ | ○ | ○ | ○ | ○ | ○ | | ○ | ○ | ○ | 213 | 0 | |
| 214 | | ○ | | ○ | ○ | ○ | | ○ | ○ | ○ | ○ | 214 | 0 | |
| 215 | ○ | ○ | | ○ | ○ | ○ | | ○ | ○ | ○ | ○ | 215 | 0 | |
| 216 | — | — | — | — | — | — | — | — | — | — | × | 216 | 0 | ±1 |
| 217 | | | ○ | ○ | ○ | ○ | | ○ | ○ | ○ | ○ | 217 | 0 | |
| 218 | ○ | | ○ | ○ | ○ | ○ | | ○ | ○ | ○ | ○ | 218 | 0 | |
| 219 | — | — | — | — | — | — | — | — | — | — | × | 219 | 0 | ±1 |
| 220 | | ○ | ○ | ○ | ○ | ○ | | ○ | ○ | ○ | ○ | 220 | 0 | |
| 221 | ○ | ○ | ○ | ○ | ○ | ○ | | ○ | ○ | ○ | ○ | 221 | 0 | |
| 222 | ○ | ○ | | ○ | ○ | | ○ | ○ | ○ | ○ | ○ | 222 | 0 | |
| 223 | — | — | — | — | — | — | — | — | — | — | × | 223 | 0 | ±1 |
| 224 | | | ○ | ○ | ○ | | ○ | ○ | ○ | ○ | ○ | 224 | 0 | |
| 225 | ○ | | ○ | ○ | ○ | | ○ | ○ | ○ | ○ | ○ | 225 | 0 | |
| 226 | — | — | — | — | — | — | — | — | — | — | × | 226 | 0 | ±1 |
| 227 | | ○ | ○ | ○ | ○ | | ○ | ○ | ○ | ○ | ○ | 227 | 0 | |
| 228 | ○ | ○ | ○ | ○ | ○ | | ○ | ○ | ○ | ○ | ○ | 228 | 0 | |
| 229 | ○ | ○ | | ○ | | ○ | ○ | ○ | ○ | ○ | ○ | 229 | 0 | |
| 230 | — | — | — | — | — | — | — | — | — | — | × | 230 | 0 | ±1 |
| 231 | | | ○ | ○ | | ○ | ○ | ○ | ○ | ○ | ○ | 231 | 0 | |
| 232 | ○ | | ○ | ○ | | ○ | ○ | ○ | ○ | ○ | ○ | 232 | 0 | |
| 233 | — | — | — | — | — | — | — | — | — | — | × | 233 | 0 | ±1 |
| 234 | | ○ | ○ | ○ | | ○ | ○ | ○ | ○ | ○ | ○ | 234 | 0 | |
| 235 | ○ | ○ | ○ | ○ | | ○ | ○ | ○ | ○ | ○ | ○ | 235 | 0 | |
| 236 | ○ | ○ | | | ○ | ○ | ○ | ○ | ○ | ○ | ○ | 236 | 0 | |
| 237 | — | — | — | — | — | — | — | — | — | — | × | 237 | 0 | ±1 |
| 238 | | | ○ | | ○ | ○ | ○ | ○ | ○ | ○ | ○ | 238 | 0 | |
| 239 | ○ | | ○ | | ○ | ○ | ○ | ○ | ○ | ○ | ○ | 239 | 0 | |
| 240 | — | — | — | — | — | — | — | — | — | — | × | 240 | 0 | ±1 |
| 241 | | ○ | ○ | | ○ | ○ | ○ | ○ | ○ | ○ | ○ | 241 | 0 | |
| 242 | ○ | ○ | ○ | | ○ | ○ | ○ | ○ | ○ | ○ | ○ | 242 | 0 | |
| 243 | — | — | — | — | — | — | — | — | — | — | × | 243 | 0 | ±2 |
| 244 | — | — | — | — | — | — | — | — | — | — | × | 243 | 1 | |
| 245 | | | | ○ | ○ | ○ | ○ | ○ | ○ | ○ | ○ | 245 | 0 | |
| 246 | ○ | | | ○ | ○ | ○ | ○ | ○ | ○ | ○ | ○ | 246 | 0 | |
| 247 | — | — | — | — | — | — | — | — | — | — | × | 247 | 0 | ±1 |
| 248 | | ○ | | ○ | ○ | ○ | ○ | ○ | ○ | ○ | ○ | 248 | 0 | |
| 249 | ○ | ○ | | ○ | ○ | ○ | ○ | ○ | ○ | ○ | ○ | 249 | 0 | |
| 250 | — | — | — | — | — | — | — | — | — | — | × | 250 | 0 | ±1 |
| 251 | | | ○ | ○ | ○ | ○ | ○ | ○ | ○ | ○ | ○ | 251 | 0 | |
| 252 | ○ | | ○ | ○ | ○ | ○ | ○ | ○ | ○ | ○ | ○ | 252 | 0 | |
| 253 | — | — | — | — | — | — | — | — | — | — | × | 253 | 0 | ±1 |
| 254 | | ○ | ○ | ○ | ○ | ○ | ○ | ○ | ○ | ○ | ○ | 254 | 0 | |
| 255 | ○ | ○ | ○ | ○ | ○ | ○ | ○ | ○ | ○ | ○ | ○ | 255 | 0 | |

FIG. 17

| GRAY LEVELS \ WEIGHT | SUB-FIELD SF1 | SF2 | SF3 | SF4 | SF5 | SF6 | SF7 | SF8 | SF9 | DISPLAY AVAILABLE/ UNAVAILABLE | CONVERTED VALUE | ERROR | DITHER |
|---|---|---|---|---|---|---|---|---|---|---|---|---|---|
| | 1 | 3 | 6 | 14 | 24 | 35 | 46 | 57 | 69 | | | | |
| 0 | | | | | | | | | | ○ | 0 | 0 | |
| 1 | ○ | | | | | | | | | ○ | 1 | 0 | |
| 2 | – | – | – | – | – | – | – | – | – | × | 1 | 1 | ±1 |
| 3 | | ○ | | | | | | | | ○ | 3 | 0 | |
| 4 | ○ | ○ | | | | | | | | ○ | 4 | 0 | |
| 5 | – | – | – | – | – | – | – | – | – | × | 4 | 1 | ±1 |
| 6 | | | ○ | | | | | | | ○ | 6 | 0 | |
| 7 | ○ | | ○ | | | | | | | ○ | 7 | 0 | |
| 8 | – | – | – | – | – | – | – | – | – | × | 7 | 1 | ±1 |
| 9 | | ○ | ○ | | | | | | | ○ | 9 | 0 | |
| 10 | ○ | ○ | ○ | | | | | | | ○ | 10 | 0 | |
| 11 | – | – | – | – | – | – | – | – | – | × | 10 | 1 | ±4 |
| 12 | – | – | – | – | – | – | – | – | – | × | 10 | 2 | ±2 |
| 13 | – | – | – | – | – | – | – | – | – | × | 10 | 3 | ±4 |
| 14 | | | | ○ | | | | | | ○ | 14 | 0 | |
| 15 | ○ | | | ○ | | | | | | ○ | 15 | 0 | |
| 16 | – | – | – | – | – | – | – | – | – | × | 15 | 1 | ±1 |
| 17 | | ○ | | ○ | | | | | | ○ | 17 | 0 | |
| 18 | ○ | ○ | | ○ | | | | | | ○ | 18 | 0 | |
| 19 | – | – | – | – | – | – | – | – | – | × | 18 | 1 | ±1 |
| 20 | | | ○ | ○ | | | | | | ○ | 20 | 0 | |
| 21 | ○ | | ○ | ○ | | | | | | ○ | 21 | 0 | |
| 22 | – | – | – | – | – | – | – | – | – | × | 21 | 1 | ±1 |
| 23 | | ○ | ○ | ○ | | | | | | ○ | 23 | 0 | |
| 24 | ○ | ○ | ○ | ○ | | | | | | ○ | 24 | 0 | |
| 25 | ○ | | | | ○ | | | | | ○ | 25 | 0 | |
| 26 | – | – | – | – | – | – | – | – | – | × | 25 | 1 | ±1 |
| 27 | | ○ | | | ○ | | | | | ○ | 27 | 0 | |
| 28 | ○ | ○ | | | ○ | | | | | ○ | 28 | 0 | |
| 29 | – | – | – | – | – | – | – | – | – | × | 28 | 1 | ±1 |
| 30 | | | ○ | | ○ | | | | | ○ | 30 | 0 | |
| 31 | ○ | | ○ | | ○ | | | | | ○ | 31 | 0 | |
| 32 | – | – | – | – | – | – | – | – | – | × | 31 | 1 | ±1 |
| 33 | | ○ | ○ | | ○ | | – | – | – | ○ | 33 | 0 | |
| 34 | ○ | ○ | ○ | | ○ | | | | | ○ | 34 | 0 | |
| 35 | – | – | – | – | – | – | – | – | – | × | 34 | 1 | ±4 |
| 36 | – | – | – | – | – | – | – | – | – | × | 34 | 2 | ±2 |
| 37 | – | – | – | – | – | – | – | – | – | × | 34 | 3 | ±4 |
| 38 | | | | ○ | ○ | | | | | ○ | 38 | 0 | |
| 39 | ○ | | | ○ | ○ | | | | | ○ | 39 | 0 | |
| 40 | – | – | – | – | – | – | – | – | – | × | 39 | 1 | ±1 |
| 41 | | ○ | | ○ | ○ | | | | | ○ | 41 | 0 | |
| 42 | ○ | ○ | | ○ | ○ | | | | | ○ | 42 | 0 | |
| 43 | – | – | – | – | – | – | – | – | – | × | 42 | 1 | ±1 |
| 44 | | | ○ | ○ | ○ | | | | | ○ | 44 | 0 | |
| 45 | ○ | | ○ | ○ | ○ | | | | | ○ | 45 | 0 | |
| 46 | – | – | – | – | – | – | – | – | – | × | 45 | 1 | ±1 |
| 47 | | ○ | ○ | ○ | ○ | | | | | ○ | 47 | 0 | |
| 48 | ○ | ○ | ○ | ○ | ○ | | | | | ○ | 48 | 0 | |
| 49 | | | | ○ | | ○ | | | | ○ | 49 | 0 | |
| 50 | ○ | | | ○ | | ○ | | | | ○ | 50 | 0 | |

FIG. 18

| GRAY LEVELS \ WEIGHT | SUB-FIELD SF1 | SF2 | SF3 | SF4 | SF5 | SF6 | SF7 | SF8 | SF9 | DISPLAY AVAILABLE/ UNAVAILABLE | CONVERTED VALUE | ERROR | DITHER |
|---|---|---|---|---|---|---|---|---|---|---|---|---|---|
| | 1 | 3 | 6 | 14 | 24 | 35 | 46 | 57 | 69 | | | | |
| 51 | – | – | – | – | – | – | – | – | – | × | 50 | 1 | ±1 |
| 52 | | ○ | | ○ | | ○ | | | | ○ | 52 | 0 | |
| 53 | ○ | ○ | | ○ | | ○ | | | | ○ | 53 | 0 | |
| 54 | – | – | – | – | – | – | – | – | – | × | 53 | 1 | ±1 |
| 55 | | | ○ | ○ | | ○ | | | | ○ | 55 | 0 | |
| 56 | ○ | | ○ | ○ | | ○ | | | | ○ | 56 | 0 | |
| 57 | – | – | – | – | – | – | – | – | – | × | 56 | 1 | ±1 |
| 58 | | ○ | ○ | ○ | | ○ | | | | ○ | 58 | 0 | |
| 59 | ○ | ○ | ○ | ○ | | ○ | | | | ○ | 59 | 0 | |
| 60 | ○ | | | | ○ | ○ | | | | ○ | 60 | 0 | |
| 61 | – | – | – | – | – | – | – | – | – | × | 60 | 1 | ±1 |
| 62 | | ○ | | | ○ | ○ | | | | ○ | 62 | 0 | |
| 63 | ○ | ○ | | | ○ | ○ | | | | ○ | 63 | 0 | |
| 64 | – | – | – | – | – | – | – | – | – | × | 63 | 1 | ±1 |
| 65 | | | ○ | | ○ | ○ | | | | ○ | 65 | 0 | |
| 66 | ○ | | ○ | | ○ | ○ | | | | ○ | 66 | 0 | |
| 67 | – | – | – | – | – | – | – | – | – | × | 66 | 1 | ±1 |
| 68 | | ○ | ○ | | ○ | ○ | | | | ○ | 68 | 0 | |
| 69 | ○ | ○ | ○ | | ○ | ○ | | | | ○ | 69 | 0 | |
| 70 | – | – | – | – | – | – | – | – | – | × | 69 | 1 | ±4 |
| 71 | – | – | – | – | – | – | – | – | – | × | 69 | 2 | ±2 |
| 72 | – | – | – | – | – | – | – | – | – | × | 69 | 3 | ±4 |
| 73 | | | ○ | ○ | ○ | | | | | ○ | 73 | 0 | |
| 74 | ○ | | ○ | ○ | ○ | | | | | ○ | 74 | 0 | |
| 75 | – | – | – | – | – | – | – | – | – | × | 74 | 1 | ±1 |
| 76 | | ○ | | ○ | ○ | ○ | | | | ○ | 76 | 0 | |
| 77 | ○ | ○ | | ○ | ○ | ○ | | | | ○ | 77 | 0 | |
| 78 | – | – | – | – | – | – | – | – | – | × | 77 | 1 | ±1 |
| 79 | | | ○ | ○ | ○ | ○ | | | | ○ | 79 | 0 | |
| 80 | ○ | | ○ | ○ | ○ | ○ | | | | ○ | 80 | 0 | |
| 81 | – | – | – | – | – | – | – | – | – | × | 80 | 1 | ±1 |
| 82 | | ○ | ○ | ○ | ○ | ○ | | | | ○ | 82 | 0 | |
| 83 | ○ | ○ | ○ | ○ | ○ | ○ | | | | ○ | 83 | 0 | |
| 84 | | | | ○ | ○ | | ○ | | | ○ | 84 | 0 | |
| 85 | ○ | | | ○ | ○ | | ○ | | | ○ | 85 | 0 | |
| 86 | – | – | – | – | – | – | – | – | – | × | 85 | 1 | ±1 |
| 87 | | ○ | | ○ | ○ | | ○ | – | – | ○ | 87 | 0 | |
| 88 | ○ | ○ | | ○ | ○ | | ○ | | | ○ | 88 | 0 | |
| 89 | – | – | – | – | – | – | – | – | – | × | 88 | 1 | ±1 |
| 90 | | | ○ | ○ | ○ | | ○ | | | ○ | 90 | 0 | |
| 91 | ○ | | ○ | ○ | ○ | | ○ | | | ○ | 91 | 0 | |
| 92 | – | – | – | – | – | – | – | – | – | × | 91 | 1 | ±1 |
| 93 | | ○ | ○ | ○ | ○ | | ○ | | | ○ | 93 | 0 | |
| 94 | ○ | ○ | ○ | ○ | ○ | | ○ | | | ○ | 94 | 0 | |
| 95 | | | | ○ | | ○ | ○ | | | ○ | 95 | 0 | |
| 96 | ○ | | | ○ | | ○ | ○ | | | ○ | 96 | 0 | |
| 97 | – | – | – | – | – | – | – | – | – | × | 96 | 1 | ±1 |
| 98 | | ○ | | ○ | | ○ | ○ | | | ○ | 98 | 0 | |
| 99 | ○ | ○ | | ○ | | ○ | ○ | | | ○ | 99 | 0 | |
| 100 | – | – | – | – | – | – | – | – | – | × | 99 | 1 | ±1 |
| 101 | | | ○ | ○ | | ○ | ○ | | | ○ | 101 | 0 | |

FIG. 19

| GRAY LEVELS \ WEIGHT | SUB-FIELD SF1 | SF2 | SF3 | SF4 | SF5 | SF6 | SF7 | SF8 | SF9 | DISPLAY AVAILABLE/ UNAVAILABLE | CONVERTED VALUE | ERROR | DITHER |
|---|---|---|---|---|---|---|---|---|---|---|---|---|---|
| | 1 | 3 | 6 | 14 | 24 | 35 | 46 | 57 | 69 | | | | |
| 102 | ○ | | ○ | ○ | | ○ | ○ | | | ○ | 102 | 0 | |
| 103 | — | — | — | — | — | — | — | — | — | × | 102 | 1 | ±1 |
| 104 | | ○ | ○ | ○ | | ○ | ○ | | | ○ | 104 | 0 | |
| 105 | ○ | ○ | ○ | ○ | | ○ | ○ | | | ○ | 105 | 0 | |
| 106 | ○ | | | | ○ | ○ | ○ | | | ○ | 106 | 0 | |
| 107 | — | — | — | — | — | — | — | — | — | × | 106 | 1 | ±1 |
| 108 | | ○ | | | ○ | ○ | ○ | | | ○ | 108 | 0 | |
| 109 | ○ | ○ | | | ○ | ○ | ○ | | | ○ | 109 | 0 | |
| 110 | — | — | — | — | — | — | — | — | — | × | 109 | 1 | ±1 |
| 111 | | | ○ | | ○ | ○ | ○ | | | ○ | 111 | 0 | |
| 112 | ○ | | ○ | | ○ | ○ | ○ | | | ○ | 112 | 0 | |
| 113 | — | — | — | — | — | — | — | — | — | × | 112 | 1 | ±1 |
| 114 | | ○ | ○ | | ○ | ○ | ○ | | | ○ | 114 | 0 | |
| 115 | ○ | ○ | ○ | | ○ | ○ | ○ | | | ○ | 115 | 0 | |
| 116 | — | — | — | — | — | — | — | — | — | × | 115 | 1 | ±4 |
| 117 | — | — | — | — | — | — | — | — | — | × | 115 | 2 | ±2 |
| 118 | — | — | — | — | — | — | — | — | — | × | 115 | 3 | ±4 |
| 119 | | | | ○ | ○ | ○ | ○ | | | ○ | 119 | 0 | |
| 120 | ○ | | | ○ | ○ | ○ | ○ | | | ○ | 120 | 0 | |
| 121 | — | — | — | — | — | — | — | — | — | × | 120 | 1 | ±1 |
| 122 | | ○ | | ○ | ○ | ○ | ○ | | | ○ | 122 | 0 | |
| 123 | ○ | ○ | | ○ | ○ | ○ | ○ | | | ○ | 123 | 0 | |
| 124 | — | — | — | — | — | — | — | — | — | × | 123 | 1 | ±1 |
| 125 | | | ○ | ○ | ○ | ○ | ○ | | | ○ | 125 | 0 | |
| 126 | ○ | | ○ | ○ | ○ | ○ | ○ | | | ○ | 126 | 0 | |
| 127 | — | — | — | — | — | — | — | — | — | × | 126 | 1 | ±1 |
| 128 | | ○ | ○ | ○ | ○ | ○ | ○ | | | ○ | 128 | 0 | |
| 129 | ○ | ○ | ○ | ○ | ○ | ○ | ○ | | | ○ | 129 | 0 | |
| 130 | | | | ○ | ○ | ○ | | ○ | | ○ | 130 | 0 | |
| 131 | ○ | | | ○ | ○ | ○ | | ○ | | ○ | 131 | 0 | |
| 132 | — | — | — | — | — | — | — | — | — | × | 131 | 1 | ±1 |
| 133 | | ○ | | ○ | ○ | ○ | | ○ | | ○ | 133 | 0 | |
| 134 | ○ | ○ | | ○ | ○ | ○ | | ○ | | ○ | 134 | 0 | |
| 135 | — | — | — | — | — | — | — | — | — | × | 134 | 1 | ±1 |
| 136 | | | ○ | ○ | ○ | ○ | | ○ | | ○ | 136 | 0 | |
| 137 | ○ | | ○ | ○ | ○ | ○ | | ○ | | ○ | 137 | 0 | |
| 138 | — | — | — | — | — | — | — | — | — | × | 137 | 1 | ±1 |
| 139 | | ○ | ○ | ○ | ○ | ○ | | ○ | | ○ | 139 | 0 | |
| 140 | ○ | ○ | ○ | ○ | ○ | ○ | | ○ | | ○ | 140 | 0 | |
| 141 | | | | ○ | ○ | | ○ | ○ | | ○ | 141 | 0 | |
| 142 | ○ | | | ○ | ○ | | ○ | ○ | | ○ | 142 | 0 | |
| 143 | — | — | — | — | — | — | — | — | — | × | 142 | 1 | ±1 |
| 144 | | ○ | | ○ | ○ | | ○ | ○ | | ○ | 144 | 0 | |
| 145 | ○ | ○ | | ○ | ○ | | ○ | ○ | | ○ | 145 | 0 | |
| 146 | — | — | — | — | — | — | — | — | — | × | 145 | 1 | ±1 |
| 147 | | | ○ | ○ | ○ | | ○ | ○ | | ○ | 147 | 0 | |
| 148 | ○ | | ○ | ○ | ○ | | ○ | ○ | | ○ | 148 | 0 | |
| 149 | — | — | — | — | — | — | — | — | — | × | 148 | 1 | ±1 |
| 150 | | ○ | ○ | ○ | ○ | | ○ | ○ | | ○ | 150 | 0 | |
| 151 | ○ | ○ | ○ | ○ | ○ | | ○ | ○ | | ○ | 151 | 0 | |
| 152 | | | | ○ | | ○ | ○ | ○ | | ○ | 152 | 0 | |

FIG. 20

| WEIGHT / GRAY LEVELS | SUB-FIELD SF1 | SF2 | SF3 | SF4 | SF5 | SF6 | SF7 | SF8 | SF9 | DISPLAY AVAILABLE/ UNAVAILABLE | CONVERTED VALUE | ERROR | DITHER |
|---|---|---|---|---|---|---|---|---|---|---|---|---|---|
| | 1 | 3 | 6 | 14 | 24 | 35 | 46 | 57 | 69 | | | | |
| 153 | ○ | | | ○ | | ○ | ○ | ○ | | ○ | 153 | 0 | |
| 154 | — | — | — | — | — | — | — | — | — | × | 153 | 1 | ±1 |
| 155 | | ○ | | ○ | | ○ | ○ | ○ | | ○ | 155 | 0 | |
| 156 | ○ | ○ | | ○ | | ○ | ○ | ○ | | ○ | 156 | 0 | |
| 157 | — | — | — | — | — | — | — | — | — | × | 156 | 1 | ±1 |
| 158 | | | ○ | ○ | | ○ | ○ | ○ | | ○ | 158 | 0 | |
| 159 | ○ | | ○ | ○ | | ○ | ○ | ○ | | ○ | 159 | 0 | |
| 160 | — | — | — | — | — | — | — | — | — | × | 159 | 1 | ±1 |
| 161 | | ○ | ○ | ○ | | ○ | ○ | ○ | | ○ | 161 | 0 | |
| 162 | ○ | ○ | ○ | ○ | | ○ | ○ | ○ | | ○ | 162 | 0 | |
| 163 | ○ | | | | ○ | ○ | ○ | ○ | | ○ | 163 | 0 | |
| 164 | — | — | — | — | — | — | — | — | — | × | 163 | 1 | ±1 |
| 165 | | ○ | | | ○ | ○ | ○ | ○ | | ○ | 165 | 0 | |
| 166 | ○ | ○ | | | ○ | ○ | ○ | ○ | | ○ | 166 | 0 | |
| 167 | — | — | — | — | — | — | — | — | — | × | 166 | 1 | ±1 |
| 168 | | | ○ | | ○ | ○ | ○ | ○ | | ○ | 168 | 0 | |
| 169 | ○ | | ○ | | ○ | ○ | ○ | ○ | | ○ | 169 | 0 | |
| 170 | — | — | — | — | — | — | — | — | — | × | 169 | 1 | ±1 |
| 171 | | ○ | ○ | | ○ | ○ | ○ | ○ | | ○ | 171 | 0 | |
| 172 | ○ | ○ | ○ | | ○ | ○ | ○ | ○ | | ○ | 172 | 0 | |
| 173 | — | — | — | — | — | — | — | — | — | × | 172 | 1 | ±4 |
| 174 | — | — | — | — | — | — | — | — | — | × | 172 | 2 | ±2 |
| 175 | — | — | — | — | — | — | — | — | — | × | 172 | 3 | ±4 |
| 176 | | | | ○ | ○ | ○ | ○ | ○ | | ○ | 176 | 0 | |
| 177 | ○ | | | ○ | ○ | ○ | ○ | ○ | | ○ | 177 | 0 | |
| 178 | — | — | — | — | — | — | — | — | — | × | 177 | 1 | ±1 |
| 179 | | ○ | | ○ | ○ | ○ | ○ | ○ | | ○ | 179 | 0 | |
| 180 | ○ | ○ | | ○ | ○ | ○ | ○ | ○ | | ○ | 180 | 0 | |
| 181 | — | — | — | — | — | — | — | — | — | × | 180 | 1 | ±1 |
| 182 | | | ○ | ○ | ○ | ○ | ○ | ○ | | ○ | 182 | 0 | |
| 183 | ○ | | ○ | ○ | ○ | ○ | ○ | ○ | | ○ | 183 | 0 | |
| 184 | — | — | — | — | — | — | — | — | — | × | 183 | 1 | ±1 |
| 185 | | ○ | ○ | ○ | ○ | ○ | ○ | ○ | | ○ | 185 | 0 | |
| 186 | ○ | ○ | ○ | ○ | ○ | ○ | ○ | ○ | | ○ | 186 | 0 | |
| 187 | — | — | — | — | — | — | — | — | — | × | 186 | 1 | ±1 |
| 188 | | | | ○ | ○ | ○ | ○ | | ○ | ○ | 188 | 0 | |
| 189 | ○ | | | ○ | ○ | ○ | ○ | | ○ | ○ | 189 | 0 | |
| 190 | — | — | — | — | — | — | — | — | — | × | 189 | 1 | ±1 |
| 191 | | ○ | | ○ | ○ | ○ | ○ | | ○ | ○ | 191 | 0 | |
| 192 | ○ | ○ | | ○ | ○ | ○ | ○ | | ○ | ○ | 192 | 0 | |
| 193 | — | — | — | — | — | — | — | — | — | × | 192 | 1 | ±1 |
| 194 | | | ○ | ○ | ○ | ○ | ○ | | ○ | ○ | 194 | 0 | |
| 195 | ○ | | ○ | ○ | ○ | ○ | ○ | | ○ | ○ | 195 | 0 | |
| 196 | — | — | — | — | — | — | — | — | — | × | 195 | 1 | ±1 |
| 197 | | ○ | ○ | ○ | ○ | ○ | ○ | | ○ | ○ | 197 | 0 | |
| 198 | ○ | ○ | ○ | ○ | ○ | ○ | ○ | | ○ | ○ | 198 | 0 | |
| 199 | | | | ○ | ○ | ○ | | ○ | ○ | ○ | 199 | 0 | |
| 200 | ○ | | | ○ | ○ | ○ | | ○ | ○ | ○ | 200 | 0 | |
| 201 | — | — | — | — | — | — | — | — | — | × | 200 | 1 | ±1 |
| 202 | | ○ | | ○ | ○ | ○ | | ○ | ○ | ○ | 202 | 0 | |
| 203 | ○ | ○ | | ○ | ○ | ○ | | ○ | ○ | ○ | 203 | 0 | |

FIG. 21

| GRAY LEVELS \ WEIGHT | SUB-FIELD SF1 | SF2 | SF3 | SF4 | SF5 | SF6 | SF7 | SF8 | SF9 | DISPLAY AVAILABLE/ UNAVAILABLE | CONVERTED VALUE | ERROR | DITHER |
|---|---|---|---|---|---|---|---|---|---|---|---|---|---|
| | 1 | 3 | 6 | 14 | 24 | 35 | 46 | 57 | 69 | | | | |
| 204 | – | – | – | – | – | – | – | – | – | × | 203 | 1 | ±1 |
| 205 | | | ○ | ○ | ○ | ○ | | ○ | ○ | ○ | 205 | 0 | |
| 206 | ○ | | ○ | ○ | ○ | ○ | | ○ | ○ | ○ | 206 | 0 | |
| 207 | – | – | – | – | – | – | – | – | – | × | 206 | 1 | ±1 |
| 208 | | ○ | ○ | ○ | ○ | ○ | | ○ | ○ | ○ | 208 | 0 | |
| 209 | ○ | ○ | ○ | ○ | ○ | ○ | | ○ | ○ | ○ | 209 | 0 | |
| 210 | | | | ○ | ○ | | ○ | ○ | ○ | ○ | 210 | 0 | |
| 211 | ○ | | | ○ | ○ | | ○ | ○ | ○ | ○ | 211 | 0 | |
| 212 | – | – | – | – | – | – | – | – | – | × | 211 | 1 | ±1 |
| 213 | | ○ | | ○ | ○ | | ○ | | ○ | ○ | 213 | 0 | |
| 214 | ○ | ○ | | ○ | ○ | | ○ | ○ | ○ | ○ | 214 | 0 | |
| 215 | – | – | – | – | – | – | – | – | – | × | 214 | 1 | ±1 |
| 216 | | | ○ | ○ | ○ | | ○ | ○ | ○ | ○ | 216 | 0 | |
| 217 | ○ | | ○ | ○ | ○ | | ○ | ○ | ○ | ○ | 217 | 0 | |
| 218 | – | – | – | – | – | – | – | – | – | × | 217 | 1 | ±1 |
| 219 | | ○ | ○ | ○ | ○ | | ○ | ○ | ○ | ○ | 219 | 0 | |
| 220 | ○ | ○ | ○ | ○ | ○ | | ○ | ○ | ○ | ○ | 220 | 0 | |
| 221 | | | | ○ | | ○ | ○ | ○ | ○ | ○ | 221 | 0 | |
| 222 | ○ | | | ○ | | ○ | ○ | ○ | ○ | ○ | 222 | 0 | |
| 223 | – | – | – | – | – | – | – | – | – | × | 222 | 1 | ±1 |
| 224 | | ○ | | ○ | | ○ | ○ | ○ | ○ | ○ | 224 | 0 | |
| 225 | ○ | ○ | | ○ | | ○ | ○ | ○ | ○ | ○ | 225 | 0 | |
| 226 | – | – | – | – | – | – | – | – | – | × | 225 | 1 | ±1 |
| 227 | | | ○ | ○ | | ○ | ○ | ○ | ○ | ○ | 227 | 0 | |
| 228 | ○ | | ○ | ○ | | ○ | ○ | ○ | ○ | ○ | 228 | 0 | |
| 229 | – | – | – | – | – | – | – | – | – | × | 228 | 1 | ±1 |
| 230 | | ○ | ○ | ○ | | ○ | ○ | ○ | ○ | ○ | 230 | 0 | |
| 231 | ○ | ○ | ○ | ○ | | ○ | ○ | ○ | ○ | ○ | 231 | 0 | |
| 232 | ○ | | | | ○ | ○ | ○ | ○ | ○ | ○ | 232 | 0 | |
| 233 | – | – | – | – | – | – | – | – | – | × | 232 | 1 | ±1 |
| 234 | | ○ | | | ○ | ○ | ○ | ○ | ○ | ○ | 234 | 0 | |
| 235 | ○ | ○ | | | ○ | ○ | ○ | ○ | ○ | ○ | 235 | 0 | |
| 236 | – | – | – | – | – | – | – | – | – | × | 235 | 1 | ±1 |
| 237 | | | ○ | | ○ | ○ | ○ | ○ | ○ | ○ | 237 | 0 | |
| 238 | ○ | | ○ | | ○ | ○ | ○ | ○ | ○ | ○ | 238 | 0 | |
| 239 | – | – | – | – | – | – | – | – | – | × | 238 | 1 | ±1 |
| 240 | | ○ | ○ | | ○ | ○ | ○ | ○ | ○ | ○ | 240 | 0 | |
| 241 | ○ | ○ | ○ | | ○ | ○ | ○ | ○ | ○ | ○ | 241 | 0 | |
| 242 | – | – | – | – | – | – | – | – | – | × | 241 | 1 | ±4 |
| 243 | – | – | – | – | – | – | – | – | – | × | 241 | 2 | ±2 |
| 244 | – | – | – | – | – | – | – | – | – | × | 241 | 3 | ±4 |
| 245 | | | | ○ | ○ | ○ | ○ | ○ | ○ | ○ | 245 | 0 | |
| 246 | ○ | | | ○ | ○ | ○ | ○ | ○ | ○ | ○ | 246 | 0 | |
| 247 | – | – | – | – | – | – | – | – | – | × | 246 | 1 | ±1 |
| 248 | | ○ | | ○ | ○ | ○ | ○ | ○ | ○ | ○ | 248 | 0 | |
| 249 | ○ | ○ | | ○ | ○ | ○ | ○ | ○ | ○ | ○ | 249 | 0 | |
| 250 | – | – | – | – | – | – | – | – | – | × | 249 | 1 | ±1 |
| 251 | | | ○ | ○ | ○ | ○ | ○ | ○ | ○ | ○ | 251 | 0 | |
| 252 | ○ | | ○ | ○ | ○ | ○ | ○ | ○ | ○ | ○ | 252 | 0 | |
| 253 | – | – | – | – | – | – | – | – | – | × | 252 | 1 | ±1 |
| 254 | | ○ | ○ | ○ | ○ | ○ | ○ | ○ | ○ | ○ | 254 | 0 | |
| 255 | ○ | ○ | ○ | ○ | ○ | ○ | ○ | ○ | ○ | ○ | 255 | 0 | |

FIG. 22

| | SUB-FIELD | | | | | | | | | | | DISPLAY AVAILABLE/ UNAVAILABLE | CONVERTED VALUE | ERROR | DITHER |
|---|---|---|---|---|---|---|---|---|---|---|---|---|---|---|---|
| WEIGHT / GRAY LEVELS | SF1 | SF2 | SF3 | SF4 | SF5 | SF6 | SF7 | SF8 | SF9 | SF10 | SF11 | | | | |
| | 1 | 2 | 4 | 8 | 16 | 33 | 35 | 36 | 38 | 40 | 42 | | | | |
| 0 | | | | | | | | | | | | ○ | 0 | 0 | |
| 1 | ○ | | | | | | | | | | | ○ | 1 | 0 | |
| 2 | | ○ | | | | | | | | | | ○ | 2 | 0 | |
| 3 | ○ | ○ | | | | | | | | | | ○ | 3 | 0 | |
| 4 | | | ○ | | | | | | | | | ○ | 4 | 0 | |
| 5 | ○ | | ○ | | | | | | | | | ○ | 5 | 0 | |
| 6 | | ○ | ○ | | | | | | | | | ○ | 6 | 0 | |
| 7 | ○ | ○ | ○ | | | | | | | | | ○ | 7 | 0 | |
| 8 | | | | ○ | | | | | | | | ○ | 8 | 0 | |
| 9 | ○ | | | ○ | | | | | | | | ○ | 9 | 0 | |
| 10 | | ○ | | ○ | | | | | | | | ○ | 10 | 0 | |
| 11 | ○ | ○ | | ○ | | | | | | | | ○ | 11 | 0 | |
| 12 | | | ○ | ○ | | | | | | | | ○ | 12 | 0 | |
| 13 | ○ | | ○ | ○ | | | | | | | | ○ | 13 | 0 | |
| 14 | | ○ | ○ | ○ | | | | | | | | ○ | 14 | 0 | |
| 15 | ○ | ○ | ○ | ○ | | | | | | | | ○ | 15 | 0 | |
| 16 | | | | | ○ | | | | | | | ○ | 16 | 0 | |
| 17 | ○ | | | | ○ | | | | | | | ○ | 17 | 0 | |
| 18 | | ○ | | | ○ | | | | | | | ○ | 18 | 0 | |
| 19 | ○ | ○ | | | ○ | | | | | | | ○ | 19 | 0 | |
| 20 | | | ○ | | ○ | | | | | | | ○ | 20 | 0 | |
| 21 | ○ | | ○ | | ○ | | | | | | | ○ | 21 | 0 | |
| 22 | | ○ | ○ | | ○ | | | | | | | ○ | 22 | 0 | |
| 23 | ○ | ○ | ○ | | ○ | | | | | | | ○ | 23 | 0 | |
| 24 | | | | ○ | ○ | | | | | | | ○ | 24 | 0 | |
| 25 | ○ | | | ○ | ○ | | | | | | | ○ | 25 | 0 | |
| 26 | | ○ | | ○ | ○ | | | | | | | ○ | 26 | 0 | |
| 27 | ○ | ○ | | ○ | ○ | | | | | | | ○ | 27 | 0 | |
| 28 | | | ○ | ○ | ○ | | | | | | | ○ | 28 | 0 | |
| 29 | ○ | | ○ | ○ | ○ | | | | | | | ○ | 29 | 0 | |
| 30 | | ○ | ○ | ○ | ○ | | | | | | | ○ | 30 | 0 | |
| 31 | ○ | ○ | ○ | ○ | ○ | | | | | | | ○ | 31 | 0 | |
| 32 | – | – | – | – | – | – | – | – | – | – | – | × | 31 | 1 | ±1 |
| 33 | | | | | | ○ | | | | | | ○ | 33 | 0 | |
| 34 | ○ | | | | | ○ | | | | | | ○ | 34 | 0 | |
| 35 | | ○ | | | | ○ | | | | | | ○ | 35 | 0 | |
| 36 | ○ | ○ | | | | ○ | | | | | | ○ | 36 | 0 | |
| 37 | | | ○ | | | ○ | | | | | | ○ | 37 | 0 | |
| 38 | ○ | | ○ | | | ○ | | | | | | ○ | 38 | 0 | |
| 39 | | ○ | ○ | | | ○ | | | | | | ○ | 39 | 0 | |
| 40 | ○ | ○ | ○ | | | ○ | | | | | | ○ | 40 | 0 | |
| 41 | | | | ○ | | ○ | | | | | | ○ | 41 | 0 | |
| 42 | ○ | | | ○ | | ○ | | | | | | ○ | 42 | 0 | |
| 43 | | ○ | | ○ | | ○ | | | | | | ○ | 43 | 0 | |
| 44 | ○ | ○ | | ○ | | ○ | | | | | | ○ | 44 | 0 | |
| 45 | | | ○ | ○ | | ○ | | | | | | ○ | 45 | 0 | |
| 46 | ○ | | ○ | ○ | | ○ | | | | | | ○ | 46 | 0 | |
| 47 | | ○ | ○ | ○ | | ○ | | | | | | ○ | 47 | 0 | |
| 48 | ○ | ○ | ○ | ○ | | ○ | | | | | | ○ | 48 | 0 | |
| 49 | | | | | ○ | ○ | | | | | | ○ | 49 | 0 | |
| 50 | ○ | | | | ○ | ○ | | | | | | ○ | 50 | 0 | |

FIG. 23

| WEIGHT / GRAY LEVELS | SUB-FIELD SF1 | SF2 | SF3 | SF4 | SF5 | SF6 | SF7 | SF8 | SF9 | SF10 | SF11 | DISPLAY AVAILABLE/ UNAVAILABLE | CONVERTED VALUE | ERROR | DITHER |
|---|---|---|---|---|---|---|---|---|---|---|---|---|---|---|---|
| | 1 | 2 | 4 | 8 | 16 | 33 | 35 | 36 | 38 | 40 | 42 | | | | |
| 51 | | ○ | | | ○ | ○ | | | | | | ○ | 51 | 0 | |
| 52 | ○ | ○ | | | ○ | ○ | | | | | | ○ | 52 | 0 | |
| 53 | | | ○ | | ○ | ○ | | | | | | ○ | 53 | 0 | |
| 54 | ○ | | ○ | | ○ | ○ | | | | | | ○ | 54 | 0 | |
| 55 | | ○ | ○ | | ○ | ○ | | | | | | ○ | 55 | 0 | |
| 56 | ○ | ○ | ○ | | ○ | ○ | | | | | | ○ | 56 | 0 | |
| 57 | | | | ○ | ○ | ○ | | | | | | ○ | 57 | 0 | |
| 58 | ○ | | | ○ | ○ | ○ | | | | | | ○ | 58 | 0 | |
| 59 | | ○ | | ○ | ○ | ○ | | | | | | ○ | 59 | 0 | |
| 60 | ○ | ○ | | ○ | ○ | ○ | | | | | | ○ | 60 | 0 | |
| 61 | | | ○ | ○ | ○ | ○ | | | | | | ○ | 61 | 0 | |
| 62 | ○ | | ○ | ○ | ○ | ○ | | | | | | ○ | 62 | 0 | |
| 63 | | ○ | ○ | ○ | ○ | ○ | | | | | | ○ | 63 | 0 | |
| 64 | ○ | ○ | ○ | ○ | ○ | ○ | | | | | | ○ | 64 | 0 | |
| 65 | | ○ | ○ | ○ | ○ | | ○ | | | | | ○ | 65 | 0 | |
| 66 | ○ | ○ | ○ | ○ | ○ | | ○ | | | | | ○ | 66 | 0 | |
| 67 | ○ | ○ | ○ | ○ | ○ | | | ○ | | | | ○ | 67 | 0 | |
| 68 | | | | | | ○ | ○ | | | | | ○ | 68 | 0 | |
| 69 | ○ | | | | | ○ | ○ | | | | | ○ | 69 | 0 | |
| 70 | | ○ | | | | ○ | ○ | | | | | ○ | 70 | 0 | |
| 71 | ○ | ○ | | | | ○ | ○ | | | | | ○ | 71 | 0 | |
| 72 | | | ○ | | | ○ | ○ | | | | | ○ | 72 | 0 | |
| 73 | ○ | | ○ | | | ○ | ○ | | | | | ○ | 73 | 0 | |
| 74 | | ○ | ○ | | | ○ | ○ | | | | | ○ | 74 | 0 | |
| 75 | ○ | ○ | ○ | | | ○ | ○ | | | | | ○ | 75 | 0 | |
| 76 | | | | ○ | | ○ | ○ | | | | | ○ | 76 | 0 | |
| 77 | ○ | | | ○ | | ○ | ○ | | | | | ○ | 77 | 0 | |
| 78 | | ○ | | ○ | | ○ | ○ | | | | | ○ | 78 | 0 | |
| 79 | ○ | ○ | | ○ | | ○ | ○ | | | | | ○ | 79 | 0 | |
| 80 | | | ○ | ○ | | ○ | ○ | | | | | ○ | 80 | 0 | |
| 81 | ○ | | ○ | ○ | | ○ | ○ | | | | | ○ | 81 | 0 | |
| 82 | | ○ | ○ | ○ | | ○ | ○ | | | | | ○ | 82 | 0 | |
| 83 | ○ | ○ | ○ | ○ | | ○ | ○ | | | | | ○ | 83 | 0 | |
| 84 | | | | | ○ | ○ | ○ | | | | | ○ | 84 | 0 | |
| 85 | ○ | | | | ○ | ○ | ○ | | | | | ○ | 85 | 0 | |
| 86 | | ○ | | | ○ | ○ | ○ | | | | | ○ | 86 | 0 | |
| 87 | ○ | ○ | | | ○ | ○ | ○ | | | | | ○ | 87 | 0 | |
| 88 | | | ○ | | ○ | ○ | ○ | | | | | ○ | 88 | 0 | |
| 89 | ○ | | ○ | | ○ | ○ | ○ | | | | | ○ | 89 | 0 | |
| 90 | | ○ | ○ | | ○ | ○ | ○ | | | | | ○ | 90 | 0 | |
| 91 | ○ | ○ | ○ | | ○ | ○ | ○ | | | | | ○ | 91 | 0 | |
| 92 | | | | ○ | ○ | ○ | ○ | | | | | ○ | 92 | 0 | |
| 93 | ○ | | | ○ | ○ | ○ | ○ | | | | | ○ | 93 | 0 | |
| 94 | | ○ | | ○ | ○ | ○ | ○ | | | | | ○ | 94 | 0 | |
| 95 | ○ | ○ | | ○ | ○ | ○ | ○ | | | | | ○ | 95 | 0 | |
| 96 | | | ○ | ○ | ○ | ○ | ○ | | | | | ○ | 96 | 0 | |
| 97 | ○ | | ○ | ○ | ○ | ○ | ○ | | | | | ○ | 97 | 0 | |
| 98 | | ○ | ○ | ○ | ○ | ○ | ○ | | | | | ○ | 98 | 0 | |
| 99 | ○ | ○ | ○ | ○ | ○ | ○ | ○ | | | | | ○ | 99 | 0 | |
| 100 | ○ | ○ | ○ | ○ | ○ | ○ | | ○ | | | | ○ | 100 | 0 | |
| 101 | | ○ | ○ | ○ | ○ | | ○ | ○ | | | | ○ | 101 | 0 | |

FIG. 24

| | SUB-FIELD | | | | | | | | | | | DISPLAY AVAILABLE/ UNAVAILABLE | CONVERTED VALUE | ERROR | DITHER |
|---|---|---|---|---|---|---|---|---|---|---|---|---|---|---|---|
| WEIGHT / GRAY LEVELS | SF1 | SF2 | SF3 | SF4 | SF5 | SF6 | SF7 | SF8 | SF9 | SF10 | SF11 | | | | |
| | 1 | 2 | 4 | 8 | 16 | 33 | 35 | 36 | 38 | 40 | 42 | | | | |
| 102 | ○ | ○ | ○ | ○ | ○ | | ○ | ○ | | | | ○ | 102 | 0 | |
| 103 | | ○ | ○ | ○ | ○ | | ○ | | ○ | | | ○ | 103 | 0 | |
| 104 | | | | | | ○ | ○ | ○ | | | | ○ | 104 | 0 | |
| 105 | ○ | | | | | ○ | ○ | ○ | | | | ○ | 105 | 0 | |
| 106 | | ○ | | | | ○ | ○ | ○ | | | | ○ | 106 | 0 | |
| 107 | ○ | ○ | | | | ○ | ○ | ○ | | | | ○ | 107 | 0 | |
| 108 | | | ○ | | | ○ | ○ | ○ | | | | ○ | 108 | 0 | |
| 109 | ○ | | ○ | | | ○ | ○ | ○ | | | | ○ | 109 | 0 | |
| 110 | | ○ | ○ | | | ○ | ○ | ○ | | | | ○ | 110 | 0 | |
| 111 | ○ | ○ | ○ | | | ○ | ○ | ○ | | | | ○ | 111 | 0 | |
| 112 | | | | ○ | | ○ | ○ | ○ | | | | ○ | 112 | 0 | |
| 113 | ○ | | | ○ | | ○ | ○ | ○ | | | | ○ | 113 | 0 | |
| 114 | | ○ | | ○ | | ○ | ○ | ○ | | | | ○ | 114 | 0 | |
| 115 | ○ | ○ | | ○ | | ○ | ○ | ○ | | | | ○ | 115 | 0 | |
| 116 | | | ○ | ○ | | ○ | ○ | ○ | | | | ○ | 116 | 0 | |
| 117 | ○ | | ○ | ○ | | ○ | ○ | ○ | | | | ○ | 117 | 0 | |
| 118 | | ○ | ○ | ○ | | ○ | ○ | ○ | | | | ○ | 118 | 0 | |
| 119 | ○ | ○ | ○ | ○ | | ○ | ○ | ○ | | | | ○ | 119 | 0 | |
| 120 | | | | | ○ | ○ | ○ | ○ | | | | ○ | 120 | 0 | |
| 121 | ○ | | | | ○ | ○ | ○ | ○ | | | | ○ | 121 | 0 | |
| 122 | | ○ | | | ○ | ○ | ○ | ○ | | | | ○ | 122 | 0 | |
| 123 | ○ | ○ | | | ○ | ○ | ○ | ○ | | | | ○ | 123 | 0 | |
| 124 | | | ○ | | ○ | ○ | ○ | ○ | | | | ○ | 124 | 0 | |
| 125 | ○ | | ○ | | ○ | ○ | ○ | ○ | | | | ○ | 125 | 0 | |
| 126 | | ○ | ○ | | ○ | ○ | ○ | ○ | | | | ○ | 126 | 0 | |
| 127 | ○ | ○ | ○ | | ○ | ○ | ○ | ○ | | | | ○ | 127 | 0 | |
| 128 | | | | ○ | ○ | ○ | ○ | ○ | | | | ○ | 128 | 0 | |
| 129 | ○ | | | ○ | ○ | ○ | ○ | ○ | | | | ○ | 129 | 0 | |
| 130 | | ○ | | ○ | ○ | ○ | ○ | ○ | | | | ○ | 130 | 0 | |
| 131 | ○ | ○ | | ○ | ○ | ○ | ○ | ○ | | | | ○ | 131 | 0 | |
| 132 | | | ○ | ○ | ○ | ○ | ○ | ○ | | | | ○ | 132 | 0 | |
| 133 | ○ | | ○ | ○ | ○ | ○ | ○ | ○ | | | | ○ | 133 | 0 | |
| 134 | | ○ | ○ | ○ | ○ | ○ | ○ | ○ | | | | ○ | 134 | 0 | |
| 135 | ○ | ○ | ○ | ○ | ○ | ○ | ○ | ○ | | | | ○ | 135 | 0 | |
| 136 | | ○ | ○ | ○ | ○ | ○ | ○ | | ○ | | | ○ | 136 | 0 | |
| 137 | ○ | ○ | ○ | ○ | ○ | ○ | ○ | | ○ | | | ○ | 137 | 0 | |
| 138 | ○ | ○ | ○ | ○ | ○ | ○ | | ○ | ○ | | | ○ | 138 | 0 | |
| 139 | | ○ | ○ | ○ | ○ | | ○ | ○ | ○ | | | ○ | 139 | 0 | |
| 140 | ○ | ○ | ○ | ○ | ○ | | ○ | ○ | ○ | | | ○ | 140 | 0 | |
| 141 | ○ | ○ | | ○ | ○ | | | ○ | ○ | ○ | | ○ | 141 | 0 | |
| 142 | | | | | | ○ | ○ | ○ | ○ | | | ○ | 142 | 0 | |
| 143 | ○ | | | | | ○ | ○ | ○ | ○ | | | ○ | 143 | 0 | |
| 144 | | ○ | | | | ○ | ○ | ○ | ○ | | | ○ | 144 | 0 | |
| 145 | ○ | ○ | | | | ○ | ○ | ○ | ○ | | | ○ | 145 | 0 | |
| 146 | | | ○ | | | ○ | ○ | ○ | ○ | | | ○ | 146 | 0 | |
| 147 | ○ | | ○ | | | ○ | ○ | ○ | ○ | | | ○ | 147 | 0 | |
| 148 | | ○ | ○ | | | ○ | ○ | ○ | ○ | | | ○ | 148 | 0 | |
| 149 | ○ | ○ | ○ | | | ○ | ○ | ○ | ○ | | | ○ | 149 | 0 | |
| 150 | | | | ○ | | ○ | ○ | ○ | ○ | | | ○ | 150 | 0 | |
| 151 | ○ | | | ○ | | ○ | ○ | ○ | ○ | | | ○ | 151 | 0 | |
| 152 | | ○ | | ○ | | ○ | ○ | ○ | ○ | | | ○ | 152 | 0 | |

FIG. 25

| WEIGHT / GRAY LEVELS | SUB-FIELD SF1 | SF2 | SF3 | SF4 | SF5 | SF6 | SF7 | SF8 | SF9 | SF10 | SF11 | DISPLAY AVAILABLE/ UNAVAILABLE | CONVERTED VALUE | ERROR | DITHER |
|---|---|---|---|---|---|---|---|---|---|---|---|---|---|---|---|
| | 1 | 2 | 4 | 8 | 16 | 33 | 35 | 36 | 38 | 40 | 42 | | | | |
| 153 | ○ | ○ | | ○ | | ○ | ○ | ○ | ○ | | | ○ | 153 | 0 | |
| 154 | | | ○ | ○ | | ○ | ○ | ○ | ○ | | | ○ | 154 | 0 | |
| 155 | ○ | | ○ | ○ | | ○ | ○ | ○ | ○ | | | ○ | 155 | 0 | |
| 156 | | ○ | ○ | ○ | | ○ | ○ | ○ | ○ | | | ○ | 156 | 0 | |
| 157 | ○ | ○ | ○ | ○ | | ○ | ○ | ○ | ○ | | | ○ | 157 | 0 | |
| 158 | | | | | ○ | ○ | ○ | ○ | ○ | | | ○ | 158 | 0 | |
| 159 | ○ | | | | ○ | ○ | ○ | ○ | ○ | | | ○ | 159 | 0 | |
| 160 | | ○ | | | ○ | ○ | ○ | ○ | ○ | | | ○ | 160 | 0 | |
| 161 | ○ | ○ | | | ○ | ○ | ○ | ○ | ○ | | | ○ | 161 | 0 | |
| 162 | | | ○ | | ○ | ○ | ○ | ○ | ○ | | | ○ | 162 | 0 | |
| 163 | ○ | | ○ | | ○ | ○ | ○ | ○ | ○ | | | ○ | 163 | 0 | |
| 164 | | ○ | ○ | | ○ | ○ | ○ | ○ | ○ | | | ○ | 164 | 0 | |
| 165 | ○ | ○ | ○ | | ○ | ○ | ○ | ○ | ○ | | | ○ | 165 | 0 | |
| 166 | | | | ○ | ○ | ○ | ○ | ○ | ○ | | | ○ | 166 | 0 | |
| 167 | ○ | | | ○ | ○ | ○ | ○ | ○ | ○ | | | ○ | 167 | 0 | |
| 168 | | ○ | | ○ | ○ | ○ | ○ | ○ | ○ | | | ○ | 168 | 0 | |
| 169 | ○ | ○ | | ○ | ○ | ○ | ○ | ○ | ○ | | | ○ | 169 | 0 | |
| 170 | | | ○ | ○ | ○ | ○ | ○ | ○ | ○ | | | ○ | 170 | 0 | |
| 171 | ○ | | ○ | ○ | ○ | ○ | ○ | ○ | ○ | | | ○ | 171 | 0 | |
| 172 | | ○ | ○ | ○ | ○ | ○ | ○ | ○ | ○ | | | ○ | 172 | 0 | |
| 173 | ○ | ○ | ○ | ○ | ○ | ○ | ○ | ○ | ○ | | | ○ | 173 | 0 | |
| 174 | | ○ | ○ | ○ | ○ | ○ | ○ | ○ | | ○ | | ○ | 174 | 0 | |
| 175 | ○ | ○ | ○ | ○ | ○ | ○ | ○ | ○ | | ○ | | ○ | 175 | 0 | |
| 176 | | ○ | ○ | ○ | ○ | ○ | ○ | | ○ | ○ | | ○ | 176 | 0 | |
| 177 | ○ | ○ | ○ | ○ | ○ | ○ | ○ | | ○ | ○ | | ○ | 177 | 0 | |
| 178 | ○ | ○ | ○ | ○ | ○ | ○ | | ○ | ○ | ○ | | ○ | 178 | 0 | |
| 179 | | ○ | ○ | ○ | ○ | | ○ | ○ | ○ | ○ | | ○ | 179 | 0 | |
| 180 | ○ | ○ | ○ | ○ | ○ | | ○ | ○ | ○ | ○ | | ○ | 180 | 0 | |
| 181 | | ○ | ○ | ○ | ○ | ○ | | ○ | | ○ | ○ | ○ | 181 | 0 | |
| 182 | | | | | | ○ | ○ | ○ | ○ | ○ | | ○ | 182 | 0 | |
| 183 | ○ | | | | | ○ | ○ | ○ | ○ | ○ | | ○ | 183 | 0 | |
| 184 | | ○ | | | | ○ | ○ | ○ | ○ | ○ | | ○ | 184 | 0 | |
| 185 | ○ | ○ | | | | ○ | ○ | ○ | ○ | ○ | | ○ | 185 | 0 | |
| 186 | | | ○ | | | ○ | ○ | ○ | ○ | ○ | | ○ | 186 | 0 | |
| 187 | ○ | | ○ | | | ○ | ○ | ○ | ○ | ○ | | ○ | 187 | 0 | |
| 188 | | ○ | ○ | | | ○ | ○ | ○ | ○ | ○ | | ○ | 188 | 0 | |
| 189 | ○ | ○ | ○ | | | ○ | ○ | ○ | ○ | ○ | | ○ | 189 | 0 | |
| 190 | | | | ○ | | ○ | ○ | ○ | ○ | ○ | | ○ | 190 | 0 | |
| 191 | ○ | | | ○ | | ○ | ○ | ○ | ○ | ○ | | ○ | 191 | 0 | |
| 192 | | ○ | | ○ | | ○ | ○ | ○ | ○ | ○ | | ○ | 192 | 0 | |
| 193 | ○ | ○ | | ○ | | ○ | ○ | ○ | ○ | ○ | | ○ | 193 | 0 | |
| 194 | | | ○ | ○ | | ○ | ○ | ○ | ○ | ○ | | ○ | 194 | 0 | |
| 195 | ○ | | ○ | ○ | | ○ | ○ | ○ | ○ | ○ | | ○ | 195 | 0 | |
| 196 | | ○ | ○ | ○ | | ○ | ○ | ○ | ○ | ○ | | ○ | 196 | 0 | |
| 197 | ○ | ○ | ○ | ○ | | ○ | ○ | ○ | ○ | ○ | | ○ | 197 | 0 | |
| 198 | | | | | ○ | ○ | ○ | ○ | ○ | ○ | | ○ | 198 | 0 | |
| 199 | ○ | | | | ○ | ○ | ○ | ○ | ○ | ○ | | ○ | 199 | 0 | |
| 200 | | ○ | | | ○ | ○ | ○ | ○ | ○ | ○ | | ○ | 200 | 0 | |
| 201 | ○ | ○ | | | ○ | ○ | ○ | ○ | ○ | ○ | | ○ | 201 | 0 | |
| 202 | | | ○ | | ○ | ○ | ○ | ○ | ○ | ○ | | ○ | 202 | 0 | |
| 203 | ○ | | ○ | | ○ | ○ | ○ | ○ | ○ | ○ | | ○ | 203 | 0 | |

FIG. 26

| | SUB-FIELD | | | | | | | | | | | DISPLAY | CONVERTED VALUE | ERROR | DITHER |
|---|---|---|---|---|---|---|---|---|---|---|---|---|---|---|---|
| WEIGHT / GRAY LEVELS | SF1 | SF2 | SF3 | SF4 | SF5 | SF6 | SF7 | SF8 | SF9 | SF10 | SF11 | AVAILABLE/ UNAVAILABLE | | | |
| | 1 | 2 | 4 | 8 | 16 | 33 | 35 | 36 | 38 | 40 | 42 | | | | |
| 204 | | ○ | ○ | | ○ | ○ | ○ | ○ | ○ | ○ | | ○ | 204 | 0 | |
| 205 | ○ | ○ | ○ | | ○ | ○ | ○ | ○ | ○ | ○ | | ○ | 205 | 0 | |
| 206 | | | | ○ | ○ | ○ | ○ | ○ | ○ | ○ | | ○ | 206 | 0 | |
| 207 | ○ | | | ○ | ○ | ○ | ○ | ○ | ○ | ○ | | ○ | 207 | 0 | |
| 208 | | ○ | | ○ | ○ | ○ | ○ | ○ | ○ | ○ | | ○ | 208 | 0 | |
| 209 | ○ | ○ | | ○ | ○ | ○ | ○ | ○ | ○ | ○ | | ○ | 209 | 0 | |
| 210 | | | ○ | ○ | ○ | ○ | ○ | ○ | ○ | ○ | | ○ | 210 | 0 | |
| 211 | ○ | | ○ | ○ | ○ | ○ | ○ | ○ | ○ | ○ | | ○ | 211 | 0 | |
| 212 | | ○ | ○ | ○ | ○ | ○ | ○ | ○ | ○ | ○ | | ○ | 212 | 0 | |
| 213 | ○ | ○ | ○ | ○ | ○ | ○ | ○ | ○ | ○ | ○ | | ○ | 213 | 0 | |
| 214 | | ○ | ○ | ○ | ○ | ○ | ○ | ○ | ○ | | ○ | ○ | 214 | 0 | |
| 215 | ○ | ○ | ○ | ○ | ○ | ○ | ○ | ○ | ○ | | ○ | ○ | 215 | 0 | |
| 216 | | ○ | ○ | ○ | ○ | ○ | ○ | ○ | | ○ | ○ | ○ | 216 | 0 | |
| 217 | ○ | ○ | ○ | ○ | ○ | ○ | ○ | ○ | | ○ | ○ | ○ | 217 | 0 | |
| 218 | | ○ | ○ | ○ | ○ | ○ | ○ | | ○ | ○ | ○ | ○ | 218 | 0 | |
| 219 | ○ | ○ | ○ | ○ | ○ | ○ | ○ | | ○ | ○ | ○ | ○ | 219 | 0 | |
| 220 | ○ | ○ | ○ | ○ | ○ | ○ | | ○ | ○ | ○ | ○ | ○ | 220 | 0 | |
| 221 | | ○ | ○ | ○ | ○ | | ○ | ○ | ○ | ○ | ○ | ○ | 221 | 0 | |
| 222 | ○ | ○ | ○ | ○ | ○ | | ○ | ○ | ○ | ○ | ○ | ○ | 222 | 0 | |
| 223 | – | – | – | – | – | – | – | – | – | – | – | × | 222 | 1 | ±1 |
| 224 | | | | | | ○ | ○ | ○ | ○ | ○ | ○ | ○ | 224 | 0 | |
| 225 | ○ | | | | | ○ | ○ | ○ | ○ | ○ | ○ | ○ | 225 | 0 | |
| 226 | | ○ | | | | ○ | ○ | ○ | ○ | ○ | ○ | ○ | 226 | 0 | |
| 227 | ○ | ○ | | | | ○ | ○ | ○ | ○ | ○ | ○ | ○ | 227 | 0 | |
| 228 | | | ○ | | | ○ | ○ | ○ | ○ | ○ | ○ | ○ | 228 | 0 | |
| 229 | ○ | | ○ | | | ○ | ○ | ○ | ○ | ○ | ○ | ○ | 229 | 0 | |
| 230 | | ○ | ○ | | | ○ | ○ | ○ | ○ | ○ | ○ | ○ | 230 | 0 | |
| 231 | ○ | ○ | ○ | | | ○ | ○ | ○ | ○ | ○ | ○ | ○ | 231 | 0 | |
| 232 | | | | ○ | | ○ | ○ | ○ | ○ | ○ | ○ | ○ | 232 | 0 | |
| 233 | ○ | | | ○ | | ○ | ○ | ○ | ○ | ○ | ○ | ○ | 233 | 0 | |
| 234 | | ○ | | ○ | | ○ | ○ | ○ | ○ | ○ | ○ | ○ | 234 | 0 | |
| 235 | ○ | ○ | | ○ | | ○ | ○ | ○ | ○ | ○ | ○ | ○ | 235 | 0 | |
| 236 | | | ○ | ○ | | ○ | ○ | ○ | ○ | ○ | ○ | ○ | 236 | 0 | |
| 237 | ○ | | ○ | ○ | | ○ | ○ | ○ | ○ | ○ | ○ | ○ | 237 | 0 | |
| 238 | | ○ | ○ | ○ | | ○ | ○ | ○ | ○ | ○ | ○ | ○ | 238 | 0 | |
| 239 | ○ | ○ | ○ | ○ | | ○ | ○ | ○ | ○ | ○ | ○ | ○ | 239 | 0 | |
| 240 | | | | | ○ | ○ | ○ | ○ | ○ | ○ | ○ | ○ | 240 | 0 | |
| 241 | ○ | | | | ○ | ○ | ○ | ○ | ○ | ○ | ○ | ○ | 241 | 0 | |
| 242 | | ○ | | | ○ | ○ | ○ | ○ | ○ | ○ | ○ | ○ | 242 | 0 | |
| 243 | ○ | ○ | | | ○ | ○ | ○ | ○ | ○ | ○ | ○ | ○ | 243 | 0 | |
| 244 | | | ○ | | ○ | ○ | ○ | ○ | ○ | ○ | ○ | ○ | 244 | 0 | |
| 245 | ○ | | ○ | | ○ | ○ | ○ | ○ | ○ | ○ | ○ | ○ | 245 | 0 | |
| 246 | | ○ | ○ | | ○ | ○ | ○ | ○ | ○ | ○ | ○ | ○ | 246 | 0 | |
| 247 | ○ | ○ | ○ | | ○ | ○ | ○ | ○ | ○ | ○ | ○ | ○ | 247 | 0 | |
| 248 | | | | ○ | ○ | ○ | ○ | ○ | ○ | ○ | ○ | ○ | 248 | 0 | |
| 249 | ○ | | | ○ | ○ | ○ | ○ | ○ | ○ | ○ | ○ | ○ | 249 | 0 | |
| 250 | | ○ | | ○ | ○ | ○ | ○ | ○ | ○ | ○ | ○ | ○ | 250 | 0 | |
| 251 | ○ | ○ | | ○ | ○ | ○ | ○ | ○ | ○ | ○ | ○ | ○ | 251 | 0 | |
| 252 | | | ○ | ○ | ○ | ○ | ○ | ○ | ○ | ○ | ○ | ○ | 252 | 0 | |
| 253 | ○ | | ○ | ○ | ○ | ○ | ○ | ○ | ○ | ○ | ○ | ○ | 253 | 0 | |
| 254 | | ○ | ○ | ○ | ○ | ○ | ○ | ○ | ○ | ○ | ○ | ○ | 254 | 0 | |
| 255 | ○ | ○ | ○ | ○ | ○ | ○ | ○ | ○ | ○ | ○ | ○ | ○ | 255 | 0 | |

DISPLAY DEVICE, AND DISPLAY METHOD

TECHNICAL FIELD

The present invention relates to a display device and a display method providing a gray scale display by controlling in accordance with an input video signal individual pixels on a display panel so that each pixel emits light or does not emit light in individual sub-fields that are defined by dividing one field, arranged on a time base in a prescribed order and weighted to represent gray levels.

BACKGROUND ART

A plasma display device employing a plasma display panel has such an advantage that the same allows thinning and conversion to a large screen. This plasma display device utilizes light emission in discharge of a discharge cell forming a pixel thereby displaying an image. The plasma display panel emits light in a binary manner, and hence a sub-field method displaying half tone by temporally superposing a plurality of binary images weighted respectively is employed.

In this sub-field method, one field is temporally divided into a plurality of sub-fields, and the respective sub-fields are weighted respectively. The weight of each sub-field corresponds to the quantity of light emission of each sub-field, the emission frequency is employed as the weight, for example, and the total of the weights of the respective sub-fields corresponds to the luminance of a video signal, i.e., the gray level.

When employing the aforementioned sub-field method, the eyes of a viewer follow a dynamic image with respect to the dynamic image, and hence a temporal integral area of the eyes spatially changes and specific pseudo-contour noise is observed with respect to the dynamic image. This contour line is referred to as pseudo-contour noise ("Pseudo-Contour Noise Observed in Pulse Duration Modulation Dynamic Image Display": Technical Report of Television Institute, Vol. 19, No. 2, IDY95-21, pp. 61-66), serving as a cause deteriorating the picture quality.

In order to reduce the aforementioned dynamic image pseudo-contour, there is the one dividing one field into 10 sub-fields and setting the weights of the respective sub-fields to 1, 2, 3, 4, 5, 6, 8, 10, 11 and 13, for example. In this case, the dynamic image pseudo-contour can be reduced.

There is also the one multiplying the number of light emission pulses of each sub-field by an integer with respect to a reference number of light emission pulses, dividing one field into 10 sub-fields, for example, and setting weights for the respective sub-fields to 4, 8, 12, 16, 20, 24, 32, 40, 44 and 52 in order to improve the maximum luminance. In this case, the maximum gray level reaches 252, and the maximum luminance can be improved.

In the former example, however, the maximum gray level reaches 64 and the maximum luminance cannot be improved although the dynamic image pseudo-contour can be reduced. In the latter example, the maximum gray level reaches 252 and the maximum luminance can be improved, while the gray level can only be set every four and hence reproducibility for low gray levels lowers.

DISCLOSURE OF THE INVENTION

An object of the present invention is to provide a display device and a display method capable of sufficiently enlarging the maximum gray level and the total number of displayable gray scales without increasing the number of division of sub-fields while improving reproducibility for low gray levels.

A display device according to an aspect of the present invention is a display device providing a gray scale display by controlling in accordance with an input video signal individual pixels on a display panel so that each pixel emits light or does not emit light in individual sub-fields that are defined by dividing one field and arranged on a time base in a prescribed order, the sub-fields being weighted to represent gray levels, the plurality of sub-fields are weighted in such a way that at least one non-display gray level which cannot be displayed by combining the plurality of sub-fields is arranged between displayable gray levels by combining the plurality of sub-fields, and the display device comprises diffusion means receiving the video signal for, when the video signal represents the non-display gray level, diffusing temporally and/or spatially a difference between the non-display gray level and one of the display gray levels so that the non-display gray level can be equivalently displayed with the display gray levels; sub-field correspondence means for converting a video signal representing one field output from the diffusion means into a video signal representing individual sub-fields; and emitting means for controlling the pixels on the display panel so that each pixel emits light or does not emit light in the individual sub-fields, in accordance with the video signal representing the individual sub-fields output from the sub-field correspondence means.

In the display device, the plurality of sub-fields are so weighted that at least one non-display gray level non-displayable by combination of the plurality of sub-fields is arranged between display gray levels displayable by combination of the plurality of sub-fields, non-display gray levels are properly dispersed in the display gray levels, and the total number of gray scales and the maximum gray level can be enlarged as a whole without increasing the number of division of the sub-fields although gray levels non-displayable by only combination of sub-fields are present.

The difference between the non-display gray level and one of the display gray levels is temporally and/or spatially diffused when the video signal is a video signal of the non-display gray level, and the video signal of one field after diffusion is converted into the video signal every sub-field so that each pixel on the display panel emit light or emit no light every sub-field in response to the converted video signal every sub-field, whereby the non-display gray level not directly displayable by combination of sub-fields can be equivalently displayed with the display gray levels. Thus, display of all gray levels including display gray levels and non-display gray levels becomes possible, the maximum gray level and the total number of displayable gray scales can be sufficiently enlarged, and low gray levels can also be sufficiently finely reproduced.

Consequently, the maximum gray level and the total number of displayable gray scales can be sufficiently enlarged while reproducibility for low gray levels can be improved without increasing the number of division of sub-fields.

The diffusion means may include gray level conversion means for converting the non-display gray level into one of the display gray levels that is close to the non-display gray level, and error diffusion means for diffusing, when the non-display gray level is converted into the one of the display gray levels by the gray level conversion means, a difference between the non-display gray level and the one of the display gray levels to pixels around a pixel having the non-display gray level.

In this case, the non-display gray level to the display gray level close to the non-display gray level among the display gray levels is converted and the difference between the non-display gray level and the display gray level is diffused to the pixels around the pixel having the non-display gray level. Therefore, the difference between the non-display gray level and the display gray level can be spatially diffused, and the non-display gray level can be equivalently displayed with the display gray level.

The diffusion means may include dither diffusion means for alternately adding or subtracting a difference between the non-display gray level and one of the display gray levels that is close to the non-display gray level to diffuse between fields or between pixels.

In this case, the difference between the non-display gray level and the display gray level close to the non-display gray level among the display gray levels is alternately added or subtracted to diffuse between fields or between pixels, whereby the difference between the non-display gray level and the display gray level can be temporally or spatially diffused by dither diffusion processing and the non-display gray level can be displayed with the non-display gray level.

At least two continuous non-display gray levels may be included between the display gray levels, and the diffusion means may include dither diffusion means for alternately adding or subtracting a difference between one non-display gray level included in the at least two continuous non-display gray levels and one of the display gray levels that is close to the one non-display gray level to diffuse between fields or between pixels, gray level conversion means for converting another non-display gray level included in the at least two continuous non-display gray levels into a gray level close to the another non-display gray level among the display gray levels and a gray level rendered displayable by the dither diffusion means, and error diffusion means for diffusing, when the another non-display gray level is converted by the gray level conversion means, a difference between the another non-display gray level and the converted gray level to pixels around a pixel having the another non-display gray level.

In this case, at least two non-display gray levels are continuously arranged between the display gray levels, while the difference between one non-display gray level included in at least two continuous non-display gray levels and the display gray level close to the non-display gray level among the display gray levels is alternately added or subtracted to diffuse between fields or between pixels, the other non-display gray level is converted into the gray level close to the non-display gray level among the display gray levels and the gray level rendered displayable by dither diffusion processing, and the difference between the non-display gray level and the converted gray level is diffused to the pixels around the pixel having the non-display gray level. Also when at least two non-display gray levels continue, therefore, it is possible to equivalently display one thereof by dither diffusion processing while equivalently displaying the other non-display gray level by error diffusion processing, and all non-display gray levels can be displayed with the display gray levels also when at least two non-display gray levels continue.

The video signal may be a digital video signal expressed by a plurality of bits, and the display device may further comprise lower diffusion means receiving the digital video signal for diffusing between fields or between pixels data of a bit lower by one digit than a bit in the digital video signal corresponding to a minimum gray level expressed by the least significant sub-field having the minimum weight among weights representing gray levels, so as to display a gray level which is half the minimum gray level, and selection means for selecting an output of the diffusion means when the gray level of the digital video signal output from the lower diffusion means is not less than the minimum value of the non-display gray level and for selecting an output of the lower diffusion means when the gray level of the digital video signal output from the lower diffusion means is less than the minimum value of the non-display gray level and for outputting the selected output to the sub-field correspondence means.

In this case, the video signal is a digital video signal expressed by a plurality of bits, and the data of the bit lower by one than the bit of the digital video signal corresponding to the minimum gray level is diffused between fields or between pixels in order to display the gray level half the minimum gray level expressed by the least significant sub-field having the minimum weight weighted in correspondence to the gray level among the plurality of sub-fields, the digital video signal obtained by temporally and/or spatially diffusing the difference between the non-display gray level and the display gray level is selected when the gray level of the diffused digital video signal is in excess of the minimum value of the non-display gray level and a digital video signal obtained by diffusing the data of the lower bit between fields or between pixels is selected otherwise, i.e., in a case of a low gray level. Therefore, the gray level half the minimum gray level can be equivalently displayed when the gray level is a low gray level, and resolution of the low gray level can be more refined.

The video signal may be a digital video signal expressed by a plurality of bits, and the display device may further comprise lower diffusion means receiving the digital video signal for diffusing between fields or between pixels data of a bit lower by one digit than a bit in the digital video signal corresponding to a minimum gray level expressed by the least significant sub-field having the minimum weight among weights representing gray levels, so as to display a gray level which is half the minimum gray level, and selection means for selecting the digital video signal not yet diffused by the lower diffusion means when the gray level of the digital video signal output from the lower diffusion means is not less than the minimum value of the non-display gray level and for selecting an output of the lower diffusion means when the gray level of the digital video signal output from the lower diffusion means is less than the minimum value of the non-display gray level, and the diffusion means may include dither diffusion means receiving the digital video signal output from the selection means, for alternately adding or subtracting a difference between the non-display gray level and a display one of gray levels that is close to the non-display gray level to diffuse between fields or between pixels.

In this case, the video signal is a digital video signal expressed by a plurality of bits, the data of the bit lower by one than the bit of the digital video signal corresponding to the minimum gray level is diffused in order to display the gray level half the minimum gray level expressed by the most significant sub-field having the minimum weight weighted in correspondence to the gray level among the plurality of sub-fields, the digital video signal before diffusion is selected when the gray level of the diffused digital video signal is in excess of the minimum value of the non-display gray level while the digital video signal diffusing the data of the lower bit between fields or between pixels is selected otherwise, i.e., when the gray level is a low gray level, and the difference between the non-display gray level and the display gray level close to the non-display gray level among the display gray levels is alternately added or subtracted to diffuse with the selected digital video signal. Therefore, the non-display gray level can be expressed with the display gray level by dither diffusion processing while the gray level half the minimum gray level can be equivalently displayed when the gray level is a low gray level, and resolution of the low gray level can be more refined.

The video signal may be a digital video signal expressed by a plurality of bits, at least two continuous non-display gray levels may be included between the display gray levels, and the display device may further comprise lower diffusion means receiving the digital video signal, for diffusing between fields or between pixels data of a bit lower by one digit than a bit in the digital video signal corresponding to a minimum gray level expressed by the least significant sub-field having the minimum weight among weights representing gray levels, so as to display a gray level which is half the minimum gray level, selection means for selecting an output of the diffusion means when the gray level of the digital video signal output from the lower diffusion means is not less than the minimum value of the non-display gray level and for selecting an output of the lower diffusion means when the gray level of the digital video signal output from the lower diffusion means is less than the minimum value of the non-display gray level, and dither diffusion means receiving the digital video signal output from the selection means, for alternately adding or subtracting a difference between one non-display gray level included in the at least two continuous non-display gray levels and one of the display gray levels that is close to the one non-display gray level to diffuse between fields or between pixels, the diffusion means may include gray level conversion means for converting another non-display gray level included in the at least two continuous non-display gray levels into a gray level close to the another non-display gray level among the display gray levels and a gray level rendered displayable by the dither diffusion means, and error diffusion means for diffusing, when the another non-display gray level is converted by the gray level conversion means, a difference between the another non-display gray level and the converted gray level to pixels around a pixel having the another non-display gray level.

In this case, the video signal is a digital video signal expressed by a plurality of bits, at least two continuous non-display gray levels are included between the display gray levels, and the difference between one non-display gray level included in at least two continuous non-display gray levels and a display gray level close to the non-display gray level among the display gray levels is alternately added or subtracted to diffuses between fields or between pixels, the other display gray level included in at least two continuous non-display gray levels is cnverted into a gray level close to the non-display gray level among the display gray levels and a gray level rendered displayable by dither diffusion processing, and the difference between the non-display gray level and the converted gray level is diffused to the pixels around the pixel having the non-display gray level.

The data of the bit lower by one than the bit of the digital video signal corresponding to the minimum gray level is diffused between fields or between pixels in order to display the gray level half the minimum gray level expressed by the least significant sub-field having the minimum weight weighted in correspondence to the gray level among the plurality of sub-fields, the digital video signal diffused by error diffusion processing is selected when the gray level of the diffused digital video signal is in excess of the minimum value of the non-display gray level, and a digital video signal obtained by diffusing the data of the lower bit between fields or between pixels is selected otherwise, i.e., when the gray level is a low gray level.

Also when at least two non-display gray levels are continuous, therefore, it is possible to diffuse one by dither diffusion processing and diffuse the other non-display gray level by error diffusion processing, while the gray level half the minimum gray level can be equivalently displayed when the gray level is a low gray level and resolution of the low gray level can be more refined.

A display method according to another aspect of the present invention is a display method for providing a gray scale display by controlling in accordance with an input video signal individual pixels on a display panel so that each pixel emits light or does not emit light in individual sub-fields that are defined by dividing one field and arranged on a time base in a prescribed order, the sub-fields being weighted to represent gray levels, the plurality of sub-fields are weighted in such a way that at least one non-display gray level which cannot be displayed by combining the plurality of sub-fields is arranged between displayable gray levels by combining the plurality of sub-fields, and the display method comprises the steps of, receiving the video signal for, when the video signal represents the non-display gray level, diffusing temporally and/or spatially a difference between the non-display gray level and one of the display gray levels so that the non-display gray level can be equivalently displayed with the display gray levels; converting a video signal representing one field processed in the step of diffusing into a video signal representing individual sub-fields; and controlling the pixels on the display panel so that each pixel emits light or does not emit light in the individual sub-fields in accordance with the converted video signal representing the individual sub-fields.

In the display method, the plurality of sub-fields are so weighted that at least one non-display gray level non-displayable by combination thereof is arranged between display gray levels displayable by combination thereof, non-display gray levels are properly dispersed in the display gray levels, and the total number of gray levels and the maximum gray level can be enlarged as a whole without increasing the number of division of the sub-fields although gray levels not displayable only by combination of sub-fields are present.

The difference between the non-display gray level and the display gray levels is temporally and/or spatially diffused when the video signal is a video signal of a non-display gray level, the video signal of one field after diffusion is converted into a video signal every sub field so that each pixel on the display panel emit light or emit no light every sub-field in response to the converted video signal every sub-field, whereby a non-display gray level not directly expressible by combination of sub-fields can be equivalently displayed with a display gray level. Therefore, display of all gray levels including display gray levels and non-display gray levels becomes possible, the maximum gray level and the total number of displayable gray scales can be sufficiently enlarged, and low gray levels can also be sufficiently finely reproduced.

Consequently, the maximum gray level and the total number of displayable gray scales can be sufficiently enlarged while reproducibility for low gray levels can be improved without increasing the number of division of sub-fields.

The step of diffusing may include the steps of converting the non-display gray level into one of the display gray levels that is close to the non-display gray level, and diffusing, when the non-display gray level is converted into the one of the display gray levels, a difference between the non-display gray level and the one of the display gray levels to pixels around a pixel having the non-display gray level.

In this case, the non-display gray level is converted into the display gray level close to the non-display gray level among the display gray levels, and the difference between the non-display gray level and the display gray level is diffused to the pixels around the pixel having the non-display gray level. Therefore, the difference between the non-display gray level and the display gray level can be spatially diffused, and the non-display gray level can be equivalently displayed with the display gray level.

The step of diffusing may include the step of alternately adding or subtracting a difference between the non-display gray level and one of the display gray levels that is close to the non-display gray level to diffuse between fields or between pixels.

In this case, the difference between the non-display gray level and the display gray level close to the non-display gray level among the display gray levels is alternately added or subtracted to diffuse between fields or between pixels, whereby the difference between the non-display gray level and the display gray level can be temporally or spatially diffused by dither diffusion processing, and the non-display gray level can be displayed with the non-display gray level.

At least two continuous non-display gray levels may be included between the display gray levels, and the step of diffusing may include the steps of alternately adding or subtracting a difference between one non-display gray level included in the at least two continuous non-display gray levels and one of the display gray levels that is close to the one non-display gray level to diffuse between fields or between pixels, converting another non-display gray level included in the at least two continuous non-display gray levels to a gray level close into the another non-display gray level among the display gray levels and a gray level rendered displayable in the step of adding or subtracting to diffuse, and diffusing, when the another non-display gray level is converted, a difference between the another non-display gray level and the converted gray level to pixels around a pixel having the another non-display gray level.

In this case, at least two non-display gray levels are continuously arranged between the display gray levels, while the difference between one non-display gray level included in at least two continuous non-display gray levels and the display gray level close to the non-display gray level among the display gray levels is alternately added or subtracted to diffuse, the other non-display gray level is converted into the gray level close to the non-display gray level among the display gray levels and a gray level rendered displayable by dither diffusion processing and the difference between the non-display gray level and the converted gray level is diffused to the pixels around the pixel having the non-display gray level. Also when at least two non-display gray levels are continuous, therefore, one thereof can be equivalently displayed by dither diffusion processing while the other non-display gray level can be equivalently displayed by error diffusion processing, and all non-display gray levels can be displayed with display gray levels also when at least two non-display gray levels are continuous.

The video signal may be a digital video signal expressed by a plurality of bits, and the display method may further comprise the steps of, receiving the digital video signal for diffusing between fields or between pixels data of a bit lower by one digit than a bit in the digital video signal corresponding to a minimum gray level expressed by the least significant sub-field having the minimum weight among weights representing gray levels, so as to display a gray level which is half the minimum gray level, and selecting the digital video signal processed by diffusing temporally and/or spatially when the gray level of the digital video signal obtained by diffusing the data of a bit lower by one digit is not less than the minimum value of the non-display gray level or selecting the digital video signal obtained by diffusing the data of a bit lower by one digit when the gray level of the digital video signal obtained by diffusing the data of a bit lower by one digit is less than the minimum value of the non-display gray level.

In this case, the video signal is a digital video signal expressed by a plurality of bits, and the data of the bit lower by one than the bit of the digital video signal corresponding to the minimum gray level is diffused between fields or between pixels in order to display the gray level half the minimum gray level expressed by the least significant sub-field having the minimum weight weighted in correspondence to the gray level among the plurality of sub-fields and the digital video signal obtained by temporally and/or spatially diffusing the difference between the non-display gray level and the display gray level is selected when the gray level of the diffused digital video signal is in excess of the minimum value of the non-display gray level while the digital video signal obtained by diffusing the data of the lower bit between fields or between pixels is selected otherwise, i.e., in a case of a low gray level. Therefore, the gray level half the minimum gray level can be equivalently displayed when the gray level is a low gray level, and the resolution of the low gray level can be more refined.

The video signal may be a digital video signal expressed by a plurality of bits, and the display method may further comprise the steps of, receiving the digital video signal for diffusing between fields or between pixels data of a bit lower by one digit than a bit in the digital video signal corresponding to a minimum gray level expressed by the least significant sub-field having the minimum weight among weights representing gray levels, so as to display a gray level which is half the minimum gray level, and selecting the digital video signal not processed by diffusing the data of a bit lower by one digit when the gray level of the digital video signal obtained by diffusing the data of a bit lower by one digit is not less than the minimum value of the non-display gray level or selecting the digital video signal obtained by diffusing the data of a bit lower by one digit when the gray level of the digital video signal obtained by diffusing the data of a bit lower by one digit is less than the minimum value of the non-display gray level, and wherein the step of diffusing temporally and/or spatially includes the step of receiving the digital video signal selected in the step of selecting, for alternately adding or subtracting a difference between the non-display gray level and one of gray levels that is close to the non-display gray level to diffuse between fields or between pixels.

In this case, the video signal is a digital video signal expressed by a plurality of bits, and the data of the bit lower by one than the bit of the digital video signal corresponding to the minimum gray level is diffused in order to display the gray level half the minimum gray level expressed by the least significant sub-field having the minimum weight weighted in correspondence to the gray level among the plurality of sub-fields, the digital video signal before diffusion is selected when the gray level of the diffused digital video signal is in excess of the minimum value of the non-display gray level while the digital video signal obtained by diffusing the data of the lower bit between fields or between pixels is selected otherwise, i.e., when the gray level is a low gray level, and the difference between the non-display gray level and the display gray level close to the non-display gray level among the display gray levels is alternately added or subtracted to diffuse between fields or between pixels with the selected digital video signal. Therefore, the non-display gray level can be expressed with the gray level by dither diffusion processing while the gray level half the minimum gray level can be equivalently displayed when the gray level is a low gray level, and the resolution of the low gray level can be more refined.

The video signal may be a digital video signal expressed by a plurality of bits, and at least two continuous non-display gray levels may be included between the display gray levels, and the display method may further comprise the steps of receiving the digital video signal for diffusing between fields or between pixels data of a bit lower by one digit than a bit in the digital video signal corresponding to a minimum gray level expressed by the least significant sub-field having the minimum weight among weights representing gray levels, so as to display a gray level which is half the minimum gray level, selecting the digital video signal processed by diffusing temporally and/or spatially when the gray level of the digital video signal obtained by diffusing the data of a bit lower by one digit is not less than the minimum value of the non-display gray level or selecting the digital video signal obtained by diffusing the data of a bit lower by one digit when the gray level of the digital video signal obtained by diffusing the data of a bit lower by one digit is less than the minimum value of the non-display gray level, and receiving the digital video signal selected in the step of selecting, for alternately adding or subtracting a difference between one non-display gray level included in the at least two continuous non-display gray levels and one of the display gray levels that is close to the one non-display gray level to diffuse between fields or between pixels, and the step of diffusing temporally and/or spatially may include the steps of converting another non-display gray level included in the at least two continuous non-display gray levels into a gray level close to the another non-display gray level among the display gray levels and a gray level rendered displayable in the step of adding or subtracting to diffuse, and diffusing, when the another non-display gray level is converted, a difference between the another non-display gray level and the converted gray level to pixels around a pixel having the another non-display gray level.

In this case, the video signal is a digital video signal expressed by a plurality of bits, at least two continuous non-display gray levels are included between the display gray levels, and the difference between one non-display gray level included in at least two continuous non-display gray levels and the display gray level close to the non-display gray level among the display gray levels is alternately added or subtracted to diffuse between fields or between pixels, the other display gray level included in at least two continuous non-display gray levels is converted into the gray level close to the non-display gray level among the display gray levels and the gray level rendered displayable by dither diffusion processing, and the difference between the non-display gray level and the converted gray level is diffused to the pixels around the pixel having the non-display gray level.

Further, the data of the bit lower by one than the bit of the digital video signal corresponding to the minimum gray level is diffused between fields or between pixels in order to display the gray level half the minimum gray level expressed by the least significant sub-field having the minimum weight weighted in correspondence to the gray level among the plurality of sub-fields and the diffused digital video signal is selected by error diffusion processing when the gray level of the diffused digital video signal is in excess of the minimum value of the non-display gray level while the digital video signal obtained by diffusing the data of the lower bit between fields or between pixels is selected otherwise, i.e., when the gray level is a low gray level.

Also when at least two non-display gray levels are continuous, therefore, it is possible to diffuse one by dither diffusion processing and diffuse the other non-display gray level by error diffusion processing while the gray level half the minimum gray level can be equivalently displayed when the gray level is a low gray level, and the resolution of the low gray level can be more refined.

A display device according to still another aspect of the present invention is a display device providing a gray scale display by controlling in accordance with an input video signal individual pixels on a display panel so that each pixel emits light or does not emit light in individual sub-fields that are defined by dividing one field and arranged on a time base in a prescribed order, the sub-fields being weighted to represent gray levels, the plurality of sub-fields are weighted in such a way that at least one non-display gray level which cannot be displayed by combining the plurality of sub-fields is arranged between displayable gray levels by combining the plurality of sub-fields, and the display device comprises a diffusion circuit that receives the video signal for, when the video signal represents the non-display gray level, diffusing temporally and/or spatially a difference between the non-display gray level and one of the display gray levels so that the non-display gray level can be equivalently displayed with the display gray levels; a sub-field corresponder that converts a video signal representing one field output from the diffusion circuit into a video signal representing individual sub-fields; and an emitting circuit that controls the pixels on the display panel so that each pixel emits light or does not emit light in the individual sub-fields, in accordance with the video signal representing the individual sub-fields output from the sub-field corresponder.

In the display device, the plurality of sub-fields are so weighted that at least one non-display gray level non-displayable by combination thereof is arranged between display gray levels displayable by combination thereof, non-display gray levels are properly dispersed between display gray levels, and the total number of gray scales and the minimum gray level can be enlarged as a whole without increasing the number of division of sub-fields although gray levels non-displayable only by combination of the sub-fields are present.

Further, the difference between the non-display gray level and the display gray levels is temporally and/or spatially diffused when the video signal is a video signal of a non-display gray level, the video signal of one field after diffusion is converted into a video signal every sub-field so that each pixel on the display panel emit light or emit no light every sub-field in response to the converted video signal every sub-field, whereby a non-display gray level not directly displayable by combination of the sub-fields can be equivalently displayed with a display gray level. Therefore, display of all gray levels including display gray levels and non-display gray levels becomes possible, the maximum gray level and the total number of displayable gray scales can be sufficiently enlarged, and low gray levels can also be sufficiently finely reproduced.

Consequently, it is possible to sufficiently enlarge the maximum gray level and the total number of displayable gray scales while reproducibility for low gray levels can be improved without increasing the number of division of sub-fields.

The diffusion circuit may include a gray level conversion table that converts the non-display gray level into one of the display gray levels that is close to the non-display gray level, and an error diffusion circuit that diffuses, when the non-display gray level is converted into the one of the display gray levels by the gray level conversion table, a difference between the non-display gray level and the one of the display gray levels to pixels around a pixel having the non-display gray level.

In this case, the non-display gray level is converted into the display gray level close to the non-display gray level among the display gray levels, and the difference between the non-display gray level and the display gray level is diffused to the pixels around the pixel having the non-display gray level. Therefore, the difference between the non-display gray level and the display gray level can be spatially diffused, and the non-display gray level can be equivalently displayed with the display gray level.

The diffusion circuit may include a dither diffusion circuit that alternately adds or subtracts a difference between the non-display gray level and one of the display gray levels that is close to the non-display gray level to diffuse between fields or between pixels.

In this case, the difference between the non-display gray level and the display gray level close to the non-display gray level among the display gray levels is alternately added or subtracted to diffuse between fields or between pixels, whereby the difference between the non-display gray level and the display gray level can be temporally or spatially diffused by dither diffusion processing, and the non-display gray level can be displayed with the non-display gray level.

At least two continuous non-display gray levels may be included between the display gray levels, and the diffusion circuit may include a dither diffusion circuit that alternately adds or subtracts a difference between one non-display gray level included in the at least two continuous non-display gray levels and one of the display gray levels that is close to the one non-display gray level to diffuse between fields or between pixels, a gray level conversion table that converts another non-display gray level included in the at least two continuous non-display gray levels into a gray level close to the another non-display gray level among the display gray levels and a gray level rendered displayable by the dither diffusion circuit, and an error diffusion circuit that diffuses, when the another non-display gray level is converted by the gray level conversion table, a difference between the another non-display gray level and the converted gray level to pixels around a pixel having the another non-display gray level.

In this case, at least two non-display gray levels are continuously arranged between the display gray levels, while the difference between one non-display gray level included in at least two continuous non-display gray levels and the display gray level close to the non-display gray level among the display gray levels is alternately added or subtracted to diffuse between fields or between pixels, the other non-display gray level is converted into the gray level close to the non-display gray level among the display gray levels and the gray level rendered displayable by dither diffusion processing, and the difference between the non-display gray level and the converted gray level is diffused to the pixels around the pixel having the non-display gray level. Also when at least two non-display gray levels are continuous, therefore, it is possible to equivalently display one thereof by dither diffusion processing while the other non-display gray level can be equivalently displayed by error diffusion processing, and all non-display gray levels can be displayed with display gray levels also when at least two non-display gray levels are continuous.

The video signal may be a digital video signal expressed by a plurality of bits, and the display device may further comprise a lower diffusion circuit that receives the digital video signal for diffusing between fields or between pixels data of a bit lower by one digit than a bit in the digital video signal corresponding to a minimum gray level expressed by the least significant sub-field having the minimum weight among weights representing gray levels, so as to display a gray level which is half the minimum gray level, and a selection circuit that selects an output of the diffusion circuit when the gray level of the digital video signal output from the lower diffusion circuit is not less than the minimum value of the non-display gray level and selects an output of the lower diffusion circuit when the gray level of the digital video signal output from the lower diffusion circuit is less than the minimum value of the non-display gray level and outputs the selected output to the sub-field corresponder.

In this case, the video signal is a digital video signal expressed by a plurality of bits, and the bit lower by one than the bit of the digital video signal corresponding to the minimum gray level is diffused between fields or between pixels in order to display the gray level half the minimum gray level expressed by the least significant sub-field having the minimum weight weighted in correspondence to the gray level among the plurality of sub-fields, the digital video signal obtained by temporally and/or spatially diffusing the difference between the non-display gray level and the display gray level is selected when the gray level of the diffused digital video signal is in excess of the minimum value of the non-display gray level, and the digital video signal obtained by diffusing the data of the lower bit between fields or between pixels is selected otherwise, i.e., in a case of a low gray level. Therefore, the gray level half the minimum gray level can be equivalently displayed when the gray level is a low gray level, and the resolution of the low gray level can be more refined.

The video signal may be a digital video signal expressed by a plurality of bits, and the display device may further comprise a lower diffusion circuit that receives the digital video signal for diffusing between fields or between pixels data of a bit lower by one digit than a bit in the digital video signal corresponding to a minimum gray level expressed by the least significant sub-field having the minimum weight among weights representing gray levels, so as to display a gray level which is half the minimum gray level, and a selection circuit that selects the digital video signal not yet diffused by the lower diffusion circuit when the gray level of the digital video signal output from the lower diffusion circuit is not less than the minimum value of the non-display gray level and selects an output of the lower diffusion circuit when the gray level of the digital video signal output from the lower diffusion circuit is less than the minimum value of the non-display gray level, and wherein the diffusion circuit includes a dither diffusion circuit that receives the digital video signal output from the selection circuit, for alternately adding or subtracting a difference between the non-display gray level and one of gray levels that is close to the non-display gray level to diffuse between fields or between pixels.

In this case, the video signal is a digital video signal expressed by a plurality of bits, and the data of the bit lower by one than the bit of the digital video signal corresponding to the minimum gray level is diffused between fields or between pixels in order to display the gray level half the minimum gray level expressed by the least significant sub-field having the minimum weight weighted in correspondence to the gray level among the plurality of sub-fields, the digital video signal before diffusion is selected when the gray level of the diffused digital video signal is in excess of the minimum value of the non-display gray level, the digital video signal obtained by diffusing the data of the lower bit between fields or between pixels is selected otherwise, i.e., when the gray level is a low gray level, and the difference between the non-display gray level and the display gray level close to the non-display gray level among the display gray levels is alternately added or subtracted to diffuse with the selected digital video signal. Therefore, the non-display gray level can be expressed with the display gray level by dither diffusion processing while the gray level half the minimum gray level can be equivalently displayed when the gray level is a low gray level, and the resolution of the low gray level can be more refined.

The video signal may be a digital video signal expressed by a plurality of bits, at least two continuous non-display gray levels may be included between the display gray levels, and the display device may further comprise a lower diffusion circuit that receives the digital video signal for diffusing between fields or between pixels data of a bit lower by one digit than a bit in the digital video signal corresponding to a minimum gray level expressed by the least significant sub-field having the minimum weight among weights representing gray levels, so as to display a gray level which is half the minimum gray level, a selection circuit that selects an output of the diffusion circuit when the gray level of the digital video signal output from the lower diffusion circuit is not less than the minimum value of the non-display gray level and selects an output of the lower diffusion circuit when the gray level of the digital video signal output from the lower diffusion circuit is less than the minimum value of the non-display gray level, and a dither diffusion circuit that receives the digital video signal output from the selection circuit, for alternately adding or subtracting a difference between one non-display gray level included in the at least two continuous non-display gray levels and one of the display gray levels that is close to the one non-display gray level to diffuse between fields or between pixels, the diffusion circuit may include a gray level conversion table that converts another non-display gray level included in the at least two continuous non-display gray levels into a gray level close to the another non-display gray level among the display gray levels and a gray level rendered displayable by the dither diffusion circuit, and an error diffusion circuit that diffuses, when the another non-display gray level is converted by the gray level conversion table, a difference between the another non-display gray level and the converted gray level to pixels around a pixel having the another non-display gray level.

In this case, the video signal is a video signal expressed by a plurality of bits, and the difference between one non-display gray level included in at least two continuous non-display gray levels and the display gray level close to the non-display gray level among the display gray levels is alternately added or subtracted to diffuse between fields or between pixels, the other display gray level included in at least two continuous non-display gray levels is converted into the gray level close to the non-display gray level among the display gray levels and the a gray level rendered displayable by dither diffusion processing, and the difference between the non-display gray level and the converted gray level is diffused to the pixels around the pixel having the non-display gray level.

Further, the data of the bit lower by one than the bit of the digital video signal corresponding to the minimum gray level is diffused between fields or between pixels in order to display the gray level half the minimum gray level expressed by the least significant sub-field having the minimum weight weighted in correspondence to the gray level among the plurality of sub-fields, and the digital video signal diffused by error diffusion processing is selected when the gray level of the diffused digital video signal is in excess of the minimum value of the non-display gray level while the digital video signal obtained by diffusing the data of the lower bit between fields or between pixels is selected otherwise, i.e., when the gray level is a low gray level.

Also when at least two non-display gray levels are continuous, therefore, it is possible to diffuse one by dither diffusion processing and diffuse the other non-display gray level by error diffusion processing, while the gray level half the minimum gray level can be equivalently displayed when the gray level is a low gray level, and the resolution of the low gray level can be more refined.

A display device according to a further aspect of the present invention is a display device providing a gray scale display by controlling in accordance with an input video signal individual pixels on a display panel so that each pixel emits light or does not emit light in individual N (N: natural number of not less than 1) sub-fields SC, SF2, . . . , SFN that are defined by dividing one field and arranged on a time base in a prescribed order, the N sub-fields SC, SF2, . . . , SFN are weighted to represent gray levels and the N sub-fields SC, SF2, . . . , SFN have small or equal weights in this order, and the N sub-fields SC, SF2, . . . , SFN include at least one such sub-field SFM that a difference between the weight of the sub-field SFM and the sum of the weights from the sub-field SC to the sub-field SF(M−1) exceeds the weight of the sub-field SC, whereby the gray scale of the video signal includes at least one non-display gray level non-displayable by combining the N sub-fields between displayable gray levels by combining the N sub-fields, and the display device comprises conversion means for, when the gray scale of the input video signal is the non-display gray level, converting the gray scale of the input video signal into one of the display gray levels that is close to the non-display gray level.

In the display device, the N sub-fields are so weighted as to include at least one such sub-field SFM that the difference between the weight of the sub-field SFM and the sum of the weights from the sub-field SC to the sub-field SF(M−1) exceeds the weight of the sub-field SC. Thus, it is possible to make gray scale display finely at low luminance and roughly at high luminance, and display matching with the human visual characteristics can be implemented.

Further, the gray scale of the video signal includes at least one non-display gray level non-displayable by combination of the N sub-fields between the display gray levels displayable by combination of the N sub-fields. When the gray scale of the input video signal is the non-display gray level, the gray scale of the input video signal is converted to the display gray level close to the non-display gray level. Thus, when a gray level non-displayable by only combination of sub-fields is present, the gray level can be displayed by a close display gray level, whereby continuity of the gray scale can be ensured.

The display device may further comprise diffusion means for diffusing temporally and/or spatially a difference between the non-display gray level and one of the display gray levels so as to equivalently display the non-display gray level with the one of the display gray levels that is converted by the conversion means and close to the non-display gray level.

In this case, it is possible to equivalently display the non-display gray level with the display gray level by temporally and/or spatially diffusing the difference between the non-display gray level and the display gray level. Thus, it is possible to display the gray level non-displayable only by combination of the sub-fields without increasing the number of division of the sub-fields, and the total number of gray scales and the maximum gray level can be enlarged as a whole.

The diffusion means may include dither diffusion means for alternately adding or subtracting between fields or between pixels a difference between the non-display gray level and one of the display gray levels that is close to the non-display gray level, so as to display the non-display gray level with the one of the display gray levels that is close to the non-display gray level.

When the input video signal is a video signal of a non-display gray level in this case, it is possible to display the non-display gray level with a display gray level by temporally and/or spatially diffusing the difference between the non-display gray level and the display gray level. Thus, it is possible to equivalently display the non-display gray level not directly displayable by combination of sub-fields with the display gray level.

The diffusion means may include error diffusion means for diffusing a difference between the non-display gray level and the one of the display gray levels to pixels around a pixel having the non-display gray level.

When the input video signal is a video signal of a non-display gray level in this case, the non-display gray level can be displayed by error-diffusing the difference between the non-display gray level and the close display gray level to the peripheral pixels. Thus, it is possible to equivalently display a non-display gray level not directly displayable by combination of sub-fields with the display gray level.

Therefore, display of all gray levels including display gray levels and non-display gray levels becomes possible, the maximum gray level and the total number of displayable gray scales can be sufficiently enlarged, and low gray levels can also be sufficiently finely reproduced.

Consequently, the maximum gray level and the total number of displayable gray scales can be sufficiently enlarged without increasing the number of division of sub-fields, while reproducibility for low gray levels can be improved.

A display device according to a further aspect of the present invention is a display device providing a gray scale display by controlling in accordance with an input video signal individual pixels on a display panel so that each pixel emits light or does not emit light in individual N (N: natural number of not less than 1) sub-fields SC, SF2, . . . , SFN that are defined by dividing one field and arranged on a time base in a prescribed order, the N sub-fields SC, SF2, . . . , SFN are weighted to represent gray levels and the N sub-fields SC, SF2, . . . , SFN have small or equal weights in this order, and the N sub-fields SC, SF2, . . . , SFN include at least one such sub-field SFM that a difference between the weight of the sub-field SFM and the sum of the weights from the sub-field SC to the sub-field SF(M−1) exceeds twice the weight of the sub-field SC, whereby the gray scale of the video signal includes at least two continuous non-display gray levels non-displayable by combining the N sub-fields between displayable gray levels by combining the N sub-fields and the at least two non-display gray levels belong to a first group or a second group respectively, and the display device comprises first conversion means for, when the gray scale of the input video signal is a non-display gray level of the first group, converting the gray scale of the input video signal into a non-display gray level of the second group that is close to the non-display gray level of the first group or one of the display gray levels that is close to the non-display gray level of the first group; and second conversion means for, when the gray scale of the input video signal is a non-display gray level of the second group or the non-display gray level of the second group converted by the first conversion means, converting the gray scale of the input video signal into one of the display gray levels that is close to the non-display gray level of the second group.

In the display device, the N sub-fields are so weighted that the difference between the weight of the sub-field SFM and the sum of the weights from the sub-field SC to the sub-field SF(M−1) exceeds twice the weight of the sub-field SC. Thus, it is possible to make gray scale display finely at low luminance and roughly at high luminance, and display matching with the human visual characteristics can be implemented.

Further, the gray scale of the video signal continuously includes at least two non-display gray levels non-displayable by combination of the N sub-fields between the display gray levels displayable by combination of the N sub-fields, and at least two continuous non-display gray levels belong to the first group or the second group respectively. When the gray scale of the input video signal is the non-display gray level of the first group, the gray scale of the input video signal is converted to the close non-display gray level of the second group or the close display gray level. When the gray scale of the input video signal is the non-display gray level of the second group or the converted close non-display gray level of the second group, the gray scale of the input video signal is converted to the close display gray level. Thus, when a gray level non-displayable by only combination of the sub-fields is present, the gray level can be displayed with a close display gray level, whereby continuity of the gray scale can be ensured.

The display device may further comprise error diffusion means for diffusing a difference between the non-display gray level of the first group and the non-display gray level of the second group or the one of the display gray levels converted by the first conversion means to pixels around a pixel having the non-display gray level of the first group, and dither diffusion means for alternately adding or subtracting a difference between the non-display gray level of the second group and the one of the display gray levels converted by the second conversion means, so as to display the non-display gray level of the second group with the one of the display gray levels that is close to the non-display gray level of the second group.

When the gray scale of the input video signal is the non-display gray level of the first group in this case, it is possible to display the non-display gray level of the first group with the close non-display gray level of the second group or the close display gray level by error diffusion processing. When the gray level of the input video signal is the non-display gray level of the second group, it is possible to display the non-display gray level of the second group with the close display gray level by dither diffusion processing. Thus, also when at least two non-display gray levels are continuous, at least two continuous non-display gray levels can be displayed equivalently with close display gray levels by error diffusion processing and dither diffusion processing. Also when at least two non-display gray levels are continuous, therefore, all non-display gray levels can be displayed with display gray levels.

The video signal may be a digital video signal expressed by a plurality of bits, and the display device may further comprise lower diffusion means receiving the digital video signal for diffusing between fields or between pixels data of a bit lower by one digit than a bit in the digital video signal corresponding to a minimum gray level expressed by the least significant sub-field having the minimum weight among weights representing gray levels, so as to display a gray level which is half the minimum gray level, and selection means for selecting an output of the diffusion means when the gray level of the digital video signal output from the lower diffusion means is not less than the minimum value of the non-display gray level and for selecting to display an output of the lower diffusion means when the gray level of the digital video signal output from the lower diffusion means is less than the minimum value of the non-display gray level.

In this case, the video signal is a digital video signal expressed by a plurality of bits, and the data of the bit lower by one than the bit of the digital video signal corresponding to the minimum gray level is diffused between fields or between pixels in order to display the gray level half the minimum gray level expressed by the least significant sub-field having the minimum weight weighted in correspondence to the gray level among the N sub-fields. When the gray level of the diffused digital video signal is in excess of the minimum value of the non-display gray level, the digital video signal temporally and/or spatially diffusing the difference between the non-display gray level and the display gray level is selected. Otherwise, i.e., in a case of a low gray level, the digital video signal diffusing the data of the lower bit between fields or between pixels is selected.

Thus, when the gray level is a low gray level, the gray level half the minimum gray level can be equivalently displayed, and the resolution of the low gray level can be more refined.

The video signal may be a digital video signal expressed by a plurality of bits, and the display device may further comprise lower diffusion means receiving the digital video signal for diffusing between fields or between pixels data of a bit lower by one digit than a bit in the digital video signal corresponding to a minimum gray level expressed by the least significant sub-field having the minimum weight among weights representing gray levels, so as to display a gray level which is half the minimum gray level, and selection means for selecting the digital video signal not yet diffused by the lower diffusion means when the gray level of the digital video signal output from the lower diffusion means is not less than the minimum value of the non-display gray level and for selecting an output of the lower diffusion means when the gray level of the digital video signal output from the lower diffusion means is less than the minimum value of the non-display gray level, and the diffusion means may include dither diffusion means receiving the digital video signal output from the selection means, for alternately adding or subtracting a difference between the non-display gray level and one of gray levels that is close to the non-display gray level to diffuse between fields or between pixels.

In this case, the video signal is a digital video signal expressed by a plurality of bits, and the data of the bit lower by one than the bit of the digital video signal corresponding to the minimum gray level is diffused between fields or between pixels in order to display the gray level half the gray level half the minimum gray level expressed by the least significant sub-field having the minimum weight weighted in correspondence to the gray level among the N sub-fields. When the gray level of the diffused digital video signal is in excess of the minimum value of the non-display gray level, the digital video signal before diffusion is selected. Otherwise, i.e., when the gray level is a low gray level, the digital video signal diffusing the data of the lower bit between fields or between pixels is selected, and the difference between the non-display gray level and the display gray level close to the non-display gray level among the display gray levels is alternately added or subtracted and diffused between fields or between pixels with the selected digital video signal.

Thus, the non-display gray level can be expressed with the gray level by dither diffusion processing, while the gray level half the minimum gray level can be equivalently displayed when the gray level is a low gray level, and the resolution of the low gray level can be more refined.

The video signal may be a digital video signal expressed by a plurality of bits, at least two continuous non-display gray levels may be included between the display gray levels, and the display device may further comprise lower diffusion means receiving the digital video signal for diffusing between fields or between pixels data of a bit lower by one digit than a bit in the digital video signal corresponding to a minimum gray level expressed by the least significant sub-field having the minimum weight among weights representing gray levels, so as to display a gray level which is half the minimum gray level, selection means for selecting to display an output of the lower diffusion means when the gray level of the digital video signal output from the lower diffusion means is less than the minimum value of the non-display gray level.

In this case, the video signal is a digital video signal expressed by a plurality of bits, at least two continuous non-display gray levels are included between the display gray levels, and the difference between one non-display gray level included in at least two continuous non-display gray levels and the display gray level close to the non-display gray level among the display gray levels is alternately added or subtracted and diffused between fields or between pixels. The other display gray level included in at least two continuous non-display gray levels is converted to the gray level close to the non-display gray level among the display gray levels and the gray level rendered displayable by dither diffusion processing, and the difference between the non-display gray level and the converted display gray level is diffused to the pixels around the pixel having the non-display gray level.

Further, the data of the bit lower by one than the bit of the digital video signal corresponding to the minimum gray level is diffused between fields or between pixels in order to display the gray level half the minimum gray level expressed by the least significant sub-field having the minimum weight weighted in correspondence to the gray level among the N fields. When the gray level of the diffused digital video signal is in excess of the minimum value of the non-display gray level, the digital video signal diffused by error diffusion processing is selected. Otherwise, i.e., when the gray level is a low gray level, the digital video signal diffusing the data of the lower bit between fields or between pixels is selected.

Therefore, also when at least two non-display gray levels are continuous, it is possible to diffuse one non-display gray level by dither diffusion processing and diffuse the other non-display gray level by error diffusion processing, while the gray level half the minimum gray level can be equivalently displayed when the gray level is a low gray level, and the resolution of the low gray level can be more refined.

A display method according to a further aspect of the present invention is a display method for providing a gray scale display by controlling in accordance with an input video signal individual pixels on a display panel so that each pixel emits light or does not emit light in individual N (N: natural number of not less than 1) sub-fields SC, SF2, . . . , SFN that are defined by dividing one field and arranged on a time base in a prescribed order, the N sub-fields SC, SF2, . . . , SFN are weighted to represent gray levels and the N sub-fields SC, SF2, . . . , SFN have small or equal weights in this order, and the N sub-fields SC, SF2, . . . , SFN include at least one such sub-field SFM that a difference between the weight of the sub-field SFM and the sum of the weights from the sub-field SC to the sub-field SF(M−1) exceeds the weight of the sub-field SC, whereby the gray scale of the video signal includes at least one non-display gray level non-displayable by combining the N sub-fields between displayable gray levels by combining the N sub-fields, and the display method comprises a conversion step of, when the gray scale of the input video signal is the non-display gray level, converting the gray scale of the input video signal into one of the display gray levels that is close to the non-display gray level.

In the display method, the N sub-fields are so weighted as to include at least one such sub-field SFM that the difference between the weight of the sub-field SFM and the sum of the weights from the sub-field SC to the sub-field SF(M−1) exceeds the weight of the sub-field SC. Thus, it is possible to make gray scale display finely at low luminance and roughly at high luminance, and display matching with the human visual characteristics can be implemented.

Further, the gray scale of the video signal includes at least one non-display gray level non-displayable by combination of the N sub-fields between the display gray levels displayable by combination of the N sub-fields. When the gray scale of the input video signal is a non-display gray level, the gray scale of the input video signal is converted to the display gray level close to the non-display gray level. Thus, when a gray level non-displayable by only combination of sub-fields is present, the gray level can be displayed by a close display gray level, whereby continuity of the gray scale can be ensured.

The display method may further comprise a diffusion step of diffusing temporally and/or spatially a difference between the non-display gray level and the one of the display gray levels converted in the conversion step, so as to equivalently display the non-display gray level with the one of the display gray levels.

In this case, the non-display gray level can be displayed equivalently with the display gray level by temporally and/or spatially diffusing the difference between the non-display gray level and the display gray level. Thus, it is possible to display the gray level non-displayable by only combination of the sub-fields without increasing the number of division of the sub-fields, and the total number of gray scales and the maximum gray level can be enlarged as a whole.

The diffusion step may include a dither diffusion step of alternately adding or subtracting between fields or between pixels a difference between the non-display gray level and the one of the display gray levels that is close to the non-display gray level, so as to display the non-display gray level with the one of the display gray levels.

When the input video signal is a video signal of a non-display gray level in this case, the non-display gray level can be displayed with the display gray level by temporally and/or spatially diffusing the difference between the non-display gray level and the display gray level. Thus, it is possible to equivalently display the non-display gray level not directly displayable by combination of the sub-fields with the display gray level.

The diffusion step may include an error diffusion step of diffusing a difference between the non-display gray level and the one of the display gray levels to pixels around a pixel having the non-display gray level.

When the input video signal is a video signal of a non-display gray level in this case, the non-display gray level can be displayed by error-diffusing the difference between the non-display gray level and the close display gray level to the peripheral pixels. Thus, it is possible to equivalently display the non-display gray level not directly displayable by combination of the sub-fields with the display gray level.

Therefore, display of all gray levels including display gray levels and non-display gray levels becomes possible, the maximum gray level and the total number of displayable gray scales can be sufficiently enlarged, and low gray levels can also be sufficiently finely reproduced.

Consequently, the maximum gray level and the total number of displayable gray scales can be sufficiently enlarged without increasing the number of division of the sub-fields, while reproducibility for low gray levels can be improved.

A display method according to a further aspect of the present invention is a display method for providing a gray scale display by controlling in accordance with an input video signal individual pixels on a display panel so that each pixel emits light or does not emit light in individual N (N: natural number of not less than 1) sub-fields SC, SF2, . . . , SFN that are defined by dividing one field and arranged on a time base in a prescribed order, the N sub-fields SC, SF2, . . . , SFN are weighted to represent gray levels and the N sub-fields SC, SF2, . . . , SFN have small or equal weights in this order, and the N sub-fields SC, SF2, . . . , SFN include at least one such sub-field SFM that a difference between the weight of the sub-field SFM and the sum of the weights from the sub-field SC to the sub-field SF(M−1) exceeds twice the weight of the sub-field SC, whereby the gray scale of the video signal includes at least two continuous non-display gray levels non-displayable by combining the N sub-fields between displayable gray levels by combining the N sub-fields and the at least two non-display gray levels belong to a first group or a second group respectively, and the display method comprises a first conversion step of, when the gray scale of the input video signal is a non-display gray level of the first group, converting the gray scale of the input video signal into a non-display gray level of the second group that is close to the non-display gray level of the first group or one of the display gray levels that is close to the non-display gray level of the first group; and a second conversion step of, when the gray scale of the input video signal is a non-display gray level of the second group or the non-display gray level of the second group converted in the first conversion step, converting the gray scale of the input video signal into one of the display gray levels that is close to the non-display gray level of the second group.

In the display method, the N sub-fields are so weighted that the difference between the weight of the sub-field SFM and the sum of the weights from the sub-field SC to the sub-field SF(M−1) exceeds twice the weight of the sub-field SC. Thus, it is possible to make gray scale display finely at low luminance and roughly at high luminance, and display matching with the human visual characteristics can be implemented.

Further, the gray scale of the video signal continuously includes at least two non-display gray levels non-displayable by combination of the N sub-fields between the display gray levels displayable by combination of the N sub-fields, and at least two continuous non-display gray levels belong to the first group or the second group respectively. When the gray scale of the input video signal is a non-display gray level of the first group, the gray scale of the input video signal is converted to the close non-display gray level of the second group or the close display gray level. When the gray scale of the input video signal is the non-display gray level of the second group or the converted close non-display gray level of the second group, the gray scale of the input video signal is converted to the close display gray level. Thus, when a gray level non-displayable only by combination of sub-fields is present, the gray level can be displayed with a close display gray level, whereby continuity of the gray scale can be ensured.

The display method may further comprise an error diffusion step of diffusing a difference between the non-display gray level of the first group and the non-display gray level of the second group or the one of the display gray levels converted in the first conversion step to pixels around a pixel having the non-display gray level of the first group and, a dither diffusion step of alternately adding or subtracting a difference between the non-display gray level of the second group and the one of the display gray levels converted in the second conversion step, so as to display the non-display gray level of the second group with the one of the display gray levels that is close to the non-display gray level of the second group.

When the gray scale of the input video signal is a non-display gray level of the first group in this case, the non-display gray level of the first group can be displayed with the close non-display gray level of the second group or the close display gray level by error diffusion processing. When the gray level of the input video signal is a non-display gray level of the second group, the non-display gray level of the second group can be displayed with the close display gray level by dither diffusion processing. Thus, also when at least two non-display gray levels are continuous, it is possible to equivalently display at least two continuous non-display gray levels with a close display gray level by error diffusion processing and dither diffusion processing. Also when at least two non-display gray levels are continuous, therefore, all non-display gray levels can be displayed with display gray levels.

The video signal may be a digital video signal expressed by a plurality of bits, and the display method may further comprise a lower diffusion step of receiving the digital video signal for diffusing between fields or between pixels data of a bit lower by one digit than a bit in the digital video signal corresponding to a minimum gray level expressed by the least significant sub-field having the minimum weight among weights representing gray levels, so as to display a gray level which is half the minimum gray level, and a selection step of selecting an output of the diffusion step when the gray level of the digital video signal output from the lower diffusion step is not less than the minimum value of the non-display gray level or selecting to display an output of the lower diffusion step when the gray level of the digital video signal output from the lower diffusion step is less than the minimum value of the non-display gray level.

In this case, the video signal is a digital video signal expressed by a plurality of bits, and the data of the bit lower by one than the bit of the digital video signal corresponding to the minimum gray level is diffused between fields or between pixels in order to display the gray level half the minimum gray level expressed by the least significant bit having the minimum weight weighted in correspondence to the gray level among the N sub-fields. When the gray level of the diffused digital video signal is in excess of the minimum value of the non-display gray level, the digital video signal obtained by temporally and/or spatially diffusing the difference between the non-display gray level and the display gray level is selected. Otherwise, i.e., in a case of a low gray level, the digital video signal obtained by diffusing the data of the lower bit between fields or between pixels is selected.

Thus, when the gray level is a low gray level, the gray level half the minimum gray level can be equivalently displayed, and the resolution of the low gray level can be more refined.

The video signal may be a digital video signal expressed by a plurality of bits, and the display method may further comprise a lower diffusion step of receiving the digital video signal for diffusing between fields or between pixels data of a bit lower by one digit than a bit in the digital video signal corresponding to a minimum gray level expressed by the least significant sub-field having the minimum weight among weights representing gray levels, so as to display a gray level which is half the minimum gray level, and a selection step of selecting the digital video signal not yet diffused in the lower diffusion step when the gray level of the digital video signal output from the lower diffusion step is not less than the minimum value of the non-display gray level or selecting an output of the lower diffusion step when the gray level of the digital video signal output from the lower diffusion step is less than the minimum value of the non-display gray level, and the diffusion step may include a dither diffusion step of receiving the digital video signal output from the selection step, for alternately adding or subtracting a difference between the non-display gray level and one of gray levels that is close to the non-display gray level to diffuse between fields or between pixels.

In this case, the video signal is a digital video signal expressed by a plurality of bits, and the data of the bit lower by one than the bit of the digital video signal corresponding to the minimum gray level is diffused between fields or between pixels in order to display the gray level half the gray level half the minimum gray level expressed by the least significant bit having the minimum weight weighted in correspondence to the gray level among the N sub-fields. When the gray level of the diffused digital video signal is in excess of the minimum value of the non-display gray level, the digital video signal before diffusion is selected. Otherwise, i.e., when the gray level is a low gray level, the digital video signal obtained by diffusing the data of the lower bit between fields or between pixels is selected, and the difference between the non-display gray level and the display gray level close to the non-display gray level among the display gray levels is alternately added or subtracted and diffused between fields or between pixels with the selected digital video signal.

Thus, the non-display gray level can be expressed with the display gray level by dither diffusion processing while the gray level half the minimum gray level can be equivalently displayed when the gray level is a low gray level, and the resolution of the low gray level can be more refined.

The video signal may be a digital video signal expressed by a plurality of bits, at least two continuous non-display gray levels may be included between the display gray levels, and the display method may further comprise, a lower diffusion steps of receiving the digital video signal for diffusing between fields or between pixels data of a bit lower by one digit than a bit in the digital video signal corresponding to a minimum gray level expressed by the least significant sub-field having the minimum weight among weights representing gray levels, so as to display a gray level which is half the minimum gray level, and a selection step of selecting to display an output of the lower diffusion step when the gray level of the digital video signal output from the lower diffusion step is less than the minimum value of the non-display gray level.

In this case, the video signal is a digital video signal expressed by a plurality of bits, at least two continuous non-display gray levels are included between the display gray levels, and the difference between one non-display gray level included in at least two continuous non-display gray levels and the display gray level close to the non-display gray level among the display gray levels is alternately added or subtracted and diffused between fields or between pixels. The other display gray level included in at least two continuous non-display gray levels is converted to the gray level close to the non-display gray level among the display gray levels and the gray level rendered displayable by dither diffusion processing, and the difference between the non-display gray level and the converted display gray level is diffused to the pixels around the pixel having the non-display gray level.

Further, the data of the bit lower by one than the bit of the digital video signal corresponding to the minimum gray level is diffused between fields or between pixels in order to display the gray level half the minimum gray level expressed by the least significant sub-field having the minimum weight weighted in correspondence to the gray level among the N sub-fields. When the gray level of the diffused digital video signal is in excess of the minimum value of the non-display gray level, the digital video signal diffused by error diffusion processing is selected. Otherwise, i.e., when the gray level is a low gray level, the digital video signal diffusing the data of the lower bit between fields or between pixels is selected.

Also when at least two non-display gray levels are continuous, therefore, it is possible to diffuse one non-display gray level by dither diffusion processing and diffuse the other non-display gray level by error diffusion processing, while the gray level half the minimum gray level can be equivalently displayed when the gray level is a low gray level, and the resolution of the low gray level can be more refined.

BRIEF DESCRIPTION OF THE DRAWINGS

FIG. 4 is a first diagram showing exemplary gray scale display by a first sub-field pattern employed for the plasma display device shown in FIG. 1

FIG. 5 is a second diagram showing exemplary gray scale display by the first sub-field pattern employed for the plasma display device shown in FIG. 1

FIG. 6 is a third diagram showing exemplary gray scale display by the first sub-field pattern employed for the plasma display device shown in FIG. 1

FIG. 7 is a fourth diagram showing exemplary gray scale display by the first sub-field pattern employed for the plasma display device shown in FIG. 1

FIG. 8 is a fifth diagram showing exemplary gray scale display by the first sub-field pattern employed for the plasma display device shown in FIG. 1

FIG. 12 is a first diagram showing exemplary gray scale display by a second sub-field pattern employed for the plasma display device according to the third embodiment of the present invention FIG. 13 is a second diagram showing exemplary gray scale display by the second sub-field pattern employed for the plasma display device according to the third embodiment of the present invention FIG. 14 is a third diagram showing exemplary gray scale display by the second sub-field pattern employed for the plasma display device according to the third embodiment of the present invention FIG. 15 is a fourth diagram showing exemplary gray scale display by the second sub-field pattern employed for the plasma display device according to the third embodiment of the present invention FIG. 16 is a fifth diagram showing exemplary gray scale display by the second sub-field pattern employed for the plasma display device according to the third embodiment of the present invention FIG. 17 is a first diagram showing exemplary gray scale display by a third sub-field pattern employed for the plasma display device according to the present invention FIG. 18 is a second diagram showing exemplary gray scale display by the third sub-field pattern employed for the plasma display device according to the present invention FIG. 19 is a third diagram showing exemplary gray scale display by the third sub-field pattern employed for the plasma display device according to the present invention FIG. 20 is a fourth diagram showing exemplary gray scale display by the third sub-field pattern employed for the plasma display device according to the present invention FIG. 21 is a fifth diagram showing exemplary gray scale display by the third sub-field pattern employed for the plasma display device according to the present invention FIG. 22 is a first diagram showing exemplary gray scale display by a fourth sub-field pattern employed for the plasma display device according to the present invention FIG. 23 is a second diagram showing exemplary gray scale display by the fourth sub-field pattern employed for the plasma display device according to the present invention FIG. 24 is a third diagram showing exemplary gray scale display by the fourth sub-field pattern employed for the plasma display device according to the present invention FIG. 25 is a fourth diagram showing exemplary gray scale display by the fourth sub-field pattern employed for the plasma display device according to the present invention FIG. 26 is a fifth diagram showing exemplary gray scale display by the fourth sub-field pattern employed for the plasma display device according to the present invention

BEST MODES FOR CARRYING OUT THE INVENTION

An AC plasma display device is now described as an exemplary display device according to the present invention. While a case where a video signal corresponds to luminance, i.e., a gray level as such is described in the following description, a similar effect can be attained by performing processing every color similarly to the following also in a case of performing color display.

Figure 1:
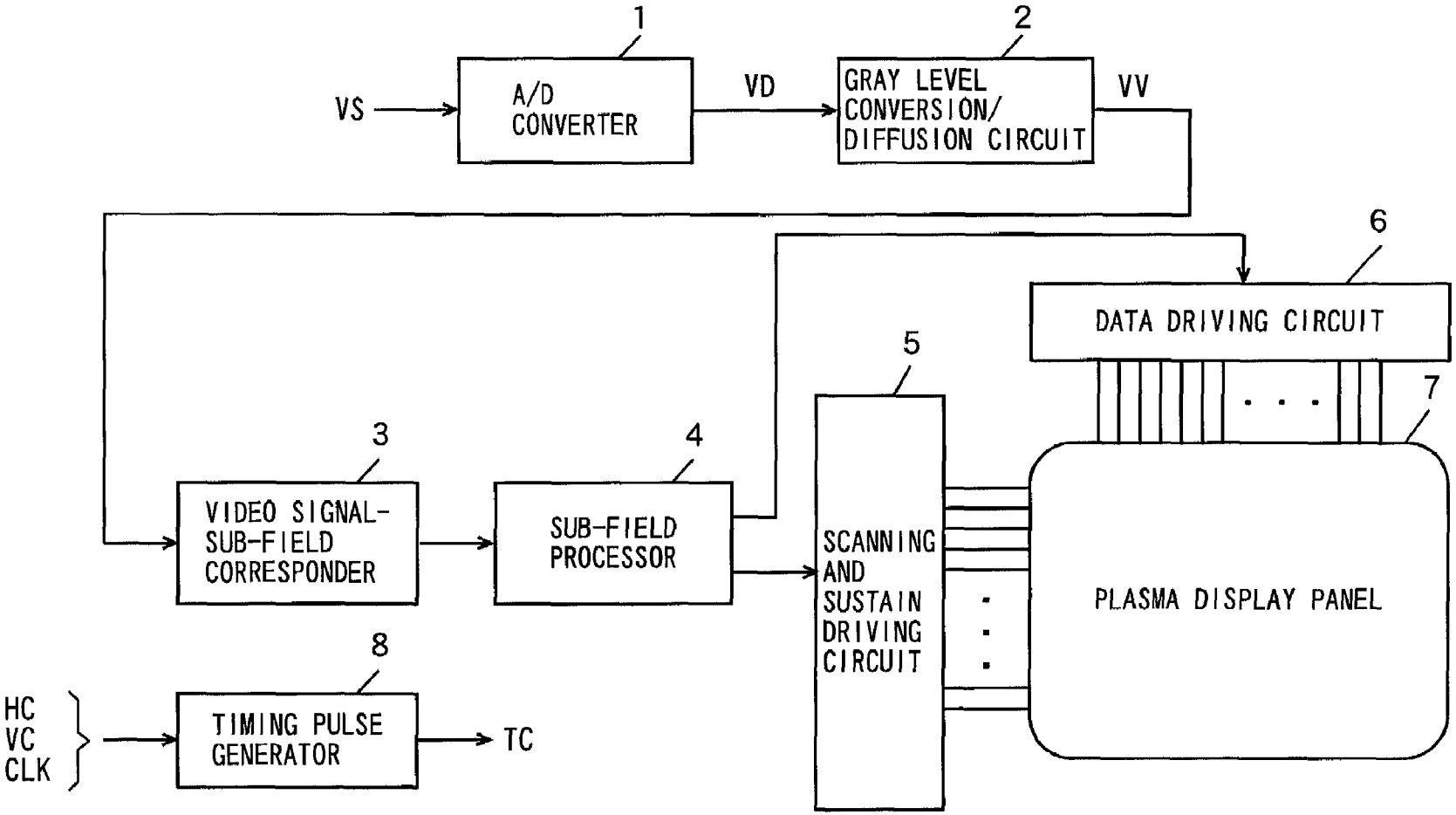
FIG. 1 is a block diagram showing the structure of a plasma display device according to a first embodiment of the present invention

FIG. 1 is a block diagram showing the structure of a plasma display device according to a first embodiment of the present invention.

The plasma display device shown in FIG. 1 includes an A/D (analog-to-digital) converter 1, a gray level conversion/diffusion circuit 2, a video signal-sub-field corresponder 3, a sub-field processor 4, a scanning and sustain driving circuit 5, a data driving circuit 6, a plasma display panel 7 and a timing pulse generator 8.

A video signal VS is input in the A/D converter 1. The A/D converter 1 converts the analog video signal VS to digital image data VD, and outputs the same to the gray level conversion/diffusion circuit 2.

The timing pulse generator 8 generates a prescribed timing signal TC on the basis of a horizontal synchronizing signal HC and a vertical synchronizing signal VC of the video signal VS and a prescribed CLK etc. and supplies the same to each part in the device at need.

The gray level conversion/diffusion circuit 2 converts the gray level of the input image data VD to a display gray level displayable by combination of a plurality of sub-fields when the same is a non-display gray level non-displayable by combination of a plurality of sub-fields, while spatially diffusing the difference between the non-display gray level and the display gray level and outputting converted image data VV to the video signal-sub-field corresponder 3.

The video signal-sub-field corresponder 3 prepares image data of each sub-field from image data of one field and outputs the same to the sub-field processor 4, in order to divide one field into a plurality of sub-fields and display the same.

The sub-field processor 4 decides the number of sustain pulses in a sustain period etc. from image data every sub-field etc. and outputs a data driver driving control signal to the data driving circuit 6 while outputting a scan driver driving control signal and a sustain driver driving control signal to the scanning and sustain driving circuit 5.

The plasma display panel 7 includes a plurality of address electrodes (data electrodes), a plurality of scan electrodes (scanning electrodes) and a plurality of sustain electrodes (sustain electrodes). The plurality of address electrodes are arranged in a vertical direction of a screen, while the plurality of scan electrodes and the plurality of sustain electrodes are arranged in a horizontal direction of the screen. The plurality o sustain electrodes are connected in common. Discharge cells are formed on the respective intersections of the address electrodes, the scan electrodes and the sustain electrodes, and each discharge cell forms a pixel on the screen.

The data driving circuit 6 is connected to the plurality of address electrodes of the plasma display panel 7. The scanning and sustain driving circuit 5 is connected to the plurality of scanning electrodes and sustain electrodes of the plasma display panel 7.

According to the data driver driving control signal, the data driving circuit 6 applies a write pulse to a corresponding address electrode of the plasma display panel 7 in response to the image data in a write period.

According to the scan driver driving control signal, the scanning and sustain driving circuit 5 successively applies the write pulse to the plurality of scan electrodes while shifting a shift pulse in a vertical scanning direction in the write period. Thus, address discharge is performed in a corresponding discharge cell. Further, the scanning and sustain driving circuit 5 applies a periodic sustain pulse to the plurality of scan electrodes of the plasma display panel 7 in a sustain period according to the scan driver driving control signal, while simultaneously applying a sustain pulse 180° out of phase from the sustain pulse for the scan electrodes to the plurality of sustain electrodes according to the sustain driver driving control signal. Thus, sustain discharge is performed in the corresponding discharge cell, and each pixel is made to emit light or emit no light every sub-field.

In the plasma display device shown in FIG. 1, as hereinabove described, an ADS (Address Display-Period Separation: address-display period separation) system is employed as a gray scale display driving system. The ADS system temporally divides one field into a plurality of sub-fields, each sub-field is separated into a setup period, a write period, a sustain period etc., setup processing of each sub-field is performed in the setup period, address discharge for selecting a lit discharge cell is performed in the write period, and sustain discharge for display is performed in the sustain period.

Figure 2:
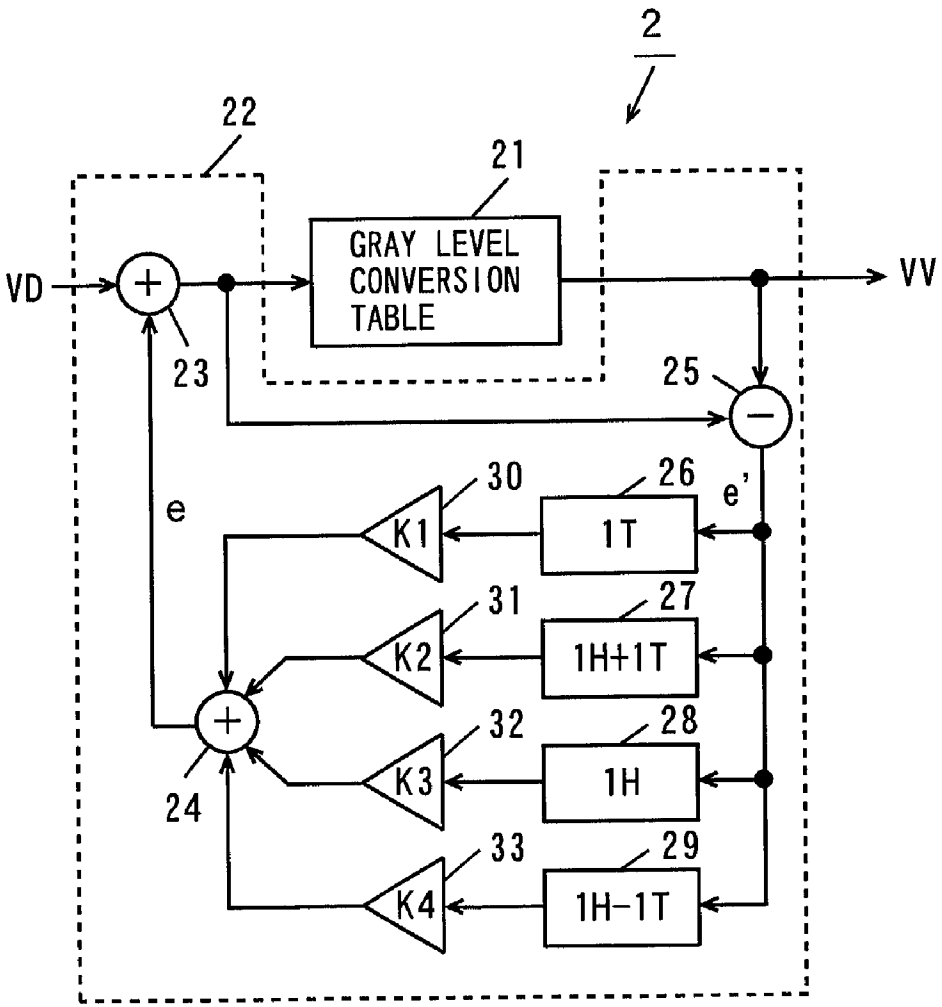
FIG. 2 is a block diagram showing the structure of a gray level conversion/diffusion circuit shown in FIG. 1

The gray level conversion/diffusion circuit 2 shown in FIG. 1 is now described in detail. FIG. 2 is a block diagram showing the structure of the gray level conversion/diffusion circuit 2 shown in FIG. 1.

The gray level conversion/diffusion circuit 2 shown in FIG. 2 includes a gray level conversion table 21 and an error diffusion circuit 22.

The gray level conversion table 21 outputs a display gray level displayable by combination of a plurality of sub-fields as such among gray levels of input image data, while converting a non-display gray level non-displayable by combination of a plurality of sub-fields to a display gray level close to the non-display gray level and outputting the same.

That is, the gray level conversion table 21 includes a table storing information related to display gray levels and non-display gray levels, and converts input gray levels to display gray levels responsive to the gray levels. More specifically, the contents of the display gray levels and the non-display gray levels are described in the gray level conversion table 21 as shown in FIG. 4 to FIG. 8 described later, for example, while an input gray level is output as such when the same is 1 and the input gray level is converted to 1 which is the most approximate gray level in the vicinity and output when the same is 2 in the example shown in FIG. 4.

Then, the error diffusion circuit 2 is described in detail. The error diffusion circuit 22 includes adders 23 and 24, a subtracter 25, delay elements 26 to 29 and multipliers 30 to 33.

The adder 23 adds the input image data VD and an output of the adder 24 with each other, and outputs the result to the gray level conversion table 21 and the subtracter 25. The subtracter 25 subtracts an output of the gray level conversion table 21 from the output of the adder 23, and outputs the result to the delay elements 26 to 29.

The delay element 26 delays the input by one pixel (1T) and outputs the same to the multiplier 30. The delay element 27 delays the input by one line and one pixel (1H+1T) and outputs the same to the multiplier 31. The delay element 28 delays the input by one line (1H)) and outputs the same to the multiplier 32. The delay element 29 delays it by a period before one pixel from one line (1H−1T) and outputs the same to the multiplier 33.

The multiplier 30 multiplies the input by a prescribed coefficient K1 and outputs the result to the adder 24. The multiplier 31 multiplies the input by a prescribed coefficient K2 and outputs the result to the adder 24. The multiplier 32 multiplies the input by a prescribed coefficient K3 and outputs the result to the adder 24. The multiplier 33 multiplies the input by a prescribed coefficient K4 and outputs the result to the adder 24. At this point, the respective coefficients K1, K2, K3 and K4 are set to proper values satisfying the relation K1+K2+K3+K4=1, and 7/16, 1/16, 5/16 and 3/16 are employed as the coefficients K1 to K4, for example. The adder 24 adds up the outputs of the respective multipliers 30 to 33 and outputs the result to the adder 23.

When a gray level is converted in the gray level conversion table 21, the converted gray level is subtracted from the original gray level of the image data VD by the subtracter 25 and level difference e' is obtained due to the aforementioned structure. This level difference e' is delayed by prescribed times by the respective delay elements 26 to 29, multiplied by the prescribed coefficients k1 to K4 by the multipliers 30 to 33, thereafter added by the adder 24, and finally output as a diffusion error e.

Figure 3:
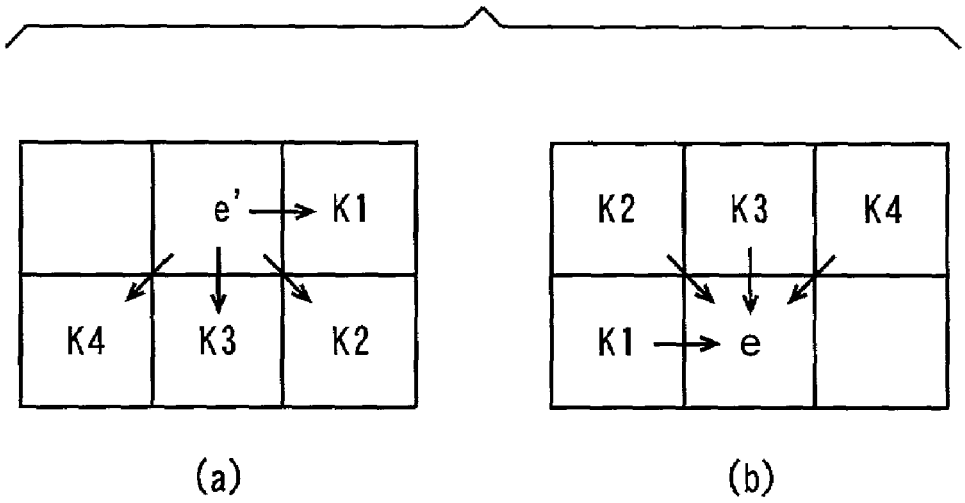
FIG. 3 is a model diagram for illustrating diffusion and accumulation of errors by error diffusion processing

That is, in the error diffusion circuit 22, the level difference e' between the original gray level of the image data VD and the gray level after conversion by the gray level conversion table 21 is diffused from a processed pixel (pixel of e') to peripheral pixels (pixels of K1 to K4) as shown at (a) in FIG. 3, error diffusion processing of spatially diffusing the level difference e' between the gray level essential to the processed pixel and the gray level after converted by the gray level conversion table 21 is performed, and the converted image data VV is output. The diffusion error e for a certain pixel is obtained by totalizing errors diffused from the pixels (the pixels of k1 to K4) around the pixel (the pixel of e) as shown at (b) in FIG. 3.

Gray levels to be displayed are preserved in the overall screen by performing the aforementioned error diffusion processing on the overall screen, and it seems to human eyes as if the same is displayed in essential luminance of the pixels, i.e., gray levels before conversion when observing the overall screen. Thus, an image of high picture quality having no roughness of the image can be expressed.

Thus, the gray level conversion/diffusion circuit 2 converts the non-display gray level to the display gray level close to the non-display gray level among display gray levels, and diffuses the difference between the non-display gray level and the display gray level to the pixels around the pixel having the non-display gray level. Therefore, the difference between the non-display gray level and the display gray level can be spatially diffused, and the non-display gray level can be equivalently displayed with the display gray level.

In this embodiment, the gray level conversion/diffusion circuit 2 corresponds to the diffusion means, the video signal-sub-field corresponder 3 corresponds to the sub-field correspondence means, and the sub-field processor 4, the scanning and sustain driving circuit 5 and the data driving circuit 6 correspond to the emission means. The gray level conversion table 21 corresponds to the gray level conversion means, and the error diffusion circuit 22 corresponds to the error diffusion means.

Specific examples of sub-fields employed in this embodiment are now described in detail. FIG. 4 to FIG. 8 are diagrams showing gray scale display examples by a first sub-field pattern employed for the plasma display device shown in FIG. 1. In each of the following drawings, "○" in each sub-field column in each gray level shows a sub-field in an emission state, a blank column shows a sub-field in a none-mission state, that having "○" in the column of display available/unavailable is a display gray level, and that having "x" in the column of display available/unavailable is a non-display gray level.

As shown in FIG. 4 to FIG. 8, the first sub-field pattern is formed by 10 sub-fields SC to SF10, the weights of the respective sub-fields SC to SF10 are 1, 3, 6, 12, 19, 26, 34, 42, 51 and 61, and the weight of each sub-field corresponds to the quantity of emission (luminance) at the time when this sub-field emits light. The weight of each sub-field can naturally be considered as the number of emission pulses assigned to each sub-field, as a matter of course.

The first sub-field pattern shown in FIG. 4 to FIG. 8 is in a structure including, assuming that the sub-fields are SC, SF2, . . . , SFM, . . . , SFN successively from a sub-field having a small or equal weight, at least one such sub-field SFM that the difference between the weight of the sub-field SFM and the sum of the weights from the sub-field SC to the sub-field SF(M−1) exceeds the weight of the sub-field SC. Assuming that M=2, for example, the weight of the sub-field SF2 is 3, and the sum of the weights up to the sub-field SC is 1. The difference between the weight of the sub-field SC and the weight of the sub-field S2 is 2, which is greater than the weight 1 of the sub-field SC.

Further, assuming that M=3, for example, the sum of the weights from the sub-field SC to the sub-field SF2 is 4, and the weight of the sub-field SF3 is 6. The difference between the sum of the weights from the sub-field SC to the sub-field SF2 and the weight of the sub-field SF3 is 2, which is greater than the weight 1 of the sub-field SC.

In addition, assuming that M=4, for example, the sum of the weights from the sub-field SC to the sub-field SF3 is 10, and the weight of the sub-field SF4 is 12. The difference between the sum of the weights from the sub-field SC to the sub-field SF3 and the weight of the sub-field SF4 is 2, which is greater than the weight 1 of the sub-field SC.

In this case, at least two or more display gray levels are continuous, only one non-display gray level is included between the display gray levels, and non-display gray levels properly disperse between the display gray levels. Therefore, the maximum gray level becomes 255, and it is possible to sufficiently enlarge the maximum gray level without much increasing the number of the sub-fields.

While non-display gray levels such as 2 and 5 cannot be displayed when employing combination of the respective sub-fields SC to SF10 as such, error diffusion processing is performed by the gray level conversion/diffusion circuit 2 by converting the respective non-display gray levels to the display gray levels shown in the columns of converted values of FIG. 4 to FIG. 8 and regarding the values shown in the columns of errors as the difference between the non-display gray levels and the display gray levels. Referring to FIG. 4, the gray level 2 is converted to the gray level 1 by the gray level conversion table 21, and the error 1 is diffused by the error diffusion circuit 22, for example.

Thus, all non-display gray levels can be equivalently displayed with display gray levels. Therefore, the total number of gray scales reaches 256 gray scales, the total number of gray scales can also be sufficiently enlarged, and the maximum luminance can also be sufficiently enlarged. In a case of displaying a dynamic image, gray levels readily causing dynamic image pseudo-contours may not be employed.

In this embodiment, according to the aforementioned structure, the respective sub-fields of the first sub-field pattern are so weighted that one non-display gray level non-displayable by combination thereof is arranged between display gray levels displayable by combination thereof, non-display gray levels are properly dispersed in display gray levels, and the total number of gray scales and the maximum gray level can be enlarged as a whole without increasing the number of division of the sub-fields although gray levels non-displayable by only combination of the sub-fields are present.

Further, the difference between the non-display gray level and the display gray level is spatially diffused by the gray level conversion/diffusion circuit 2 when the video signal is a video signal of the non-display gray level, the video signal of one field after diffusion is converted into a video signal every sub-field by the video signal-sub-field corresponder 3 so that each discharge cell of the plasma display panel 7 emit light or emit no light every sub-field by the sub-field processor 4, the scanning and sustain driving circuit 5 and the data driving circuit 6 in response to the video signal every sub-field, whereby non-display gray levels not directly expressible by combination of sub-fields can be equivalently displayed with the display gray level.

Therefore, display of all gray levels inclusive of gray levels and non-display gray levels becomes possible, the maximum gray level and the total number of displayable gray scales can be sufficiently increased, and low gray levels can also be sufficiently finely reproduced. Consequently, the maximum gray level and the total number of displayable gray scales can be sufficiently enlarged while reproducibility for low gray levels can be improved without increasing the number of division of sub-fields.

A plasma display device according to a second embodiment of the present invention is now described. The point different between the plasma display device according to the second embodiment and the plasma display device shown in FIG. 1 is the point that the gray level conversion/diffusion circuit 2 is changed to a dither circuit 2*a* performing dither diffusion processing while the remaining points are similar to those of the plasma display device shown in FIG. 1, and hence only the dither circuit 2*a* is now described in detail.

Figure 9:
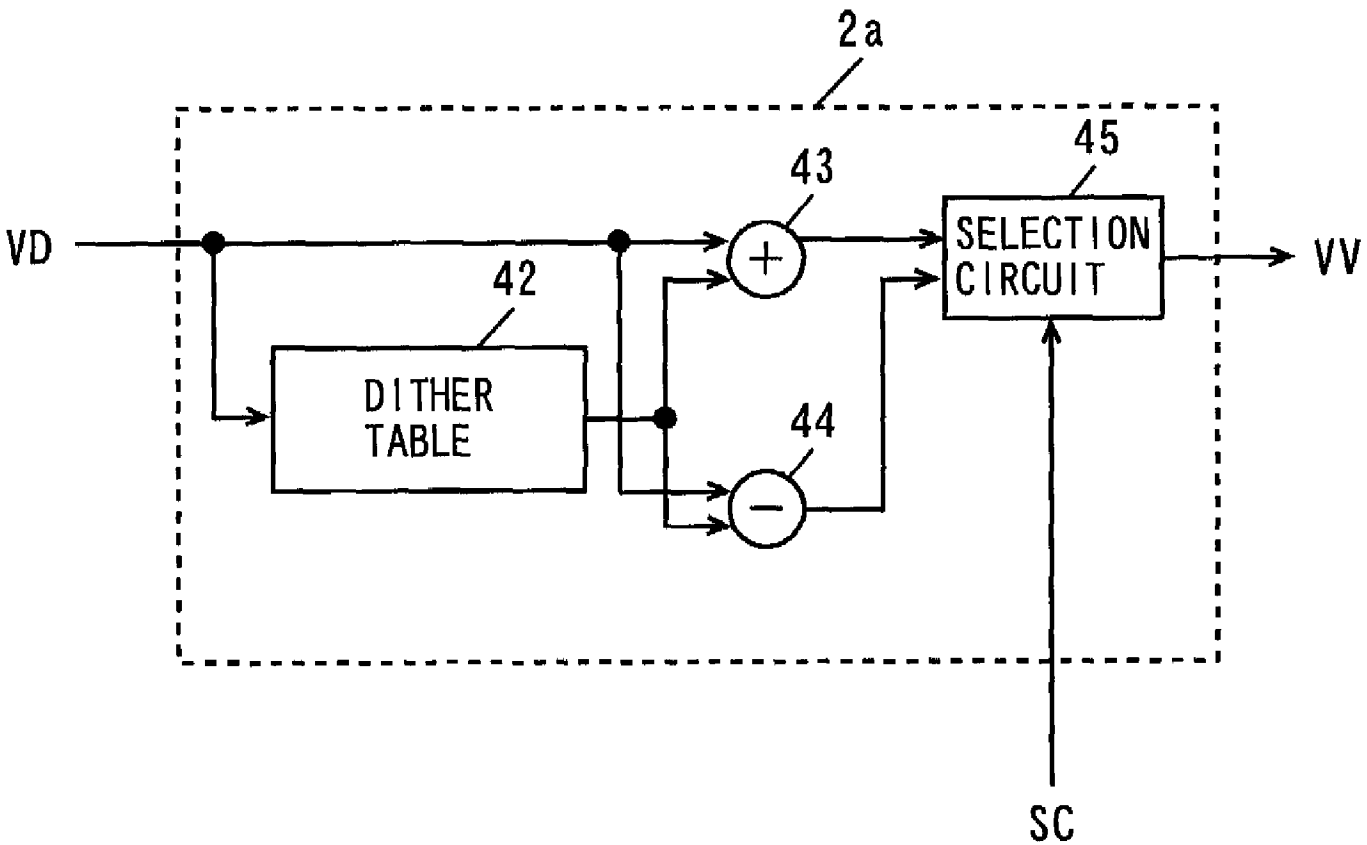
FIG. 9 is a block diagram showing the structure of a dither circuit employed for a plasma display device according to a second embodiment of the present invention

FIG. 9 is a block diagram showing the structure of the dither circuit employed for the plasma display device according to the second embodiment of the present invention.

The dither circuit 2*a* shown in FIG. 9 includes a dither table 42, an adder 43, a subtracter 44 and a selection circuit 45.

Image data VD is input in the dither table 42, the adder 43 and the subtracter 44. Also in the plasma display device according to the second embodiment, the first sub-field pattern shown in FIG. 4 to FIG. 8 is employed, for example, and the dither table 42 stores information associating the non-display gray levels shown by "x" in the columns of display available/unavailable in FIG. 4 to FIG. 8 with the dithers described in the columns of dithers as a table.

That is, the dither table 42 outputs the dither used for the dither diffusion processing to the adder 43 and the subtracter 44 when the gray level of the input image data VD is a non-display gray level subjected to the dither diffusion processing, and outputs zero as the dither when the gray level of the input image data VD is not the gray level subjected to the dither diffusion processing, i.e., a display gray level. In the example shown in FIG. 4, for example, the dither table 2 outputs 1 as the dither when the gray level is 2.

The adder 43 receives the image data VD and the output of the dither table 42, adds the same and outputs the result to the selection circuit 45. The subtracter 44 receives the image data VD and the output of the dither table 42, and outputs a value obtained by subtracting the output of the dither table 42 from the image data VD to the selection circuit 45. The selection circuit 45, in which a selection signal SC prepared by a timing pulse generator 8 is input, alternates the output of the adder 43 and the output of the subtracter 44 at prescribed timing and outputs image data VV after conversion.

According to the aforementioned structure, the dither circuit 2*a* performs, when the gray level of the image data VD is a non-display gray level subjected to dither diffusion processing, dither diffusion processing for making expression with a display gray level obtained by performing diffusion by a dither set for the non-display gray level. More specifically, the dither circuit 2*a* generates, when the gray level of the input image data VD is a non-display gray level, image data for alternating display gray levels horizontally separating from the gray level by the dither in an even field and an odd field of one field and displaying the same.

Figure 10:
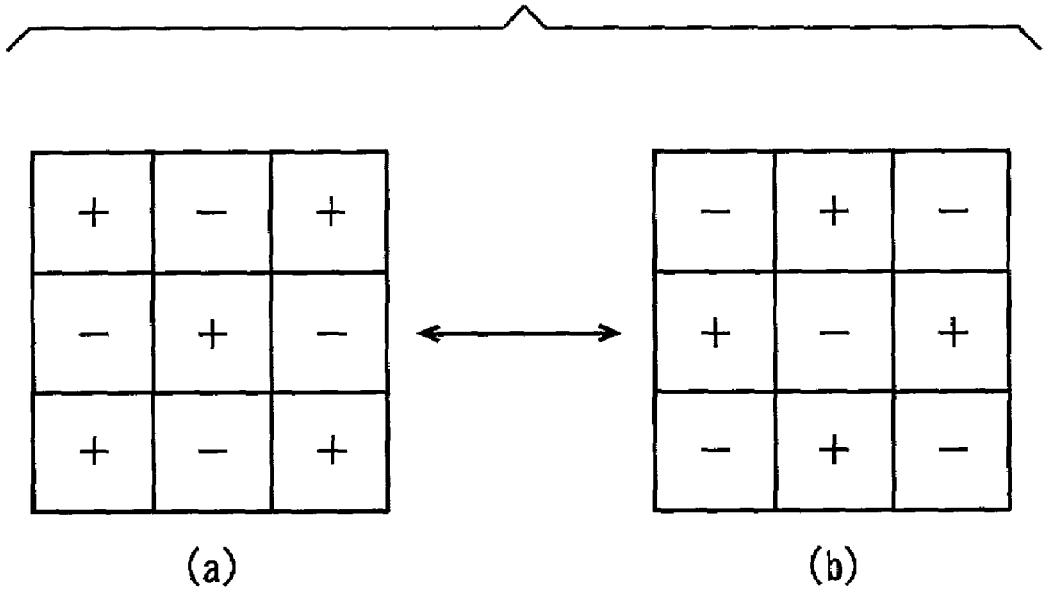
FIG. 10 is a model diagram for illustrating diffusion of dithers of dither diffusion processing in an even field and an odd field

In the aforementioned dither diffusion processing, diffusion of the dither is performed so that the total is zero between an even field and an odd field as shown in FIG. 10, for example, and changes the gray level every pixel as to addition and subtraction of the dither (diffusion quantity) on a screen. That is, addition/subtraction of dithers is reversed between vertically and horizontally adjacent pixels in the even field or the odd field, and addition/subtraction of the dither on the same pixel position is reversed in the even field and the odd field. In the example shown in FIG. 10, the case shown at (a) in FIG. 10 is the even field and the case shown at (b) in FIG. 10 is the odd field, for example.

Thus, display gray levels are temporally averaged and an intermediate non-display gray level can be expressed on the screen. In the example shown in FIG. 4, for example, the gray level 1 (2−1) in one of the even and odd fields is displayed when the gray level is 2 and the dither is 1 while da gray level 3 (2+1) in the other one.

Level difference can be temporally diffused every pixel without deteriorating resolution by employing the aforementioned dither diffusion processing and temporally diffusing the difference between the gray level essential to the image data and the display gray level used for display in practice as the dither.

Diffusion of the dither in the dither diffusion processing is not particularly restricted to the aforementioned example but addition/subtraction may be performed every line or addition/subtraction may be performed every prescribed area. The dither diffusion processing may not only perform temporal diffusion as described above but may also diffuse dithers between pixels with a prescribed dither pattern for spatially performing diffusion similarly to error diffusion processing.

In this embodiment, the dither circuit 2*a* corresponds to the diffusion means and the dither diffusion means, a video signal-sub-field corresponder 3 corresponds to the sub-field correspondence means, and a sub-field processor 4, a scanning and sustain driving circuit 5 and a data driving circuit 6 correspond to the emission means.

As hereinabove described, this embodiment alternately adds or subtracts and diffuses the difference between the non-display gray level and the display gray level close to the non-display gray level among the display gray levels between fields by the dither circuit 2*a*. Therefore, the difference between the non-display gray level and the display gray level can be temporally diffused by the dither diffusion processing. Consequently, it is possible to display the non-display gray level with the non-display gray level, and an effect similar to that of the first embodiment can be attained also in this embodiment.

A plasma display device according to a third embodiment of the present invention is now described. The point different between the plasma display device according to the third embodiment and the plasma display device shown in FIG. 1 is the point that the gray level conversion/diffusion circuit 2 is changed to a gray level conversion/diffusion circuit 2*b* performing error diffusion processing and dither diffusion processing, while the remaining points are similar to those of the plasma display device shown in FIG. 1 and hence only the gray level conversion/diffusion circuit 2*b* is now described in detail.

Figure 11:
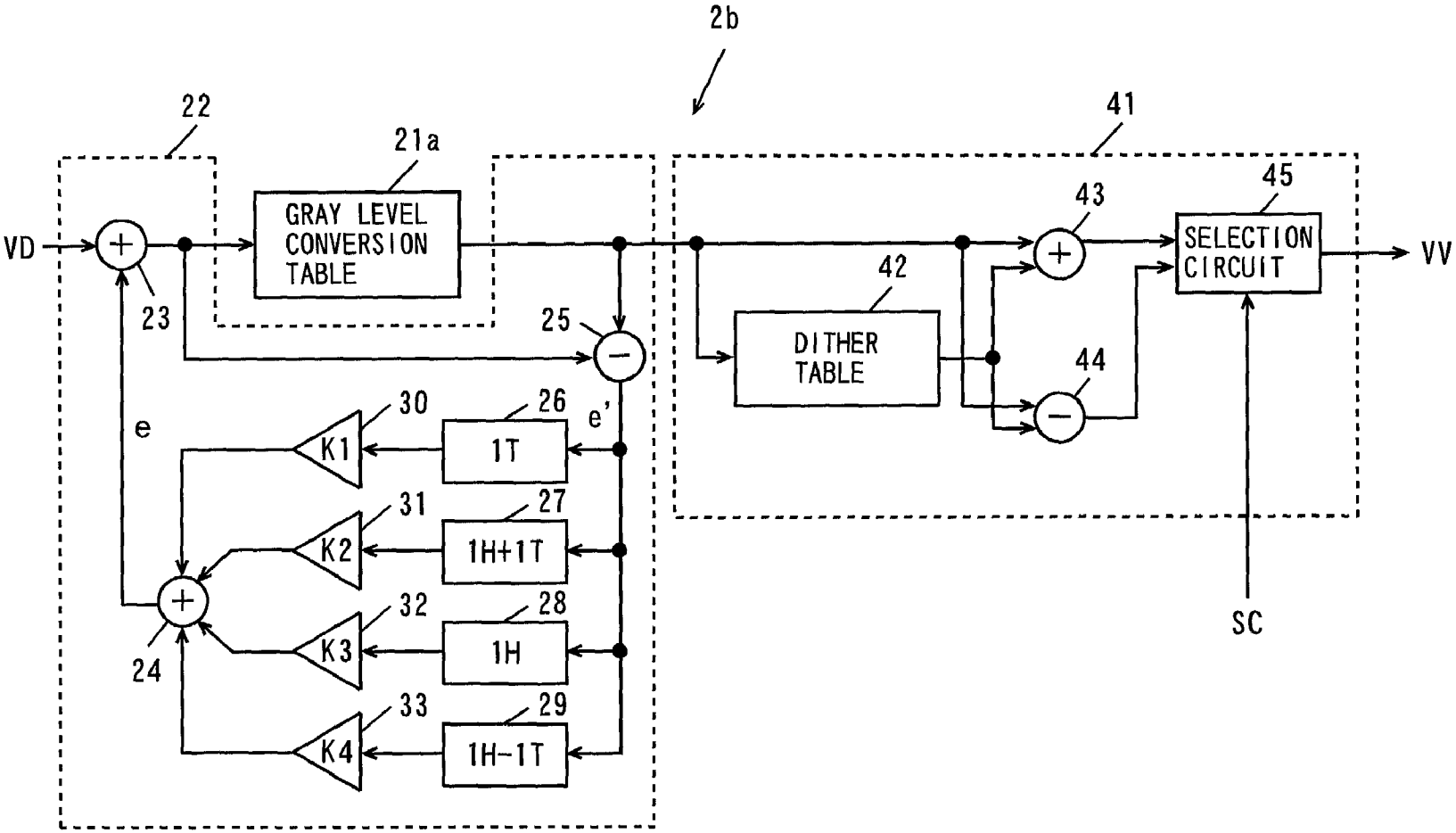
FIG. 11 is a block diagram showing the structure of a gray level conversion/diffusion circuit employed for a plasma display device according to a third embodiment of the present invention

FIG. 11 is a block diagram showing the structure of the gray level conversion/diffusion circuit employed for the plasma display device according to the third embodiment of the present invention.

The gray level conversion/diffusion circuit 2*b* shown in FIG. 11 includes a gray level conversion table 21*a*, an error diffusion circuit 22 and a dither circuit 41.

The gray level conversion table 21*a* shown in FIG. 11 outputs, among gray levels of input image data, a display gray level displayable by combination of a plurality of sub-fields and a dither gray level displayed by dither diffusion processing of the dither circuit 41 as such while converting an error diffusion gray level displayed by error diffusion processing of the error diffusion circuit 22 to a display gray level or a dither gray level and outputting the same.

That is, the gray level conversion table 21*a* includes a table storing information related to display gray levels and non-display gray levels, and converts an input gray level to a displayable gray level in response to the gray level. In this embodiment, a second sub-field pattern shown in FIG. 12 to FIG. 16 described later is employed, for example, and the contents of display gray levels shown by "○" in columns of display available/unavailable, non-display gray levels shown by "x" in the columns of display available/unavailable, such error diffusion gray levels that values different from essential gray levels are described in columns of converted values and such dither gray levels that dithers are described in columns of dithers are described in the gray level conversion table 21*a* as shown in the figures.

In the example shown in FIG. 12, the input gray level is output as such when the same is 1 (display gray level) and when the same is 2 (dither gray level), and the input gray level is converted to 11 (dither gray level) which is the most approximate displayable gray level in the vicinity when the same is 12 (error diffusion gray level).

The error diffusion circuit 22 shown in FIG. 11 is structured similarly to the error diffusion circuit 22 shown in FIG. 2, operates similarly, performs error diffusion processing of spatially diffusing the difference between an essential gray level of image data VD and a gray level after conversion by the gray level conversion table 21*a*, and outputs pixel data after processing to the dither circuit 41.

The dither circuit 41 shown in FIG. 11 is structured similarly to the dither circuit 2*a* shown in FIG. 9, similarly operates, and performs, when a gray level output from the gray level conversion table 21 is a dither gray level subjected to dither diffusion processing among non-display gray levels, dither diffusion processing for expressing the same with a display gray level obtained by performing diffusion by a dither set for the dither gray level.

In this embodiment, the gray level conversion/diffusion circuit 2*b* corresponds to the diffusion means, a video signal-sub-field corresponder 3 corresponds to the sub-field correspondence means, and a sub-field processor 4, a scanning and sustain driving circuit 5 and a data driving circuit 6 correspond to the emission means. The dither circuit 41 corresponds to the dither diffusion means, the gray level conversion table 21*a* corresponds to the gray level conversion means, and the error diffusion circuit 22 corresponds to the error diffusion means.

Specific examples of sub-fields employed in this embodiment are now described in detail. FIG. 12 to FIG. 16 are diagrams showing gray scale display examples by the second sub-field pattern employed for the plasma display device according to the third embodiment.

As shown in FIG. 12 to FIG. 16, the second sub-field pattern is formed by 10 sub-fields SC to SF10, the weights of the respective sub-fields SC to SF10 are 1, 3, 6, 13, 20, 27, 34, 42, 50 and 59, and the weight of each sub-field corresponds to the quantity of emission (luminance) at the time when this sub-field emits light. The weight of each sub-field can naturally be considered as the number of emission pulses assigned to each sub-field.

The second sub-field pattern shown in FIG. 12 to FIG. 16 is in a structure including, assuming that the sub-fields are SC, SF2, . . . , SFM, . . . , SFN successively from a sub-field having a small or equal weight, at least one such sub-field SFM that the difference between the weight of the sub-field SFM and the sum of the weights from the sub-field SC to the sub-field SF(M−1) exceeds the weight of the sub-field SC.

Assuming that M=4, for example, the weight of the sub-field SF4 is 13, and the sum of the weights from the sub-field SC to the sub-field SF3 is 10. The difference between the weight of the sub-field SF4 and the sum of the weights from the sub-field SC to the sub-field SF3 reaches 3, and is greater than 2 which is twice the weight 1 of the sub-field SC.

In the second sub-field pattern shown in FIG. 12 to FIG. 16, gray scales of a video signal continuously include at least two or more non-display gray levels non-displayable by combination of a plurality of sub-fields between display gray levels displayable by combination of a plurality of sub-fields. For example, a gray scale 11 and a gray scale 12 correspond thereto.

Also in this case, at least two display gray levels are continuous, only two non-display gray levels are included between display gray levels at the maximum, and non-display gray levels properly disperse between display gray levels. Therefore, the maximum gray level reaches 255, and the maximum gray level can be sufficiently enlarged without much increasing the number of sub-fields.

In the second sub-field pattern shown in FIG. 12 to FIG. 16, such gray scales that numerals other than zero are entered in columns of errors correspond to non-display gray levels of a first group, and such gray scales that numerals are entered in columns of dithers correspond to non-display gray levels of a second group.

That is, the non-display gray level 12 of the first group is converted to the non-display gray level 11 of the second group, and 1 which is the difference between the converted gray scale and the original gray scale is error-diffused to peripheral pixels.

The non-display gray level 11 of the second group is displayed with a display gray level 9 and a display gray level 13 by letting 2 which is the difference between the same and the display gray level 9 and the difference between the same and the display gray level 13 be alternately added or subtracted between peripheral pixels or fields.

Also in this case, non-display gray levels such as 2, 5 etc. cannot be displayed when employing combination of the respective fields SC to SF10 as such, while dither gray levels are dither-diffused among non-display gray levels by the dither circuit 41, the remaining error diffusion gray levels are convereted into the gray levels shown in columns of converted values of FIG. 12 to FIG. 16 and values shown in columns of errors of FIG. 12 to FIG. 16 are error-diffused by the error diffusion circuit 22. Therefore, all non-display gray levels can be equivalently displayed with display gray levels also in this example, whereby the total number of gray scales reaches 256 gray scales, the total number of gray scales can also be sufficiently enlarged, and the maximum luminance can also be sufficiently enlarged.

While at least two non-display gray levels are continuously arranged between display gray levels in this embodiment as hereinabove described, one of at least two continuous non-display gray levels is diffused by alternately adding or subtracting the difference between the non-display gray level and a close display gray level between fields by the dither circuit 41, the other non-display gray level is converted into the gray level close to the non-display gray level among display gray levels and dither gray levels by the gray level conversion/diffusion circuit 2*b*, and the difference between the non-display gray level and the converted gray level is diffused to pixels around the pixel having this non-display gray level.

While at least two non-display gray levels are continuously arranged between display gray levels in this case, a non-display gray level of the first group is converted to a non-display gray level of the second group, the difference between the converted gray scale and the original gray scale is error-diffused to peripheral pixels, the non-display gray level of the second group is converted to a display gray level and the difference between the converted gray scale and the original gray scale is alternately added or subtracted between peripheral pixels or fields, whereby the non-display gray level is displayed with the display gray level.

Also when at least two non-display gray levels are continuous, therefore, it is possible to dither one thereof by dither diffusion processing while diffusing the other non-display gray level by error diffusion processing, all non-display gray levels can be displayed with display gray levels also when at least two non-display gray levels are continuous, and an effect similar to that of the first embodiment can be attained also in this embodiment.

In this embodiment, the first conversion means and the second conversion means are included in the aforementioned gray level conversion table 21*a*. The error diffusion means and the dither diffusion means are included in the aforementioned gray level conversion/diffusion circuit 2*b*.

Examples of other sub-field patterns employed for the plasma display devices according to the aforementioned first to third embodiments are now described. FIG. 17 to FIG. 21 are diagrams showing gray scale display examples by a third sub-field pattern employed for the plasma display devices according to the aforementioned first to third embodiments. Columns of converted values and errors of the following respective drawings show a case of diffusing all non-display gray levels by error diffusion processing, and converted values become non-converted essential gray levels while errors also become zero when dither diffusion processing is combined. Further, columns of dithers of the following respective drawings show a case of diffusing all non-display gray levels by dither diffusion processing.

As shown in FIG. 17 to FIG. 21, the third sub-field pattern is formed by nine sub-fields SC to SF9, the weights of the respective sub-fields SC to SF9 are 1, 3, 6, 14, 24, 35, 46, 57 and 69, and the weight of each sub-field corresponds to the quantity of emission (luminance) at the time when this sub-field emits light. The weight of each sub-field can naturally be considered as the number of emission pulses assigned to each sub-field.

The third sub-field pattern shown in FIG. 17 to FIG. 21 is in a structure including, assuming that the sub-fields are SC, SF2, . . . , SFM, . . . , SFN successively from a sub-field having a small or equal weight, at least one such sub-field SFM that the difference between the weight of the sub-field SFM and the sum of the weights from the sub-field SC to the sub-field SF(M−1) exceeds twice the weight of the sub-field SC.

Assuming that M=4, for example, the weight of the sub-field SF4 is 14, and the sum of the weights from the sub-field SC to the sub-field SF3 is 10. The difference between the weight of the sub-field SF4 and the sum of the weights from the sub-field SC to the sub-field SF3 reaches 4, and is greater than 2 which is twice the weight 1 of the sub-field SC.

In the second sub-field pattern shown in FIG. 17 to FIG. 21, gray scales of a video signal continuously include at least two or more non-display gray levels non-displayable by combination of a plurality of sub-fields between display gray levels displayable by combination of a plurality of sub-fields. For example, a gray scale 11, a gray scale 12 and a gray scale 13 correspond thereto.

Also in this case, at least two display gray levels are continuous, only three non-display gray levels are included between display gray levels at the maximum, and non-display gray levels properly disperse between display gray levels. Therefore, the maximum gray level reaches 255, and the maximum gray level can be sufficiently enlarged without increasing the number of sub-fields.

Also in this case, all non-display gray levels can be equivalently displayed with display gray levels by performing error diffusion processing and/or dither gray scale processing on non-display gray levels in response to the diffusion processing of the aforementioned respective embodiments although non-display gray levels such as 2 and 5 cannot be displayed when employing combination of the respective sub-fields SC to SF9 as such. Also in this case, therefore, the total number of gray scales reaches 256 gray scales, the total number of gray scales can also be sufficiently enlarged, and the maximum gray level can also be sufficiently enlarged.

In this example, its gray scale is a non-display gray level of a first group when performing diffusion by error diffusion processing, while its gray scale is a second non-display gray level when performing diffusion by dither diffusion processing. It is possible to execute error diffusion processing and dither diffusion processing in combination also in this example.

In this embodiment, the first conversion means and the second conversion means are included in the aforementioned gray level conversion table 21*a*. The error diffusion means and the dither diffusion means are included in the aforementioned gray level conversion/diffusion circuit 2*b*.

FIG. 22 to FIG. 26 are diagrams showing gray scale display examples by a fourth sub-field pattern employed for the plasma display devices according to the aforementioned first to third embodiments.

As shown in FIG. 22 to FIG. 26, the fourth sub-field pattern is formed by 11 sub-fields SC to SF11, the weights of the respective sub-fields SC to SF11 are 1, 2, 4, 8, 16, 33, 35, 36, 38, 40 and 42, and the weight of each sub-field corresponds to the quantity of emission (luminance) at the time when this sub-field emits light.

In this case, only two non-display gray levels are included in total, and display gray levels are substantially continuous. Therefore, the maximum gray level reaches 255, and the maximum gray level can be sufficiently enlarged without much increasing the number of sub-fields, while substantially total gray levels can be displayed by employing the display gray levels as such.

Also in this example, all non-display gray levels can be equivalently displayed with display gray levels by performing error diffusion processing and/or dither gray scale processing on non-display gray levels in response to the diffusion processing of the aforementioned respective embodiments although non-display gray levels of 32 and 223 cannot be displayed when employing combination of the respective sub-fields SC to SF11 as such. Also in this example, therefore, the total number of gray scales reaches 256 gray scales, the total number of gray scales can also be sufficiently enlarged, and the maximum gray level can also be sufficiently enlarged.

Figure 27:
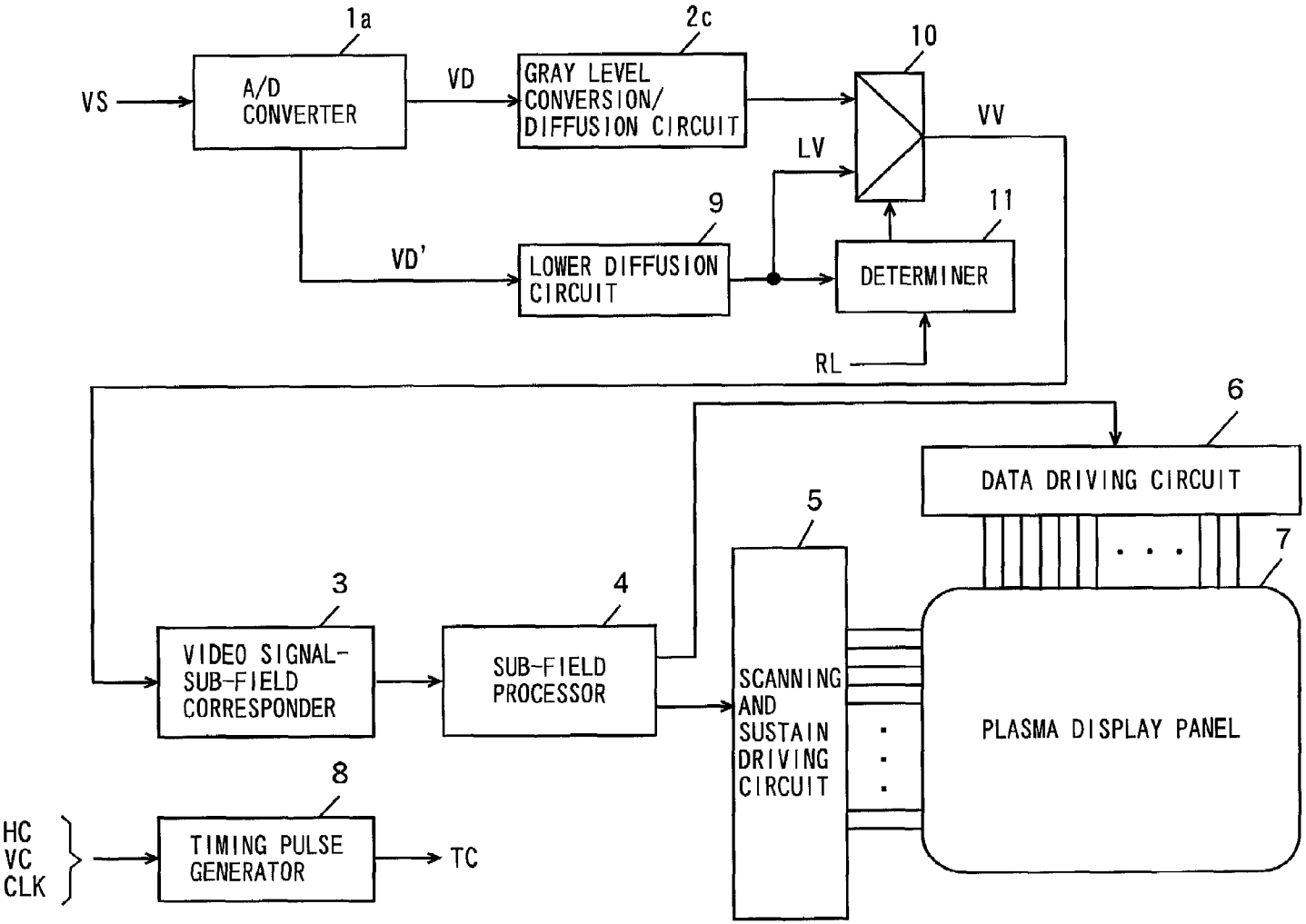
FIG. 27 is a block diagram showing the structure of a plasma display device according to a fourth embodiment of the present invention

A plasma display device according to a fourth embodiment of the present invention is now described. FIG. 27 is a block diagram showing the structure of the plasma display device according to the fourth embodiment of the present invention.

The point different between the plasma display device shown in FIG. 27 and the plasma display device shown in FIG. 1 is the point that the A/D converter 1 and the gray level conversion/diffusion circuit 2 are changed to an A/D converter 1*a*, a gray level conversion/diffusion circuit 2*c*, a lower diffusion circuit 9, a selection circuit 10 and a determiner 11 while the remaining points are similar to those of the plasma display device shown in FIG. 1, and hence the same numerals are assigned to identical parts and only different points are now described in detail.

The A/D converter 1*a* converts an analog video signal VS to image data VD' having a prescribed bit number and outputs the same to the lower diffusion circuit 9, while truncating data of the least significant bit of the image data VD', converting the same to image data VD less by one bit, and outputting the same to the gray level conversion/diffusion circuit 2. As to the bit number of the image data VD' input in the lower diffusion circuit 9, various bit numbers can be employed so far as the same can express a bit lower by one than a bit corresponding to the minimum gray level among gray levels expressible by combination of sub-fields.

This embodiment employs the first sub-field pattern shown in FIG. 4 to FIG. 8, for example, as a plurality of sub-fields. In the first sub-field pattern, therefore, 256 gray scales are expressed by data of 8 bits, the maximum gray level expressible by combination of sub-fields is 255, the minimum gray level is 1, and the bit number of the image data VD' input in the lower diffusion circuit 9 is 9. The used sub-fields are not particularly restricted to the aforementioned example but various sub-fields such as the second to fourth sub-field patterns can be employed, and this also applies to the subsequent respective embodiments.

The gray level conversion/diffusion circuit 2*c* is structured similarly to the gray level conversion/diffusion circuit 2 shown in FIG. 2 and converts the gray level of the image data VD of 8 bits to a display gray level when the same is a non-display gray level, while spatially diffusing the difference between the non-display gray level and the display gray level by error diffusion processing and outputting image data of 8 bits after conversion to the selection circuit 10. The gray level conversion/diffusion circuit 2*c* is not particularly restricted to the gray level conversion/diffusion circuit 2 shown in FIG. 2, but the dither circuit 2*a* shown in FIG. 9 or the gray level conversion/diffusion circuit 2*b* shown in FIG. 11 may be employed.

The lower diffusion circuit 9 receives the image data VD' of 9 bits, diffuses the data of the least significant bit between fields or between pixels in order to display a gray level half the minimum gray level, and outputs image data LV of 8 bits after diffusion to the selection circuit 10 and the determiner 11.

The determiner 11 compares a reference signal RL expressing the minimum value of non-display gray levels created in the device with the gray level of the image data LV diffused by the lower diffusion circuit 9 and instructs the selection circuit 10 to select the output of the gray level conversion/diffusion circuit 2*c* when the gray level of the image data LV diffused by the lower diffusion circuit 9 is in excess of the minimum value (RL) of the non-display gray levels while otherwise instructing the selection circuit 10 to select the output of the lower diffusion circuit 9. In this embodiment, the first sub-field pattern is employed, and the minimum value (RL) of the non-display gray levels reaches 2.

According to the instruction of the determiner 11, the selection circuit 10 selects the output of the gray level conversion/diffusion circuit 2*c* when the gray level of the image data diffused by the lower diffusion circuit 9 is in excess of the minimum value (RL) of the non-display gray levels while otherwise selecting the output of the lower diffusion circuit 9, and outputs selected image data VV to a video signal-sub-field corresponder 3. Thereafter the image data is processed similarly to the first embodiment.

Figure 28:
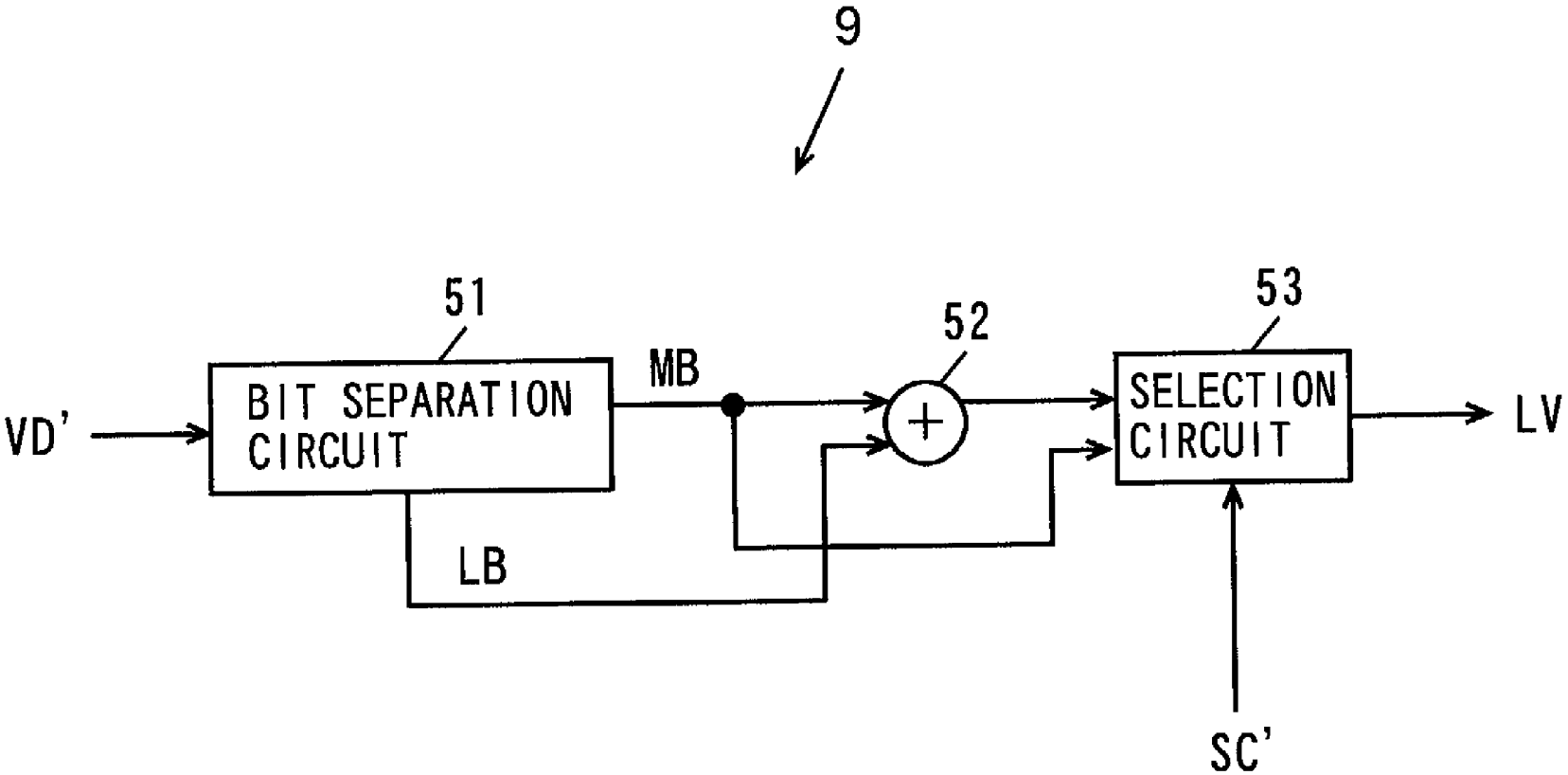
FIG. 28 is a block diagram showing the structure of an exemplary lower diffusion circuit shown in FIG. 27

FIG. 28 is a block diagram showing an exemplary structure of the lower diffusion circuit 9 shown in FIG. 27. The lower diffusion circuit 9 shown in FIG. 28 includes a bit separation circuit 51, an adder 52 and a selection circuit 53.

The bit separation circuit 51 outputs data MB of upper 8 bits of the input image data VD' of 9 bits to the adder 52 and the selection circuit 53, while outputting data LB of the least significant bit to the adder 52.

The adder 52 adds the data MB of the upper 8 bits and the data LB of the least significant bit, and outputs the added data of 8 bits to the selection circuit 53. The selection circuit 53, in which a selection signal SC' prepared by a timing pulse generator 8 is input, alternates the output of the adder 52 and the output MB of the bit separation circuit 51 in an even field and an odd field of one field at prescribed timing, and outputs the image data LV of 8 bits after diffusion.

According to the aforementioned structure, the lower diffusion circuit 9 can diffuse the data of the least significant bit between fields and display the gray level half the minimum gray level with the diffused image data. The diffusion processing of the data of the least significant bit by the lower diffusion circuit 9 is not particularly restricted to the aforementioned example but the same may be diffused between pixels.

In this embodiment, the gray level conversion/diffusion circuit 2*c* corresponds to the diffusion means and the error diffusion means, a video signal-sub-field corresponder 3 corresponds to the sub-field correspondence means, and a sub-field processor 4, a scanning and sustain driving circuit 5 and a data driving circuit 6 correspond to the emission means. The lower diffusion circuit 9 corresponds to the lower diffusion means, and the selection circuit 10 and the determiner 11 correspond to the selection means.

According to the aforementioned structure, an effect similar to that of the first embodiment can be attained in this embodiment, while the data of the bit lower by one than the bit of the digital video signal corresponding to the minimum gray level is diffused between fields by the lower diffusion circuit 9, and the output of the gray level conversion/diffusion circuit 2*c* is selected by the selection circuit 10 when the gray level of the diffused digital video signal is in excess of the minimum value (RL) of the non-display gray levels while the output of the lower diffusion circuit 9 is selected otherwise, i.e., in the case of a low gray level. Therefore, the gray level half the minimum gray level can be equivalently displayed when the gray level is a low gray level, and resolution of the low gray level can be more refined.

Figure 29:
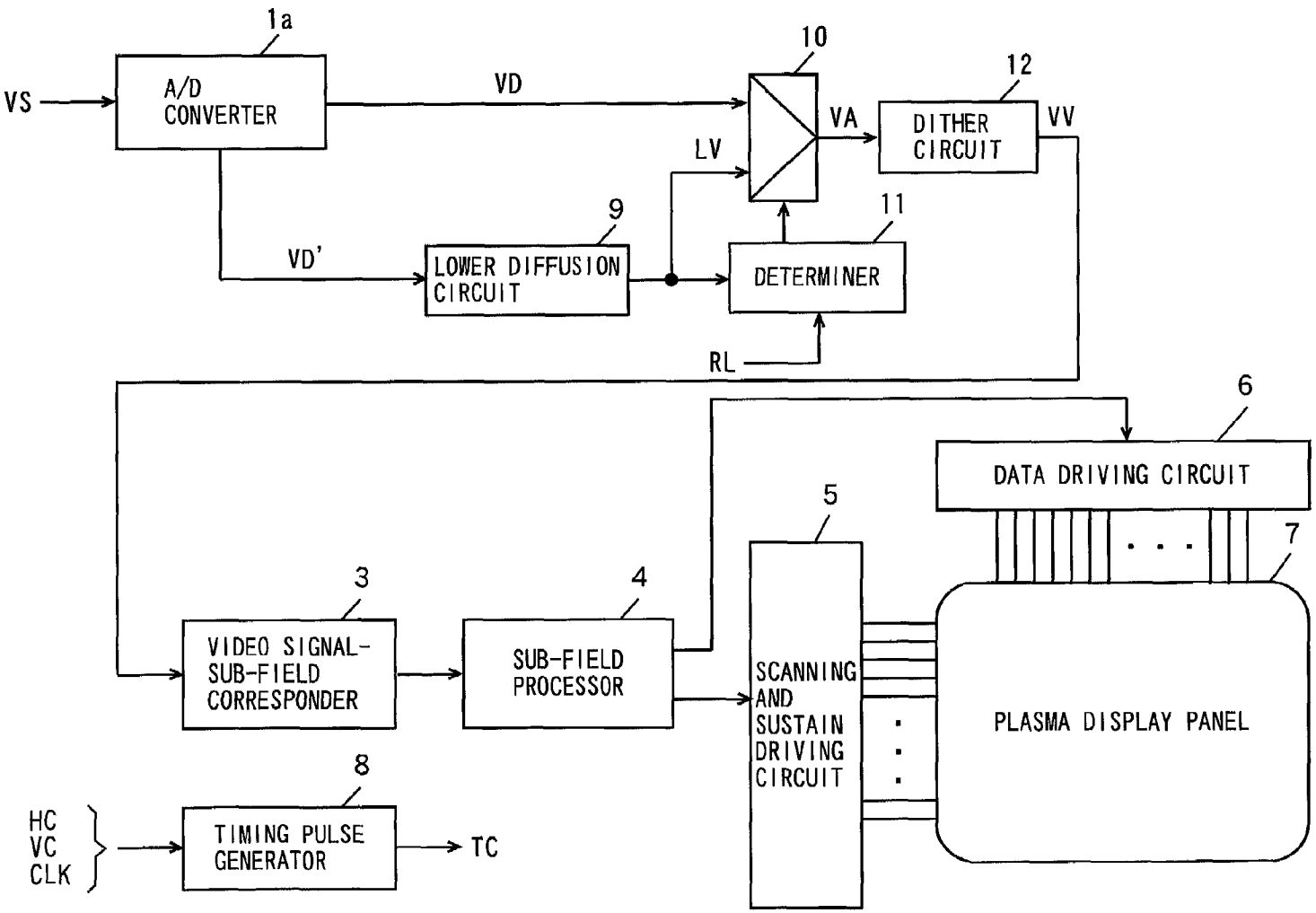
FIG. 29 is a block diagram showing the structure of a plasma display device according to a fifth embodiment of the present invention

A plasma display device according to a fifth embodiment of the present invention is now described. FIG. 29 is a block diagram showing the structure of the plasma display device according to the fifth embodiment of the present invention.

The point different between the plasma display device shown in FIG. 29 and the plasma display device shown in FIG. 27 is the point that the gray level conversion/diffusion circuit 2*c* is omitted and a dither circuit 12 is added, while the remaining points are similar to those of the plasma display device shown in FIG. 27 and hence the same reference numerals are assigned to identical parts and only the different point is now described in detail.

An A/D converter 1*a* converts an analog video signal VS to image data VD' of a prescribed bit number such as 9 bits, for example, and outputs the same to a lower diffusion circuit 9 while converting the image data VD' of 9 bits to image data VD of 8 bits by truncating data of the least significant bit and outputting the same to a selection circuit 10.

The lower diffusion circuit 9 and a determiner 11 operate similarly to the fourth embodiment, and the selection circuit 10 selects the output of the A/D converter 1*a* when the gray level of image data diffused by the lower diffusion circuit 9 is in excess of the minimum value (RL) of non-display gray levels while otherwise selecting the output of the lower diffusion circuit 9 according to an instruction of the determiner 11, and outputs selected image data VA to the dither circuit 12.

The dither circuit 12, structured similarly to the dither circuit 2*a* shown in FIG. 9, generates, when the gray level of the input image data VA of 8 bits is a non-display gray level, image data for making display by alternating display gray levels horizontally separating from this gray level by the dither between an even field and an odd field of one field and outputs generated image data VV of 8 bits to a video signal-sub-field corresponder 3. Thereafter the image data is processed similarly to the first embodiment. The dither circuit 12 is not particularly restricted to the dither circuit shown in FIG. 9, but may diffuse the dither between pixels with a prescribed dither pattern and spatially perform diffusion.

In this embodiment, the dither circuit 12 corresponds to the diffusion means and the dither diffusion means, the video signal-sub-field corresponder 3 corresponds to the sub-field correspondence means, and a sub-field processor 4, a scanning and sustain driving circuit 5 and a data driving circuit 6 correspond to the emission means. The lower diffusion circuit 9 corresponds to the lower diffusion means, and the selection circuit 10 and the determiner 11 correspond to the selection means.

According to the aforementioned structure, an effect similar to that of the second embodiment can be attained in this embodiment, while data of a bit lower by one than the bit of the digital video signal corresponding to the minimum gray level is diffused between fields by the lower diffusion circuit 9, the output of the A-D converter 1*a* is selected by the selection circuit 10 when the gray level of the diffused digital video signal is in excess of the minimum value (RL) of non-display gray levels, the output of the lower diffusion circuit 9 is selected otherwise, i.e., in the case of a low gray level, and the selected digital video signal is subjected to dither diffusion processing by the dither circuit 12. Therefore, a non-display gray level can be expressed with a display gray level by this dither diffusion processing, while a gray level half a minimum gray level can be equivalently displayed when the gray level is a low gray level, and resolution of the low gray level can be more refined.

Figure 30:
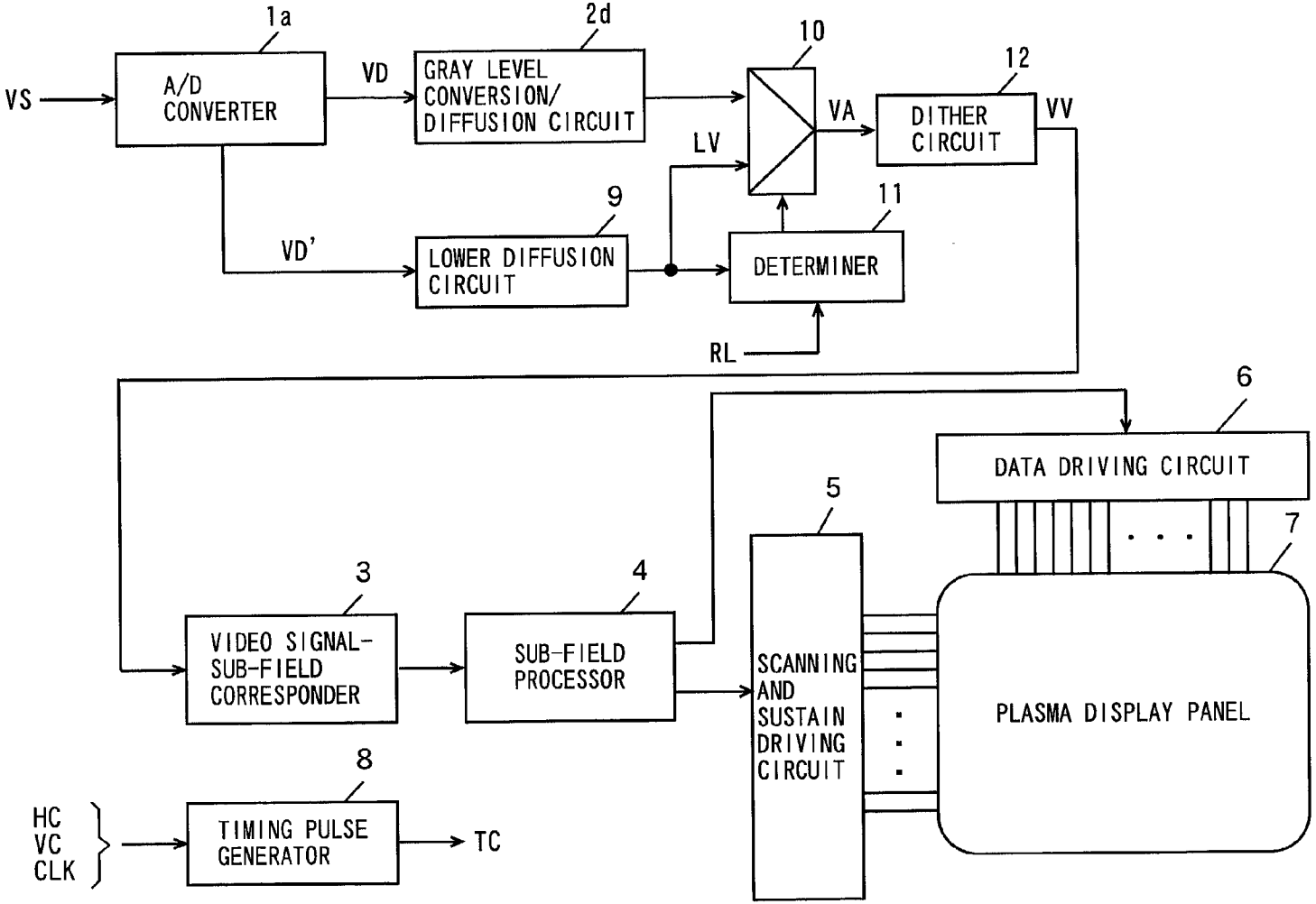
FIG. 30 is a block diagram showing the structure of a plasma display device according to a sixth embodiment of the present invention

A plasma display panel according to a sixth embodiment of the present invention is now described. FIG. 30 is a block diagram showing the structure of the plasma display device according to the sixth embodiment of the present invention.

The point different between the plasma display device shown in FIG. 30 and the plasma display device shown in FIG. 27 is the point that the gray level conversion/diffusion circuit 2*c* is changed to a gray level conversion/diffusion circuit 2*d* while a dither circuit 12 is added, and the remaining points are similar to those of the plasma display device shown in FIG. 27, and hence the same reference numerals are assigned to identical parts and only the different point is now described in detail.

The gray level conversion/diffusion circuit 2*d* is structured similarly to the gray level conversion table 21*a* and the error diffusion circuit 22 shown in FIG. 11 and converts, when the gray level of image data VD of 8 bits is a non-display gray level, the same to a display gray level or a dither gray level while spatially diffusing the difference between the non-display gray level and the converted gray level by error diffusion processing and outputting the image data of 8 bits after conversion to a selection circuit 10.

According to an instruction of a determiner 11, the selection circuit 10 selects the output of the gray level conversion/diffusion circuit 2*d* when the gray level of image data diffused by a lower diffusion circuit 9 is in excess of the minimum value (RL) of non-display gray levels while otherwise selecting an output of the lower diffusion circuit 9, and outputs selected image data VA to the dither circuit 12.

The dither circuit 12, structured similarly to the dither circuit 41 shown in FIG. 11, generates, when the gray level of input image data VB of 8 bits is a dither gray level, image data for making display by alternating display gray levels horizontally separating from this dither gray level by the dither between an even field and an odd field of one field and outputs generated image data VV of 8 bits to a video signal-sub-field corresponder 3. Thereafter the image data is processed similarly to the first embodiment. The dither circuit 12 is not particularly restricted to the aforementioned example, but may diffuse the dither between pixels with a prescribed dither pattern and spatially perform diffusion.

In this embodiment, the gray level conversion/diffusion circuit 2*d* corresponds to the diffusion means and the error diffusion means, the video signal-sub-field corresponder 3 corresponds to the sub-field correspondence means, and a sub-field processor 4, a scanning and sustain driving circuit 5 and a data driving circuit 6 correspond to the emission means. The lower diffusion means 9 corresponds to the lower diffusion means, the selection circuit 10 and the determiner 11 correspond to the selection means, and the dither circuit 12 corresponds to the dither diffusion means.

According to the aforementioned structure, an effect similar to that of the third embodiment can be attained in this embodiment, while one of at least two continuous non-display gray levels is diffused by alternately adding or subtracting the difference between the non-display gray level and a close display gray level between fields by the dither circuit 12 also when at least two non-display gray levels are continuous between display gray levels as in the second sub-field pattern, and the other non-display gray level included in at least two continuous non-display gray levels is converted to a gray level close to the non-display gray level among display gray levels and dither gray levels by the gray level conversion/diffusion circuit 2*a* so that the difference between the non-display gray level and the converted gray level is diffused to pixels around a pixel having this non-display gray level.

Data of a bit lower by one than a bit of a digital video signal corresponding to the minimum gray level is diffused between fields by the lower diffusion circuit 9 and the output of the gray level conversion/diffusion circuit 2*d* is selected by the selection circuit 10 when the gray level of the diffused digital video signal is in excess of the minimum value (RL) of non-display gray levels while the output of the lower diffusion circuit 9 is selected otherwise, i.e., in the case of a low gray level.

Also when at least two non-display gray levels are continuous, therefore, it is possible to diffuse one by dither diffusion processing and diffuse the other non-display gray level by error diffusion processing, while a gray level half a minimum gray level can be equivalently displayed when the gray level is a low gray level, and resolution of the low gray level can be more refined.

The number, the weights etc. of sub-fields applied to the plasma display device according to the present invention are not particularly restricted to the aforementioned respective examples but various modifications are available.

According to the present invention, a plurality of sub-fields are so weighted that at least one non-display gray level non-displayable by combination thereof is arranged between display gray levels displayable by combination thereof and the difference between the non-display gray level and the display gray levels is temporally and/or spatially diffused when a video signal is a video signal of a non-display gray level, whereby the non-display gray level can be equivalently displayed with a display gray level. Therefore, display of all gray levels including display gray levels and non-display gray levels becomes possible, the maximum gray level and the total number of displayable gray scales can be sufficiently enlarged, and low gray levels can also be sufficiently finely reproduced. Consequently, the maximum gray level and the total number of displayable gray scales can be sufficiently enlarged while reproducibility for low gray levels can be improved without increasing the number of division of sub-fields.

The invention claimed is:

1. A display device providing a gray scale display by controlling in accordance with an input video signal individual pixels on a display panel so that each pixel emits light or does not emit light in individual sub-fields that are defined by dividing one field and arranged on a time base in a prescribed order, said sub-fields being weighted to represent gray levels;

wherein said plurality of sub-fields are weighted in such a way that at least one non-display gray level which cannot be displayed by combining said plurality of sub-fields is arranged between displayable gray levels by combining said plurality of sub-fields, and wherein said display device comprises, a diffuser that receives said video signal for, when said video signal represents said non-display gray level, diffusing temporally and/or spatially a difference between said non-display gray level and one of said display gray levels so that said non-display gray level can be equivalently displayed with said display gray levels;

a sub-field corresponder that converts a video signal representing one field output from said diffuser into a video signal representing individual sub-fields; and an emitter that controls said pixels on said display panel so that each pixel emits light or does not emit light in said individual sub-fields, in accordance with said video signal representing said individual sub-fields output from said sub-field corresponder.

2. The display device according to claim 1, wherein said diffuser includes:

a gray level converter that converts said non-display gray level into one of said display gray levels that is close to said non-display gray level, and an error diffuser that diffuses, when said non-display gray level is converted into said one of said display gray levels by said gray level converter, a defference between said non-display gray level and said one of said display gray levels to pixels around a pixel having said non-display gray level.

3. The display device according to claim 1, wherein said diffuser includes:

a dither diffuser that alternately adds or subtracts a difference between said non-display gray level and one of said display gray levels that is close to said non-display gray level to diffuse between fields or between pixels.

4. The display device according to claim 1, wherein at least two continuous non-display gray levels are included between said display gray levels, and said diffuser includes:

a dither diffuser that alternately adds or subtracts a difference between one non-display gray level included in said at least two continuous non-display gray levels and one of said display gray levels that is close to said one non-display gray level to diffuse between fields or between pixels, a gray level converter that converts another non-display gray level included in said at least two continuous non-display gray levels into a gray level close to said another non-display gray level among said display gray levels and a gray level rendered displayable by said dither diffusion means, and an error diffuser that diffuses, when said another non-display gray level is converted by said gray level converter, a difference between said another non-display gray level and the converted gray level to pixels around a pixel having said another non-display gray level.

5. The display device according to claim 1, wherein said video signal is a digital video signal expressed by a plurality of bits, and wherein said display device further comprises, a lower diffuser that receives said digital video signal for diffusing between fields or between pixels data of a bit lower by one digit than a bit in said digital video signal corresponding to a minimum gray level expressed by the least significant sub-field having the minimum weight among weights representing gray levels, so as to display a gray level which is half said minimum gray level, and a selector that selects an output of said diffuser when the gray level of the digital video signal output from said lower diffuser is not less than the minimum value of said non-display level and for selecting an output of said lower diffuser when the gray level of the digital video signal output from said lower diffuser is less than the minimum value of said non-display gray level and for outputting the selected output to said sub-field corresponder.

6. The display device according to claim 1, wherein said video signal is a digital video signal expressed by a plurality of bits, and wherein said display device further comprises, a lower diffuser that receives said digital video signal for diffusing between fields or between pixels data of a bit lower by one digit than a bit in said digital video signal corresponding to a minimum gray level expressed by the least significant sub-field having the minimum weight among weights representing gray levels, so as to display a gray level which is half said minimum gray level, and a selector that selects the digital video signal not yet diffused by said lower duffuser when the gray level of the digital video signal output from said lower diffuser is not less than the minimum value of said non-display gray level and for selecting an output of said lower diffuser when the gray level of the digital video signal output from said lower diffuser is less than the minimum value of said non-display gray level, and wherein said diffuser includes a dither diffuser that receives the digital video signal output from said selector, for alternately adding or subtracting a difference between said non-display gray level and a display one of gray levels that is close to said non-display gray level to diffuse between fields or between pixels.

7. The display device according to claim 1, wherein said video signal is a digital video signal expressed by a plurality of bits, at least two continuous non-display gray levels are included between said display gray levels, and wherein said display device further comprises, a lower diffuser that receives said digital video signal, for diffusing between fields or between pixels data of a bit lower by one digit than a bit in said digital video signal corresponding to a minimum gray level expressed by the least significant sub-field having the minimum weight among weights representing gray levels, so as to display a gray level which is half said minimum gray level, a selector that selects an output of said diffuser when the gray level of the digital video signal output from said lower diffuser is not less than the minimum value of said non-display gray level and for selecting an output of said lower diffuser when the gray level of the digital video signal output from said lower diffuser is less than the minimum value of said non-display gray level, and a dither diffuser that receives the digital video signal output from said selector, for alternately adding or subtracting a difference between one non-display gray level included in said at least two continuous non-display gray levels and one of said display gray levels that is close to said one non-display gray level to diffuse between fields or between pixels, said diffuser includes:

a gray level converter that converts another non-display gray level included in said at least two continuous non-display gray levels into a gray level close to said another non-display gray level among said display gray levels and a gray level rendered displayable by said dither diffuser, and an error diffuser for diffuses, when said another non-display gray level is converted by said gray level converter, a difference between said another non-display gray level and the converted gray level to pixels around a pixel having said another non-display gray level.

8. A display method for providing a gray scale display by controlling in accordance with an input video signal individual pixels on a display panel so that each pixel emits light or does not emit light in individual sub-fields that are defined by dividing one field and arranged on a time base in a prescribed order, said sub-fields being weighted to represent gray levels;

wherein said plurality of sub-fields are weighted in such a way that at least one non-display gray level which cannot be displayed by combining said plurality of sub-fields is arranged between displayable gray levels by combining said plurality of sub-fields, and wherein said display method comprises:

receiving said video signal for, when said video signal represents said non-display gray level, diffusing temporally and/or spatially a difference between said non-display gray level and one of said display gray levels so that said non-display gray level can be equivalently displayed with said display gray levels;

converting a video signal representing one field processed by-diffusing into a video signal representing individual sub-fields; and controlling said pixels on said display panel so that each pixel emits light or does not emit light in said individual sub-fields in accordance with said converted video signal representing said individual sub-fields.

9. The display method according to claim 8, wherein diffusing includes:

converting said non-display gray level into one of said display gray levels that is close to said non-display gray level, and diffusing, when said non-display gray level is converted into said one of said display gray levels, a difference between said non-display gray level and said one of said display gray levels to pixels around a pixel having said non-display gray level.

10. The display method according to claim 8, wherein diffusing includes:

alternately adding or subtracting a difference between said non-display gray level and one of said display gray levels that is close to said non-display gray level to diffuse between fields or between pixels.

11. The display method according to claim 8, wherein at least two continuous non-display gray levels are included between said display gray levels, and wherein diffusing includes:

alternately adding or subtracting a difference between one non-display gray level included in said at least two continuous non-display gray levels and one of said display gray levels that is close to said one non-display gray level to diffuse between fields or between pixels, converting another non-display gray level included in said at least two continuous non-display gray levels to a gray level close into said another non-display gray level among said display gray levels and a gray level rendered displayable in said step of adding or subtracting to diffuse, and diffusing, when said another non-display gray level is converted, a difference between said another non-display gray level and the converted gray level to pixels around a pixel having said another non-display gray level.

12. The display method according to claim 8, wherein said video signal is a digital video signal expressed by a plurality of bits, and wherein said display method further comprises:

receiving said digital video signal for diffusing between fields or between pixels data of a bit lower by one digit than a bit in said digital video signal corresponding to a minimum gray level expressed by the least significant sub-field having the minimum weight among weights representing gray levels, so as to display a gray level which is half said minimum gray level, and selecting the digital video signal processed by diffusing temporally and/or spatially when the gray level of the digital video signal obtained by diffusing said data of a bit lower by one digit is not less than the minimum value of said non-display gray level or selecting the digital video signal obtained by diffusing said data of a bit lower by one digit when the gray level of the digital video signal obtained by diffusing said data of a bit lower by one digit is less than the minimum value of said non-display gray level.

13. The display method according to claim 8, wherein said video signal is a digital video signal expressed by a plurality of bits, and wherein said display method further comprises:

receiving said digital video signal for diffusing between fields or between pixels data of a bit lower by one digit than a bit in said digital video signal corresponding to a minimum gray level expressed by the least significant sub-field having the minimum weight among weights representing gray levels, so as to display a gray level which is half said minimum gray level, and selecting the digital video signal not processed by diffusing said data of a bit lower by one digit when the gray level of the digital video signal obtained by diffusing said data of a bit lower by one digit is not less than the minimum value of said non-display gray level or selecting the digital video signal obtained by diffusing said data of a bit lower by one digit when the gray level of the digital video signal obtained by diffusing said data of a bit lower by one digit is less than the minimum value of said non-display gray level, and wherein diffusing temporally and/or spatially includes receiving the selected digital video signal, for alternately adding or subtracting a difference between said non-display gray level and one of gray levels that is close to said non-display gray level to diffuse between fields or between pixels.

14. The display method according to claim 8, wherein said video signal is a digital video signal expressed by a plurality of bits, and at least two continuous non-display gray levels are included between said display gray levels, and wherein said display method further comprises:

receiving said digital video signal for diffusing between fields or between pixels data of a bit lower by one digit than a bit in said digital video signal corresponding to a minimum gray level expressed by the least significant sub-field having the minimum weight among weights representing gray levels, so as to display a gray level which is half said minimum gray level, selecting the digital video signal processed by diffusing temporally and/or spatially when the gray level of the digital video signal obtained by diffusing said data of a bit lower by one digit is not less than the minimum value of said non-display gray level or selecting the digital video signal obtained by diffusing said data of a bit lower by one digit when the gray level of the digital video signal obtained by diffusing said data of a bit lower by one digit is less than the minimum value of said non-display gray level, and receiving the selected digital video signal, for alternately adding or subtracting a difference between one non-display gray level included in said at least two continuous non-display gray levels and one of said display gray levels that is close to said one non-display gray level to diffuse between fields or between pixels, and wherein diffusing temporally and/or spatially includes:

converting another non-display gray level included in said at least two continuous non-display gray levels into a gray level close to said another non-display gray level among said display gray levels and a gray level rendered displayable in said step of adding or subtracting to diffuse, and diffusing, when said another non-display gray level is converted, a difference between said another non-display gray level and the converted gray level to pixels around a pixel having said another non-display gray level.

15. A display device providing a gray scale display by controlling in accordance with an input video signal individual pixels on a display panel so that each pixel emits light or does not emit light in individual sub-fields that are defined by dividing one field and arranged on a time base in a prescribed order, said sub-fields being weighted to represent gray levels;

wherein said plurality of sub-fields are weighted in such a way that at least one non-display gray level which cannot be displayed by combining said plurality of sub-fields is arranged between displayable gray levels by combining said plurality of sub-fields, and wherein said display device comprises, a duffusion circuit that receives said video signal for, when said video signal represents said non-display gray level, diffusing temporally and/or spatially a difference between said non-display gray level and one of said display gray levels so that said non-display gray level can be equivalently displayed with said display gray levels;

a sub-field corresponder that converts a video signal representing one field output from said diffusion circuit into a video signal representing individual sub-fields; and an emitting circuit that controls said pixels on said display panel so that each pixel emits light or does not emit light in said individual sub-fields, in accordance with said video signal representing said individual sub-fields output from said sub-field corresponder.

16. The display device according to claim 15, wherein said duffusion circuit includes:

a gray level conversion table that converts said non-display gray level into one of said display gray levels that is close to said non-display gray level, and an error diffusion circuit that diffuses, when said non-display gray level is converted into said one of said display gray levels by said gray level conversion table, a difference between said non-display gray level and said one of said display gray levels to pixels around a pixel having said non-display gray level.

17. The display device according to claim 15, wherein said diffusion circuit includes:

a dither duffusion circuit that alternately adds or subtracts a difference between said non-display gray level and one of said display gray levels that is close to said non-display gray level to diffuse between fields or between pixels.

18. The display device according to claim 15, wherein at least two continuous non-display gray levels are included between said display gray levels, and said diffusion circuit includes:

a dither diffusion circuit that alternately adds or subtracts a difference between one non-display gray level included in said at least two continuous non-display gray levels and one of said display gray levels that is close to said one non-display gray level to diffuse between fields or between pixels, a gray level conversion table that converts another non-display gray level included in said at least two continuous non-display gray levels into a gray level close to said another non-display gray level among said display gray levels and gray level rendered displayable by said dither diffusion circuit, and an error diffusion circuit that diffuses, when said another non-display gray level is converted by said gray level conversion table, a difference between said another non-display gray level and the converted gray level to pixels around a pixel having said another non-display gray level.

19. The display device according to claim 15, wherein said video signal is a digital video signal expressed by a plurality of bits, and wherein said display device further comprises, a lower diffusion circuit that receives said digital video signal for diffusing between fields or between pixels data of a bit lower by one digit than a bit in said digital video signal corresponding to a minimum gray level expressed by the least significant sub-field having the minimum weight among weights representing gray levels, so as to display a gray level which is half said minimum gray level, and a selection circuit that selects an output of said diffusion circuit when the gray level of the digital video signal output from said lower diffusion circuit is not less than the minimum value of said non-display gray level and selects an output of said lower diffusion circuit when the gray level of the digital video signal output from said lower diffusion circuit is less than the minimum value of said non-display gray level and outputs the selected output to said sub-field corresponder.

20. The display device according to claim 15, wherein said video signal is a digital video signal expressed by a plurality of bits, and wherein said display device further comprises, a lower diffusion circuit that receives said digital video signal for diffusing between fields or between pixels data of a bit lower by one digit than a bit in said digital video signal corresponding to a minimum gray level expressed by the least significant sub-field having the minimum weight among weights representing gray levels, so as to display a gray level which is half said minimum gray level, and a selection circuit that selects the digital video signal not yet diffused by said lower diffusion circuit when the gray level of the digital video signal output from said lower diffusion circuit is not less than the minimum value of said non-display gray level and selects an output of said lower diffusion circuit when the gray level of the digital video signal output from said lower diffusion circuit is less than the minimum value of said non-display gray level, and wherein said diffusion circuit includes a dither diffusion circuit that receives the digital video signal output from said selection circuit, for alternately adding or subtracting a difference between said non-display gray level and one of gray levels that is close to said non-display gray level to diffuse between fields or between pixels.

21. The display device according to claim 15, wherein said video signal is a digital video signal expressed by a plurality of bits, at least two continuous non-display gray levels are included between said display gray levels, and wherein said display device further comprises, a lower diffusion circuit that receives said digital video signal for diffusing between fields or between pixels data of a bit lower by one digit than a bit in said digital video signal corresponding to a minimum gray level expressed by the least significant sub-field having the minimum weight among weights representing gray levels, so as to display a gray level which is half said minimum gray level, a selection circuit that selects an output of said diffusion circuit when the gray level of the digital video signal output from said lower diffusion circuit is not less than the minimum value of said non-display gray level and selects an output of said lower diffusion circuit when the gray level of the digital video signal output from said lower diffusion circuit is less than the minimum value of said non-display gray level, and a dither diffusion circuit that receives the digital video signal output from said selection circuit, for alternately adding or subtracting a difference between one non-display gray level included in said at least two continuous non-display gray levels and one of said display gray levels that is close to said one non-display gray level to diffuse between fields or between pixels, said diffusion circuit includes:

a gray level converter table that converts another non-display gray level included in said at least two continuous non-display gray levels into a gray level close to said another non-display gray level among said display gray levels and gray level rendered displayable by said dither diffusion circuit, and an error diffusion circuit that diffuses, when said another non-display gray level is converted by said gray level converter table, a difference between said another non-display gray level and the converted gray level to pixels around a pixel having said another non-display gray level.

* * * * *

UNITED STATES PATENT AND TRADEMARK OFFICE

CERTIFICATE OF CORRECTION

PATENT NO. : 7,236,147 B2
APPLICATION NO. : 10/069526
DATED : June 26, 2007
INVENTOR(S) : Tomoko Morita et al.

It is certified that error appears in the above-identified patent and that said Letters Patent is hereby corrected as shown below:

At column 40, line 46 (claim 2, line 8), of the printed patent, change "defference" to -- difference --;

At column 41, line 26 (claim 5, line 26), of the printed patent, insert -- gray -- after "non-display"; and At column 47, line 6 (claim 21, line 39), of the printed patent, change "converter" to -- conversion --.

Signed and Sealed this

Fifth Day of August, 2008

JON W. DUDAS
*Director of the United States Patent and Trademark Office*